US005219724A

United States Patent [19]

Kato et al.

[11] Patent Number: 5,219,724

[45] Date of Patent: Jun. 15, 1993

[54] METHOD FOR PRODUCING A SILVER HALIDE PHOTOGRAPHIC LIGHT-SENSITIVE MATERIAL

[75] Inventors: Mariko Kato; Takeshi Sampei, both of Hino, Japan

[73] Assignee: Konica Corporation, Tokyo, Japan

[21] Appl. No.: 797,040

[22] Filed: Nov. 25, 1991

[30] Foreign Application Priority Data

Nov. 27, 1990 [JP] Japan ..... 2-327412

[51] Int. Cl.[5] ..... G03C 1/34; G03C 1/74; G03C 11/16

[52] U.S. Cl. ..... 430/607; 430/551; 430/608; 430/610; 430/935

[58] Field of Search ..... 430/610, 608, 607, 551, 430/501, 935, 349, 579

[56] References Cited

U.S. PATENT DOCUMENTS

| | | | |
|---|---|---|---|
| 4,013,469 | 3/1977 | Haga et al. | 430/608 |
| 4,681,836 | 7/1987 | Inoue et al. | 430/608 |
| 4,914,003 | 4/1990 | Yagihara et al. | 430/607 |
| 4,946,769 | 8/1990 | Arai et al. | 430/935 |
| 4,962,017 | 10/1990 | Nakamura | 430/607 |
| 4,971,890 | 11/1990 | Okada et al. | 430/607 |
| 5,096,803 | 3/1992 | Kanetake et al. | 430/935 |
| 5,130,226 | 7/1992 | Sampei et al. | 430/607 |

*Primary Examiner*—Charles L. Bowers, Jr.
*Assistant Examiner*—Mark Huff
*Attorney, Agent, or Firm*—Finnegan, Henderson, Farabow, Garrett & Dunner

[57] ABSTRACT

A method of producing a silver halide photographic light-sensitive material is disclosed. The light-sensitive material comprises a support, provided thereon, a photographic layer including a silver halide emulsion layer and the photographic layer contains a hydrazine compound for forming an extremely high contrast image even when developed with a developer having a pH value of not higher than 11. The light-sensitive material is produced by the method comprising steps of coating a coating solution to form the photographic layer on the support, drying the coated layer, and packing the light-sensitive material after the drying step, wherein the drying of the coated layer is carried out with air having relative humidity of not more than 50% after the time when water amount contained in the coated layer reaches 300% of the dry-weight of binder contained in the coated layer. The light-sensitive material has inhibited in formation of pepper spots and gives high contrast image even after prolonged storage.

7 Claims, No Drawings

METHOD FOR PRODUCING A SILVER HALIDE PHOTOGRAPHIC LIGHT-SENSITIVE MATERIAL

FIELD OF THE INVENTION

The present invention relates to a method for producing a silver halide photographic light-sensitive material, particularly to a method for producing a silver halide photographic light-sensitive material capable of providing a high contrast.

BACKGROUND OF THE INVENTION

Photomechanical process contains a process to convert an original of continuous gradation into dot images. In this process, there has been used an infectious developing technique as a technique that enables image reproduction with ultrahard gradation.

Lith-type silver halide photographic light-sensitive materials to be developed with the infectious development comprise a silver-chloride-rich silver chlorobromide emulsion containing at least 50 mol % of silver chloride and grains of which have a uniform shape and a narrow grain size distribution with an average value, for example, of 0.2 μm. When these lith-type silver halide photographic light-sensitive materials are processed with an alkaline hydroquinone developer of low sulfite ion concentration, a so-called lith-type developer, images of high contrast, high sharpness and high resolution can be obtained.

The lith-type developer, however, is poor in preservability for its liability to air oxidation. And this makes it difficult to keep the developing quality constant even in a continuous processing.

There is known in the art methods to obtain high contrast images rapidly without use of the lith-type developer. For example, Japanese Pat. O.P.I. Pub. No. 106244/1981 discloses the use of hydrazine derivatives in a silver halide light-sensitive materials. According to these methods, contrasty images can be obtained by processing light-sensitive materials with a developer high in preservability and capable of rapid-processing.

In these techniques, however, the pH of a developer must be higher than 11.0 in order to heighten the hydrazine derivatives' high contrast providing capability. In such a developer with a pH value higher than 11.0, the developing agent is liable to be oxidized. Though the developer is not so unstable as the lith-type developer, oxidation of a developing agent often hinders formation of ultrahard images.

As measures to correct such a defect, there are disclosed silver halide photographic light-sensitive materials containing contrast improving agents workable even in developers of relatively low pH values in Japanese Pat. O.P.I. Pub. No. 29751/1988 and European Pat. Nos. 333,435, 345,025.

However, even when such light-sensitive materials containing contrast improving agents are developed at a pH less than 11.0, the gradation is still insufficient and an adequate dot quality cannot be obtained.

SUMMARY OF THE INVENTION

The object of the present invention is to provide a method for producing a silver halide photographic light-sensitive material which produces a high contrast, generates less pepper spots and does not causes sensitivity fluctuation, gradation lowering and increase in pepper spots in an unexposed portion each attributable to aging, even when processed with a developer having a pH less than 11.0.

The above object of the invention is achieved by a method for producing a silver halide photographic light-sensitive material, which comprises a support having thereon a photographic layer including a silver halide emulsion layer, comprising steps of coating a coating solution to form the photographic layer on the support, drying the coated layer or layers, and packing the light-sensitive material after the drying step, wherein the photographic layer may include a hydrophilic colloid sublayer other than the emulsion layer which is simultaneously dried with the silver halide emulsion layer and the silver halide emulsion layer or the hydrophilic colloid sublayer contains a hydrazine compound represented by the following Formula H, and drying of the coated photographic layer, during that period in the drying process in which the water content of the photographic layer is 300% or less of the dry-weight of a hydrophilic colloid contained in the photographic layer, is carried out with air having a relative humidity of not more than 50% contained in the photographic layer;

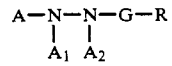

(H)

wherein A is an aryl group or a heterocyclic group containing a sulfur atom or an oxygen atom; G is a

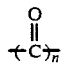

group, a sulfonyl group, a sulfoxy group,

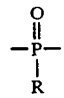

group or an iminomethylene group; $A_1$ and $A_2$ are hydrogen atoms or one of $A_1$ and $A_2$ is a hydrogen atom and the other is a substituted or unsubstituted alkylsulfonyl group or a substituted or unsubstituted acyl group; R is a hydrogen atom, an alkyl group, an aryl group, an alkoxy group, an aryloxy group, an amino group, a carbamoyl group, an oxycarbonyl group or a —O—$R_3$ group, $R_3$ is a saturated heterocyclic group.

It is preferable for the silver halide light-sensitive material of the invention to be allowed to contact with an ambient air virtually having a dew point less than 16° C. in processes between completion of drying of all coated layers on the support and completion of the packing.

The present inventors have found that the effect of the invention is exhibited more noticeably when a light-sensitive material is allowed to contact with the air virtually having a dew point less than 16° C. at least for 5 seconds, in processes between completion of the drying and completion of the packing.

DETAILED DESCRIPTION OF THE INVENTION

In general, coating and drying of a light-sensitive material is carried out by steps of coating on a support a coating solution containing a hydrophilic colloid such as gelation composition, cooling the support to set the coated solution to gel in a low-temperature air having a dry-bulb temperature of −10° to 15° C., and raising the temperature to dry the coated solution.

In drying in the method of the invention, it is essential that water contained in a coated photographic layer in amount of less than 300% of dry-weight of hydrophilic colloid be evaporated under a condition of relative humidity less than 50% in the drying process after the layer coated at least on one side of a support is set to gel by cooling.

When the coating solution contains water exceeding 300% of binder by weight, it is required that drying of the coated layer to be carried out with air having a relative humidity of not more than 50% after the time when the water amount in the layer reaches 300% to the dry weight of the binder.

When two or more of such hydrophilic layers including a silver halide emulsion layer are coated and dried simultaneously, the water amount means the water amount contained in all layers, and the hydrophilic colloid amount is the total amount of the hydrophilic colloid contained in all layers. In evaporating water in amount of less than 300% of dry-weight of binder, the temperature is preferably within a range from 25° to 50° C. The term relative humidity used here expresses in percentage the ratio of an amount of aqueous vapor contained in a certain volume of air to a saturated amount of aqueous vapor in said air.

In the present specification that follows hereunder, a time when a light-sensitive material under processing terminates the contact with air, drying air, for example, having a relative humidity less than 50% is referred to as a termination point of the coating and drying process.

In shipping silver halide photographic light-sensitive materials subjected to said treatment as finished products, the effect of the invention can be noticeably exhibited when processes between completion of the coating and drying process and completion of the packing are carried out in an environment having a dew point less than 16° C.

The processes between completion of the coating and drying process and completion of the packing generally include processes of winding, cutting and packing; interim storing and transferring are also included at times. The term "air with which a light-sensitive material virtually contacts" used in the specification means the air with which the light-sensitive material contacts in a state without contacting with any other material. Light-sensitive materials are often transferred in the form of rolls (in a so-called bulk state), or in piles after being cut into desired sizes. In such cases, for example, in transferring in a bulk state, the inner portion of light-sensitive materials, where the both sides thereof are in close contact with each other, is not regarded to be in virtual contact with the environmental air.

For example, when a light-sensitive material undergoing the coating and drying process of the invention is wound into a roll in an ambient air with a dew point of less than 16° C., transferred in an ambient air with a dew point of 17° C. in the form of roll, and then subjected to cutting and packing in an ambient air with a dew point of less than 16° C., such a procedure is contained in the preferred embodiment of the present invention.

The structure of the hydrazine derivative used in the invention is that represented by the following Formula H.

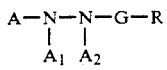

Formula H

In the formula, A represents an aryl group or a heterocyclic group containing at least one sulfur or oxygen atom; G represents a

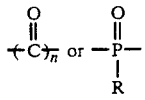

group, or a sulfomethyl, sulfoxy or imonomethylene group n represents an integer of 1 or 2; $A_1$ and $A_2$ are both hydrogen atoms, or one of them is a hydrogen atom and the other is a substituted or unsubstituted alkylsulfonyl group or substituted or unsubstituted acyl group; R represents a hydrogen atom, or an alkyl, aryl, alkoxy, aryloxy, amino, carbamoyl or oxycarbonyl group, or a —O—$R_3$ group; and $R_3$ represents saturated heterocyclic group.

The particularly preferred structure are those represented by the following Formula A or B

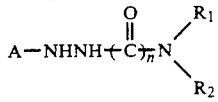

Formula A

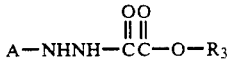

Formula B

In the formulas, A represents an aryl group or a heterocyclic group containing at least one sulfur or oxygen atom; n represents an integer of 1 or 2; when n is 1, $R_1$ and $R_2$ each represent a hydrogen atom, or an alkyl, alkenyl, alkynyl, aryl, saturated or unsaturated heterocyclic, hydroxy, alkoxy, alkenyloxy, alkynyloxy, aryloxy or heterocycloxy group, or $R_1$ and $R_2$ may form a ring in conjunction with the nitrogen atom; when n is 2, $R_1$ and $R_2$ each represent a hydrogen atom, or an alkyl, alkenyl, alkynyl, aryl, saturated or unsaturated heterocyclic, hydroxy, alkoxy, alkenyloxy, alkynyloxy, aryloxy or heterocycloxy group; provided that at least one of $R_1$ and $R_2$ is an alkyl, alkynyl, saturated heterocyclic, hydroxy, alkoxy, alkenyloxy, alkynyloxy, aryloxy or heterocycloxy group, when n is 2; and $R_3$ represents an alkyl or saturated heterocyclic group.

The compounds represented by Formula A or B contain those in which at least one of H atoms in —NHNH— is substituted by a substituent.

To be more concrete, A represents an aryl group such as phenyl or naphthyl group or a heterocyclic group such as thiophene, furan, benzothiophene or pyrane group.

$R_1$ and $R_2$ each represent a hydrogen group such as methyl, ethyl, methoxyethyl, cyanoethyl, hydroxyethyl, benzyl or trifluoroethyl group; alkenyl group such as allyl, butenyl, pentanyl or pentadienyl group; alkynyl group such as propargyl, butynyl or pentynyl group; aryl group such as phenyl, naphthyl, cyanophenyl or methoxyphenyl group; heterocyclic group including an unsaturated heterocycle such as pyridinyl, thiophenyl or furanyl and a saturated heterocycle such as sulfolanyl or tetrahydrofuranyl group; hydroxy group; alkoxy group such as methoxy, ethoxy, benzyloxy or cyanomethoxy group; alkenyloxy group such as allyloxy or butenyloxy group; alkynyloxy group such as propargyloxy or butynyloxy group; aryloxy group such as phenoxy or naphthyloxy group; or heterocycloxy group such as pyridyloxy or pyrimidyloxy group. $R_1$ and $R_2$ may form a ring such as piperidine, piperadine or morpholine in conjunction with the nitrogen atom, provided that n is 1.

When n is 2, at least one of $R_1$ and $R_2$ is an alkenyl, alkynyl, saturated heterocyclic, hydroxy, alkoxy, alkenyloxy, alkynyloxy, aryloxy or heterocycloxy group.

Examples of the alkynyl group and saturated heterocyclic group represented by $R_3$ are those described above.

The aryl group and the heterocyclic group containing at least one sulfur or oxygen atom, both of which represented by A, may have a substituent. Examples of such substituents include, halogen atoms and alkyl, aryl, alkoxy, aryloxy, acyloxy, alkylthio, arylthio, sulfonyl, alkoxycarbonyl, aryloxycarbonyl, carbamoyl, sulfamoyl, acyl, amino, alkylamino, alkylideneamino, arylamino, acylamino, sulfonamide, arylaminothiocarbonylamino, hydroxy, carboxy, sulfo, nitro and cyano groups. Among these substituents, sulfonamide, alkylamino and alkylideneamino groups are preferred.

In each of the above formulas, A has preferably at least one of antidiffusive groups or silver-halide-adsorption-accelerating groups. Preferable antidiffusive group are ballast groups which are commonly used in immovable photographic additives such as couplers. The ballast group is a group having more than 8 carbon atoms and relatively inert to photographic properties and can be selected, for example, from alkyl, alkoxy, phenyl, alkylphenyl, phenoxy and alkylphenoxy groups. Examples of the silver-halide-adsorption-accelerating group include those described in U.S. Pat. No. 4,385,108 such as thiouredo, thiourethane, heterocyclothioamido, mercaptoheterocyclic and triazolyl groups.

Compounds preferably used in the invention are those represented by Formula A and n being 2 therein, and those represented by Formula B.

Among the compounds of n being 2 in Formula A, the particularly preferred are those in which $R_1$ and $R_2$ are independently a hydrogen group, or an alkyl, alkenyl, alkynyl, aryl, saturated or unsaturated heterocyclic, hydroxy or alkoxy group, and at least one of $R_1$ and $R_2$ is an alkenyl, alkynyl, saturated heterocyclic, hydroxy or alkoxy group.

Among the compounds represented by Formula A, especially preferred ones are compounds represented by the following Formula A-1.

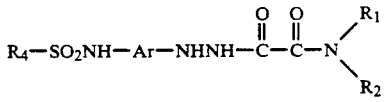

In the formula, $R_1$ and $R_2$ are the same as those defined for Formula A, and at least one of $R_1$ and $R_2$ is an alkenyl, alkynyl, saturated heterocyclic, hydroxy, alkoxy, alkenyloxy, alkynyloxy, aryloxy or heterocycloxy group; $R_4$ represents an alkyl, aryl, or saturated or unsaturated heterocyclic group; and $Ar_1$ represents a arylene, or saturated or unsaturated heteroctclic group.

Formula A-1 is described more minutely. $R_4$ represents an alkyl group such as octyl, t-octyl, decyl, dodecyl or tetradecyl group; aryl group such as phenyl, p-propyl, phenyl or naphthyl group; heterocyclic group such as pyridyl, tetrazolyl, oxazolyl, benzoxazolyl, benzothiazolyl or benzimidazolyl group. A $R_4$ contains preferably at least one antidiffusive group or silver-halide-adsorption-accelerating group. $Ar_1$ is an arylene or heterocyclic group and preferably an arylene group. $R_1$ and $R_2$ are the same as those defined for Formula A.

Of the compounds represented by Formula A-1, especially preferred compounds are those in which $R_4$ is a substituted alkyl group, substituted aryl group or substituted heterocyclic group each having at least one of antidiffusive group and silver-halide-adsorption-accelerating group; $Ar_1$ is an arylene group; and $R_1$ and $R_2$ each are a hydrogen atom, or an alkyl, alkenyl, alkynyl, aryl, saturated or unsaturated heterocyclic, hydroxyl or alkoxy group, provided that at least one of $R_1$ and $R_2$ is an alkenyl, alkynyl, saturated heterocyclic, hydroxy or alkoxy group.

Typical examples of the compounds represented by Formula A or B are illustrated below.

Examples of typical compounds

H-1

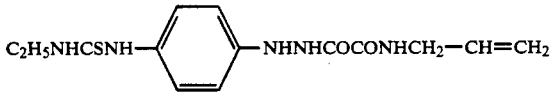

H-2

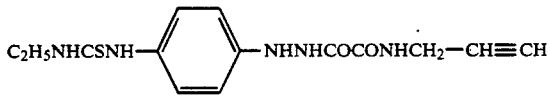

H-3

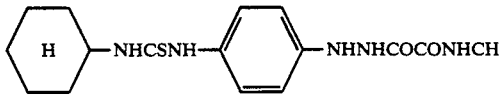

H-4

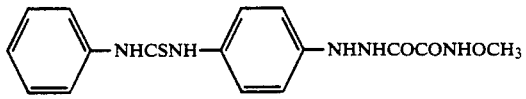

-continued
H-5
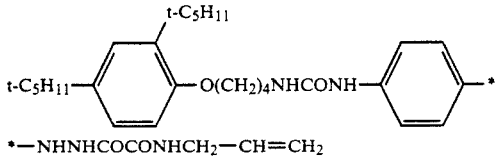
H-6
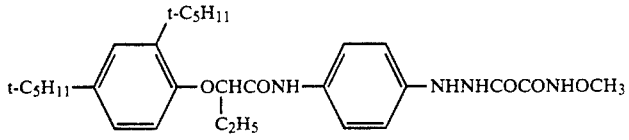
H-7
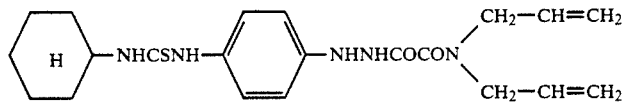
H-8
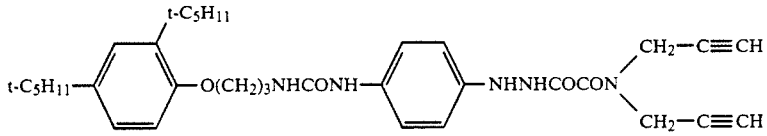
H-9
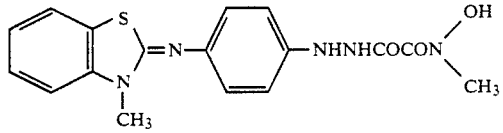
H-10
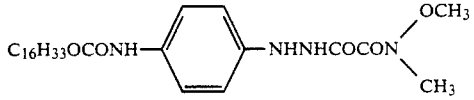
H-11
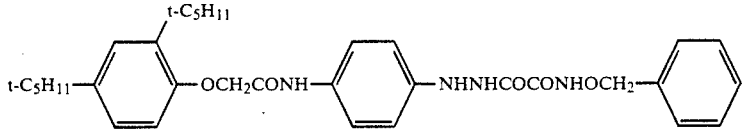
H-12
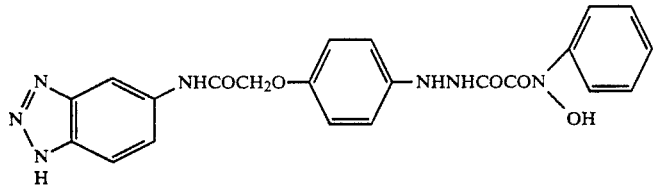
H-13
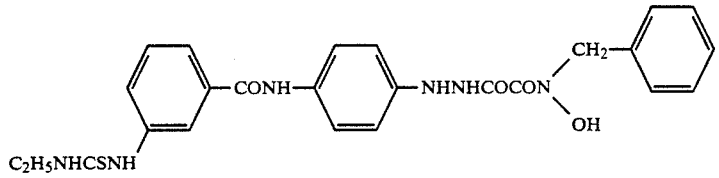
H-14
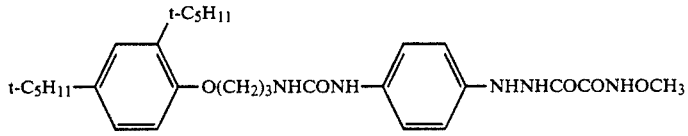

-continued
H-15
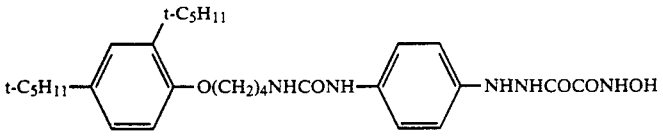
H-16
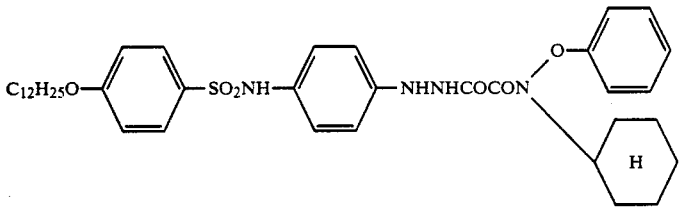
H-17
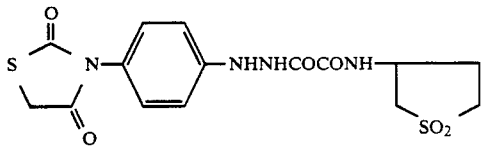
H-18
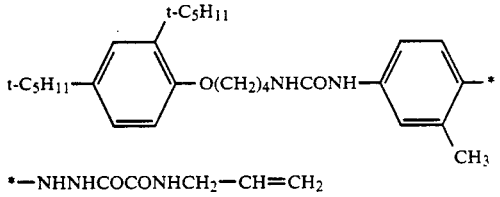
H-19
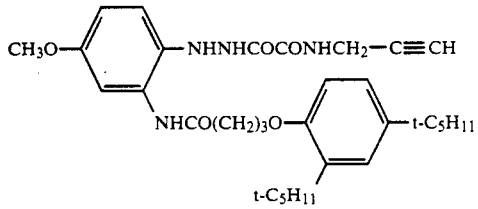
H-20
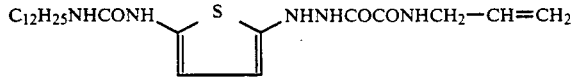
H-21
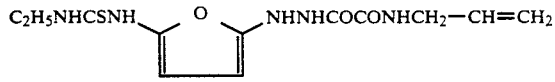
H-22
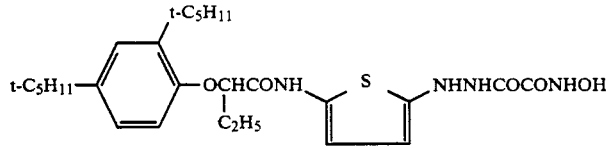
H-23
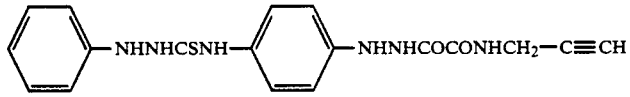
H-24
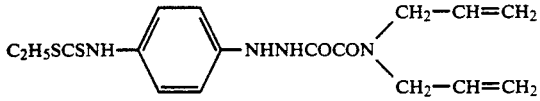
H-25
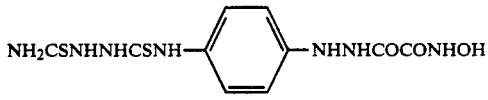

-continued
H-26
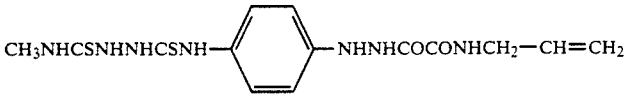
H-27
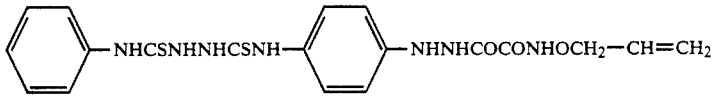
H-28
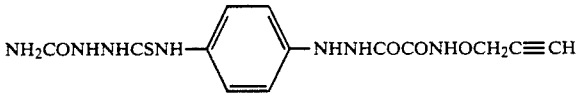
H-29
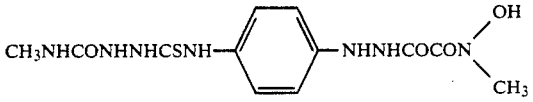
H-30
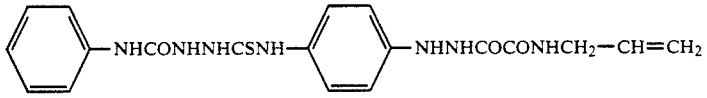
H-31
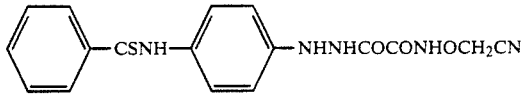
H-32
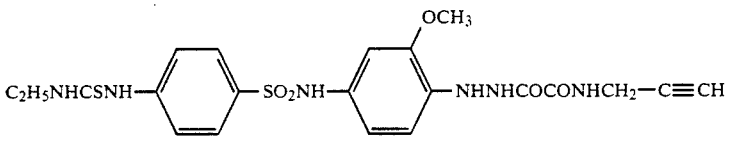
H-33
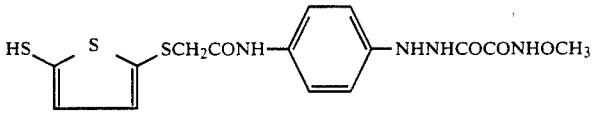
H-34
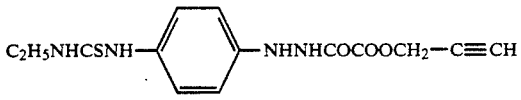
H-35
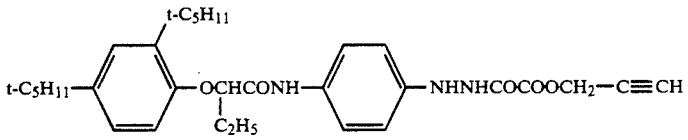
H-36
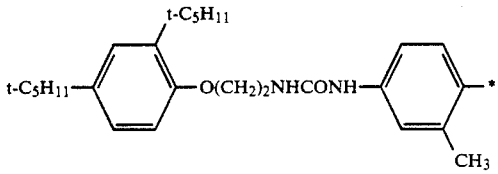
*—NHNHCOCOOCH2—C≡CH -continued
H-37
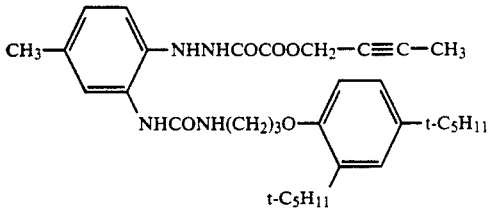
H-38
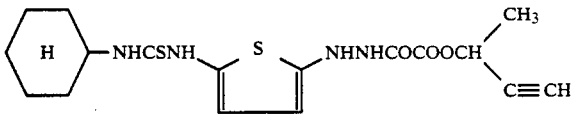
H-39
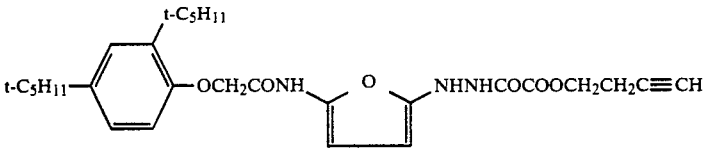
H-40
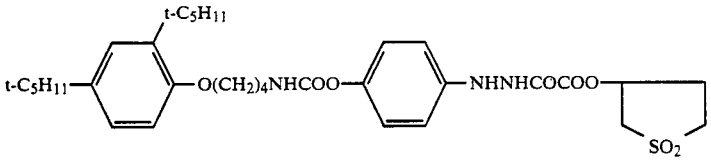
H-41
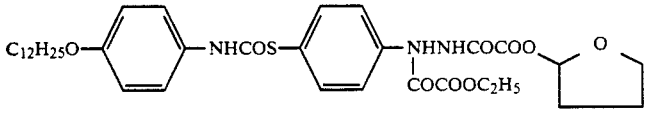
H-42
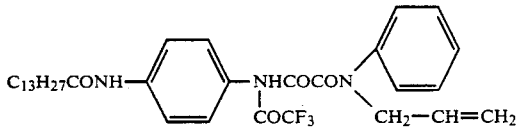
H-43
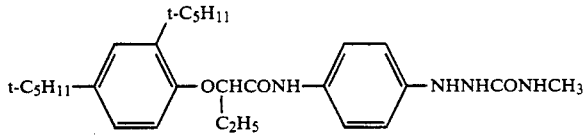
H-44
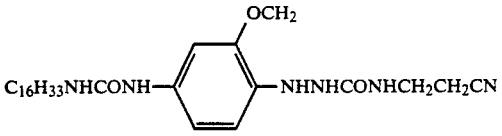
H-45
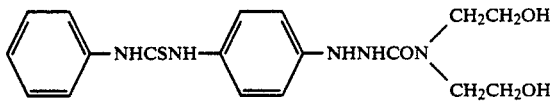
H-46
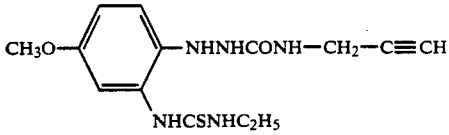

-continued
H-47
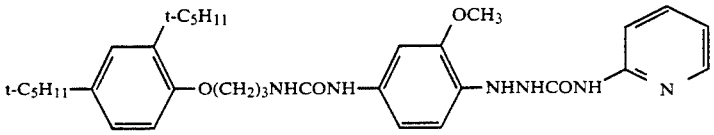
H-48
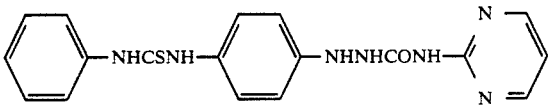
H-49
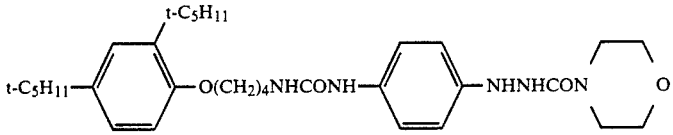
H-50
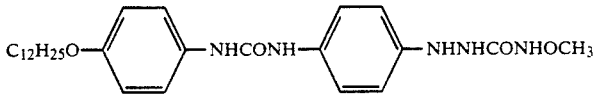
H-51
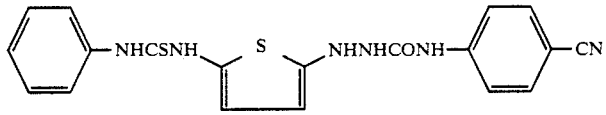
H-52
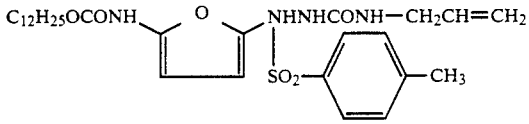
H-53
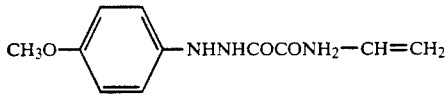
H-54
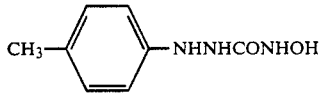
H-55
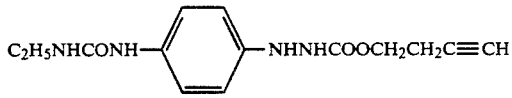
H-56
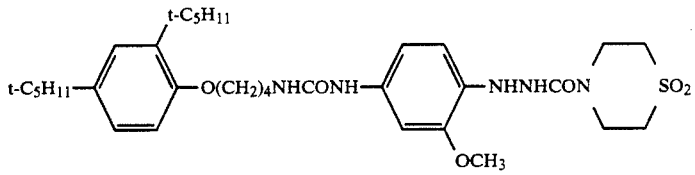
H-57
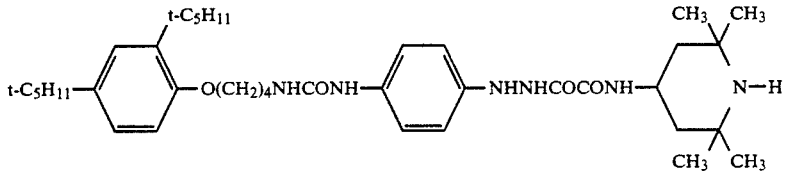

-continued
H-58
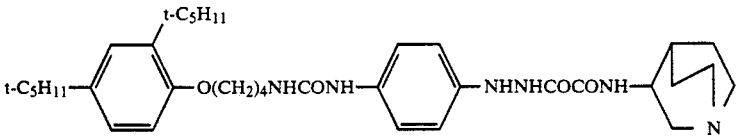
H-59
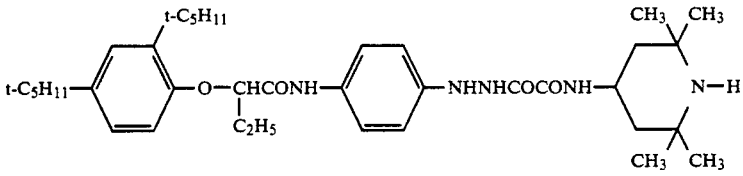
H-60
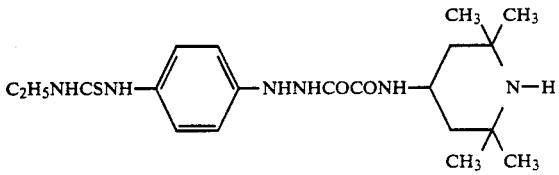
H-61
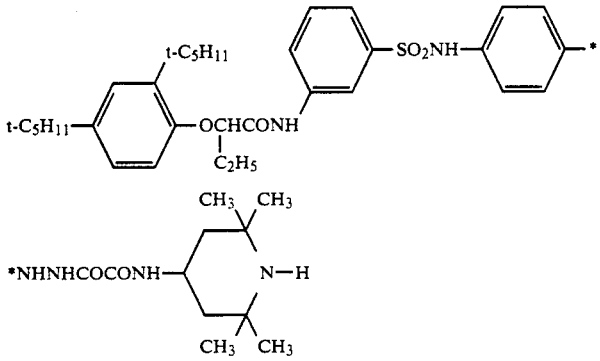
H-62
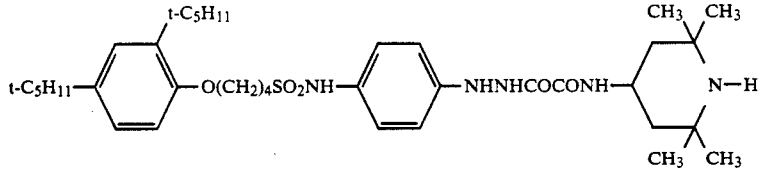
H-63
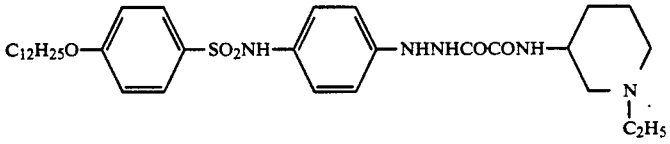
H-64
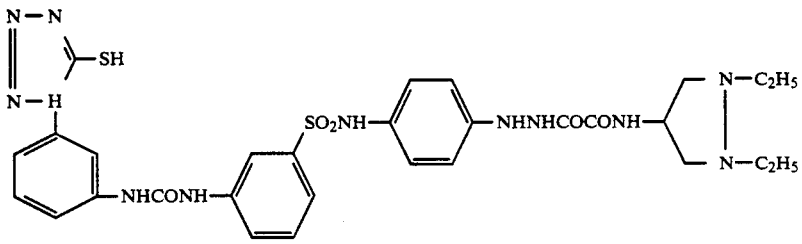

-continued
H-65
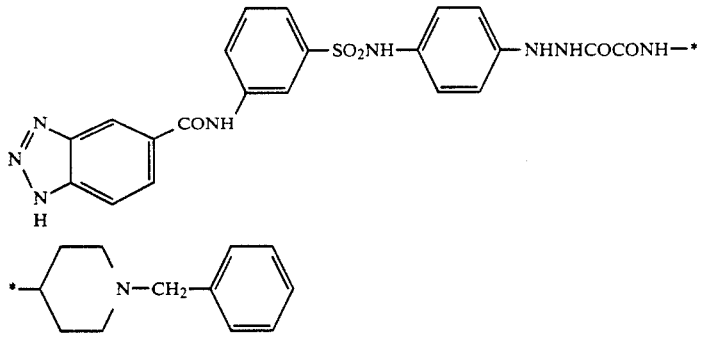
H-66
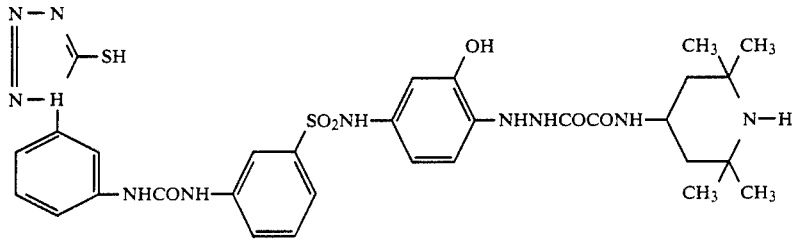
H-67
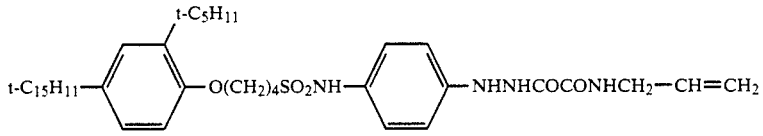
H-68
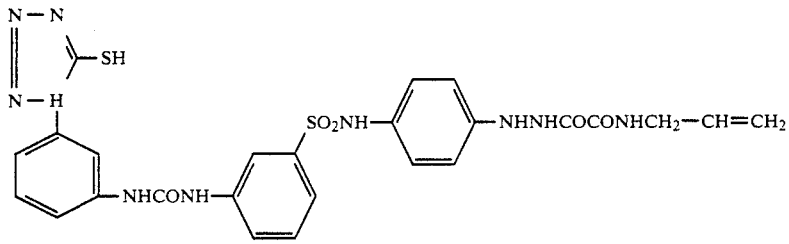
H-69
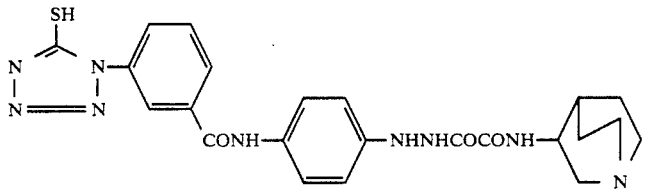
H-70
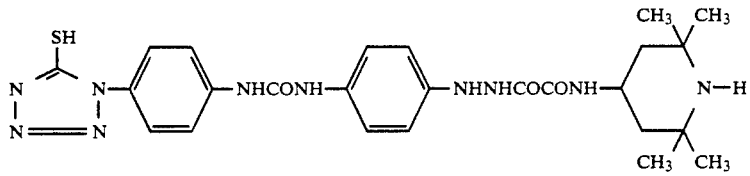
H-71
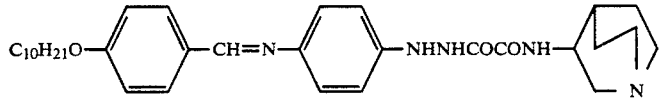
H-72
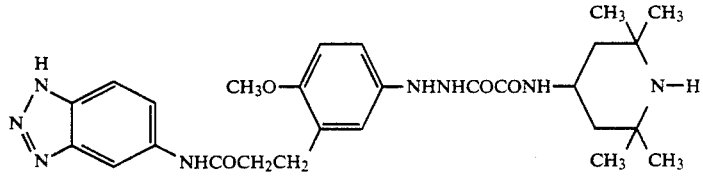

-continued
H-73
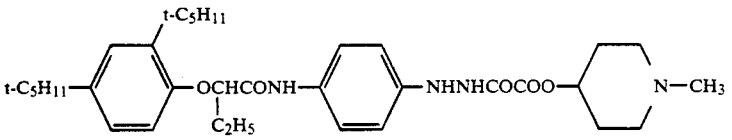
H-74
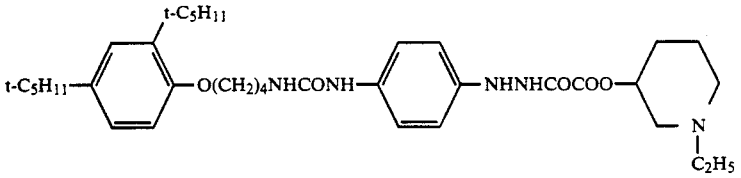
H-75
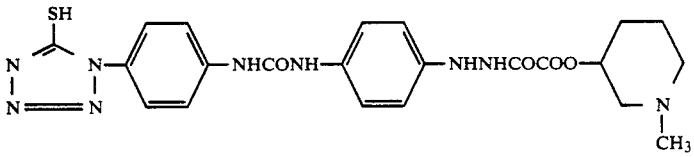
H-76
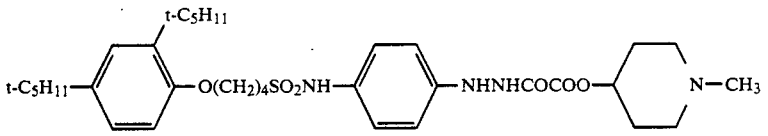
H-77
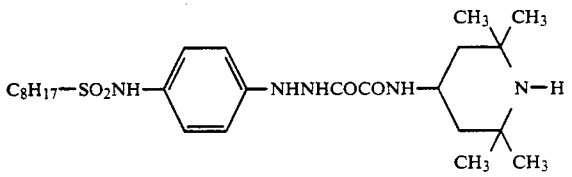
H-78
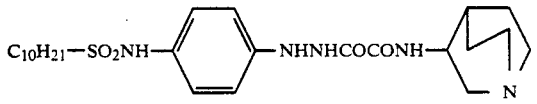
H-79
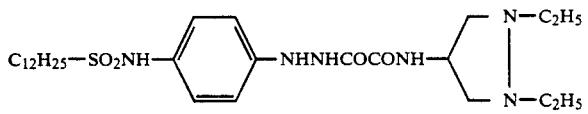
H-80
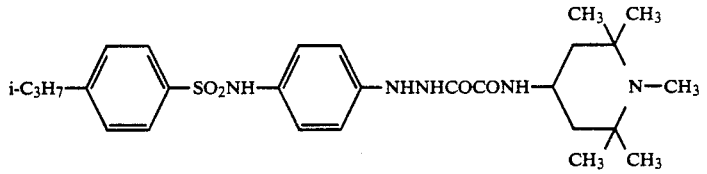
H-81
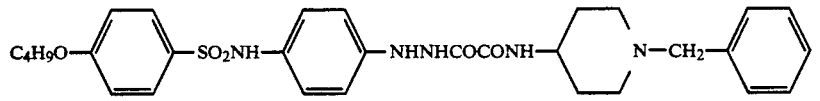
H-82
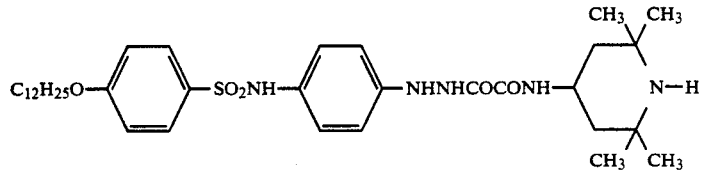

-continued
H-83
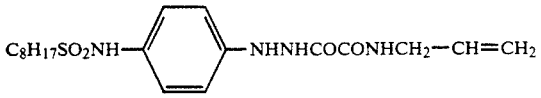
H-84
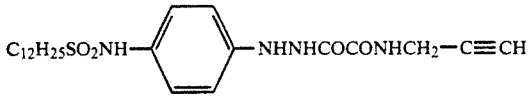
H-85
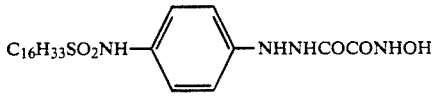
H-86
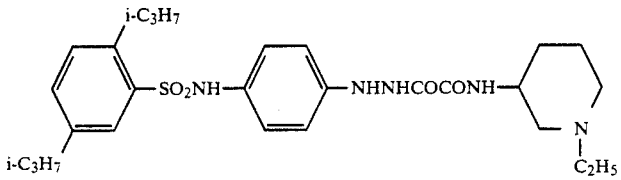
H-87
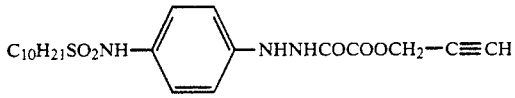
H-88
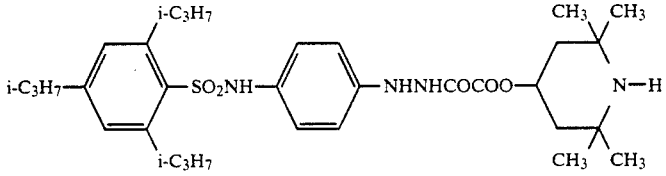
H-89
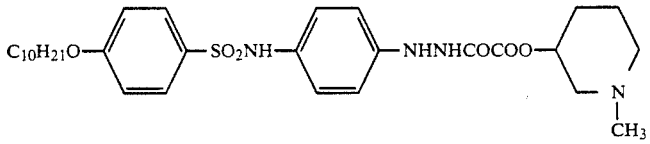
H-90
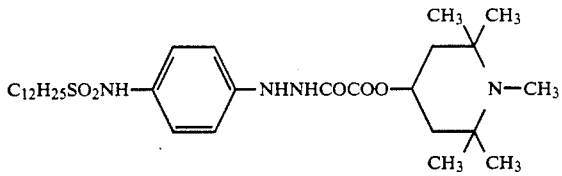
H-91
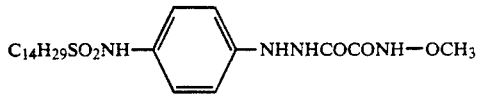
H-92
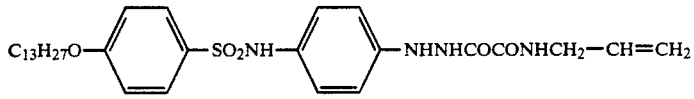
H-93
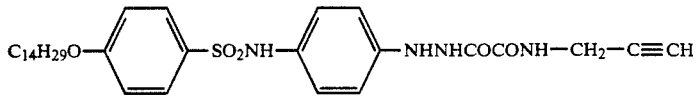

-continued
H-94
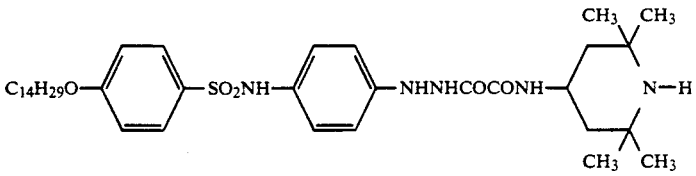
H-95
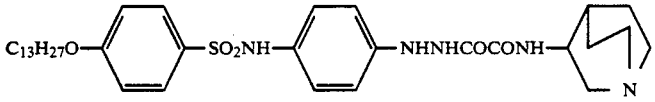
H-96
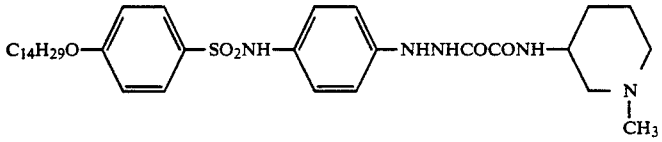
H-97
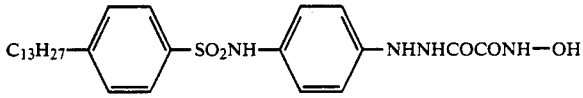
H-98
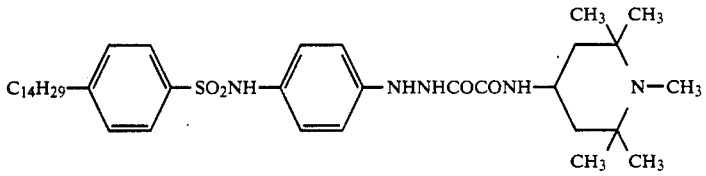
H-99
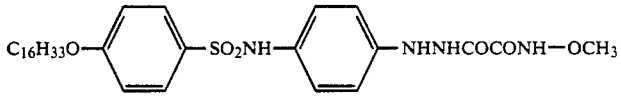
H-100
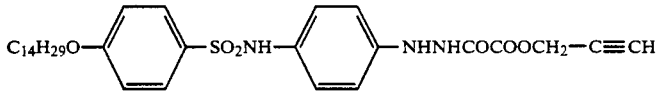
H-101
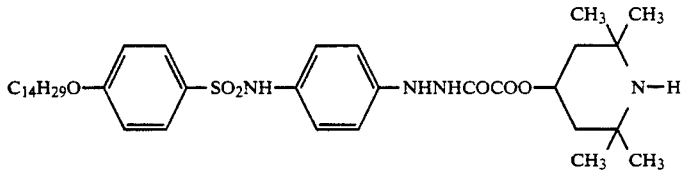
H-102
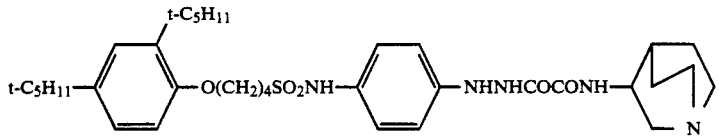
H-103
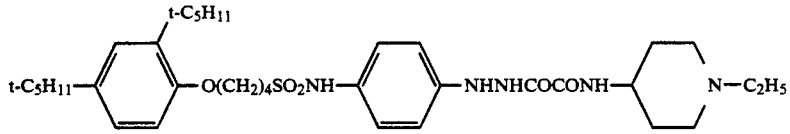
H-104
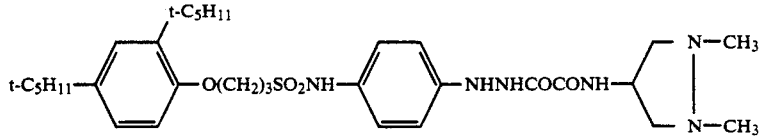

-continued
H-105
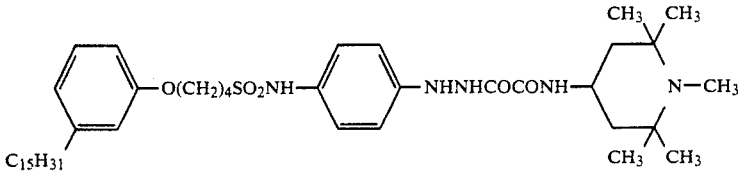
H-106
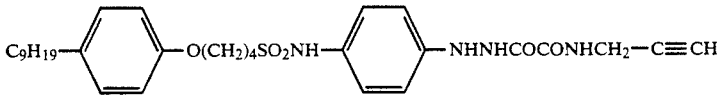
H-107
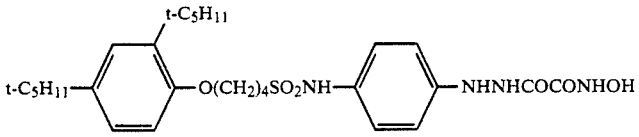
H-108
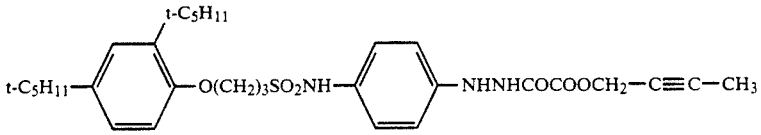
H-109
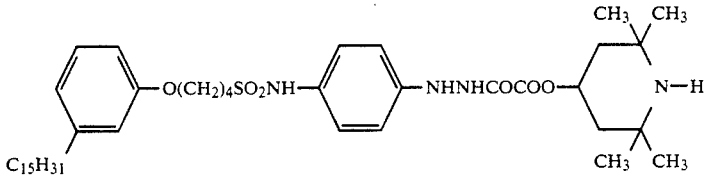
H-110
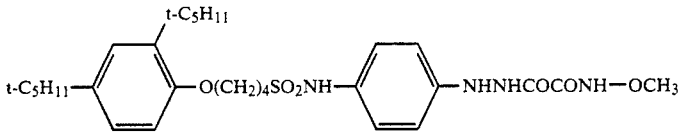
H-111
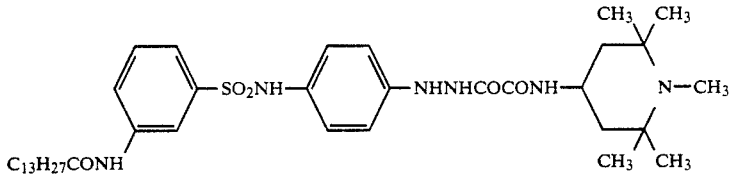
H-112
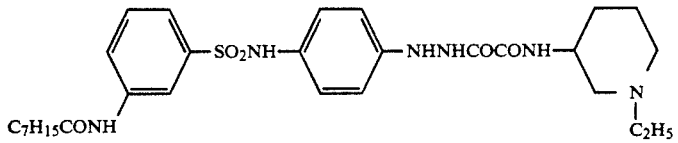
H-113
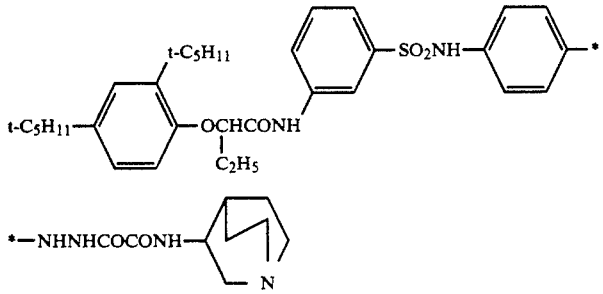

-continued
H-114
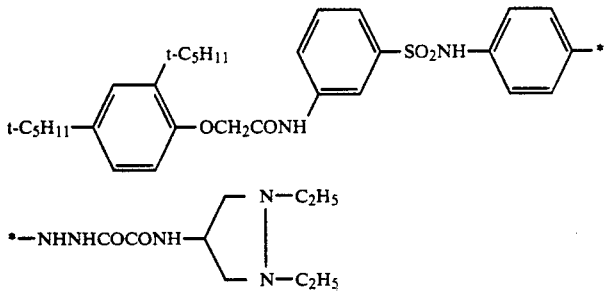
H-115
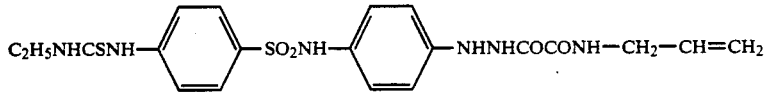
H-116
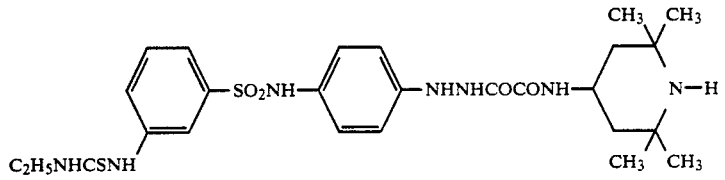
H-117
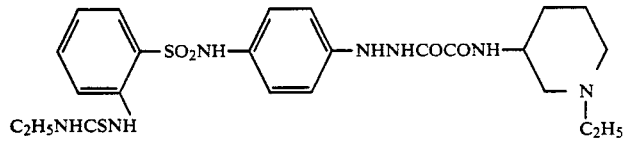
H-118
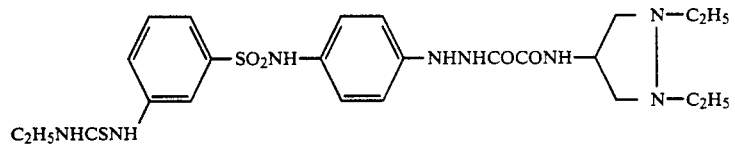
H-119
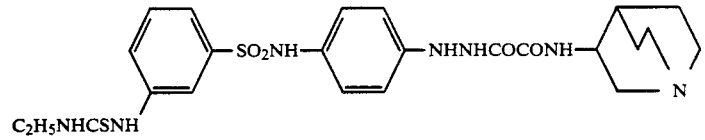
H-120
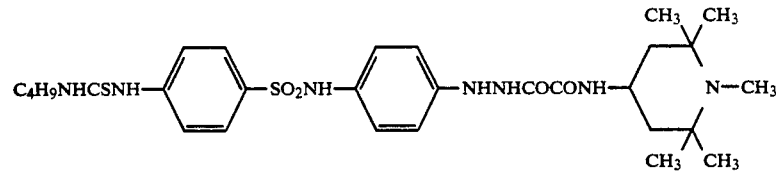
H-121
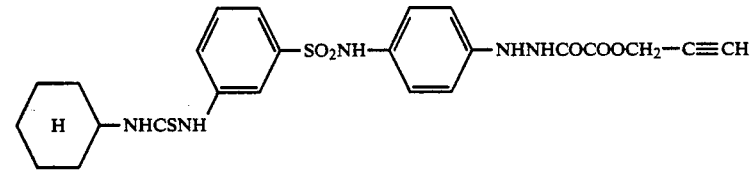
H-122
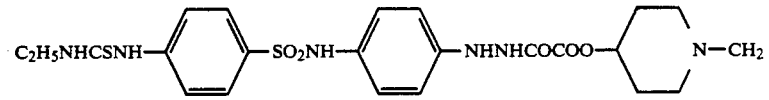

-continued
H-123
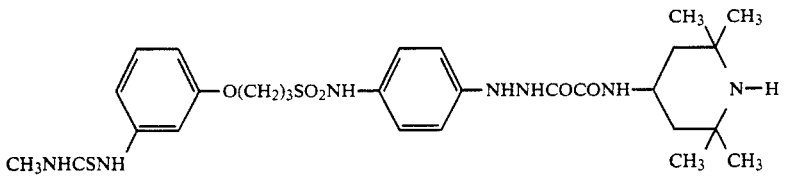
H-124
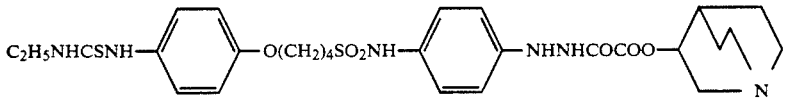
H-125
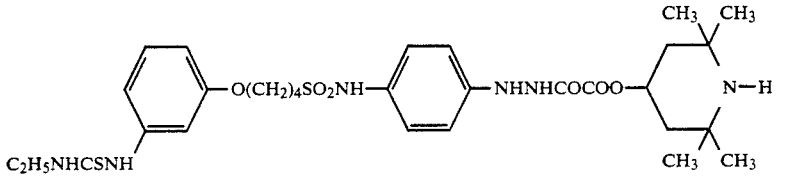
H-126
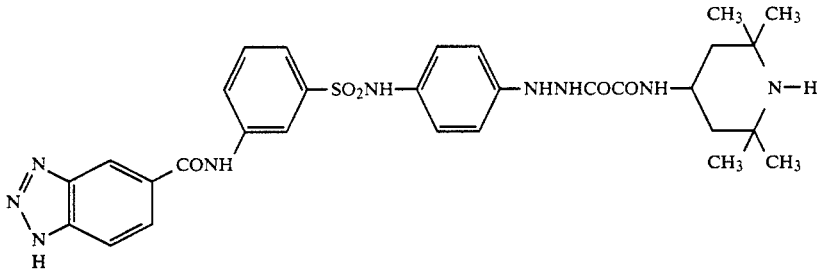
H-127
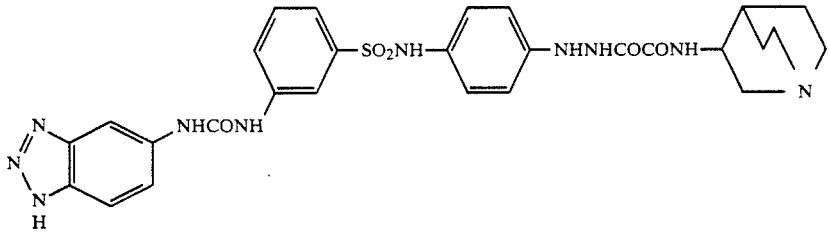
H-128
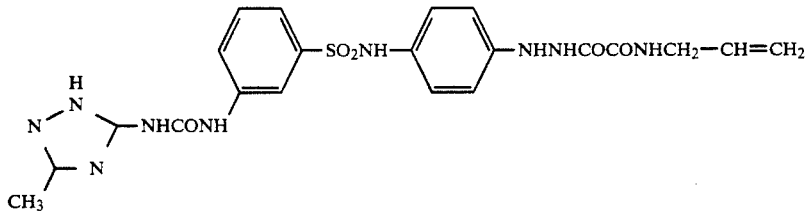
H-129
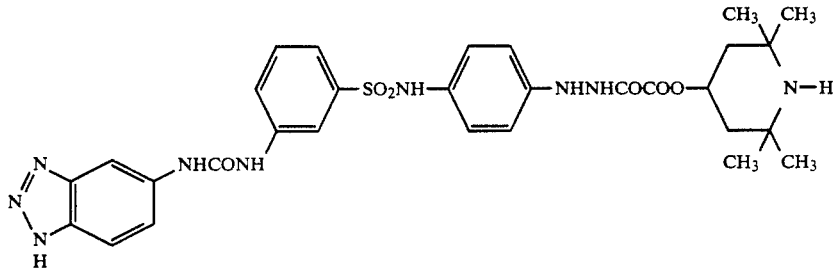

-continued
H-130
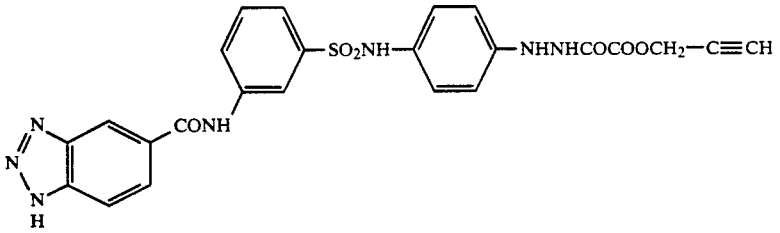
H-131
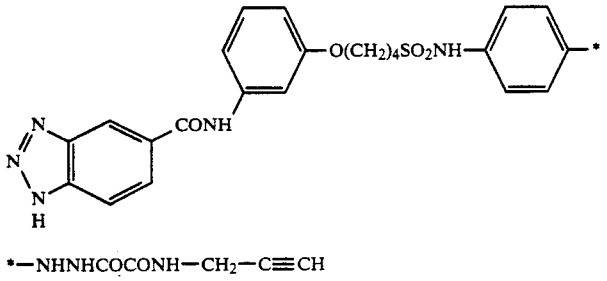
H-132
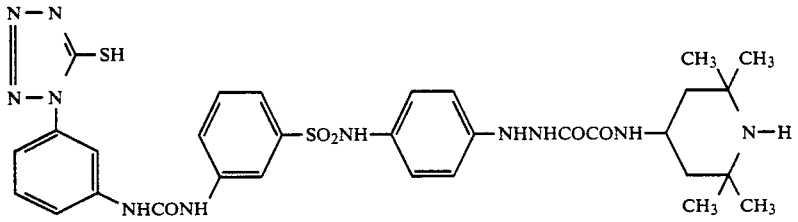
H-133
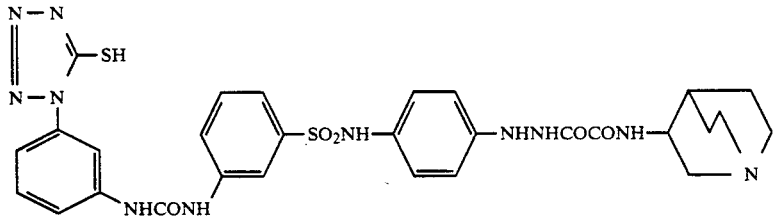
H-134
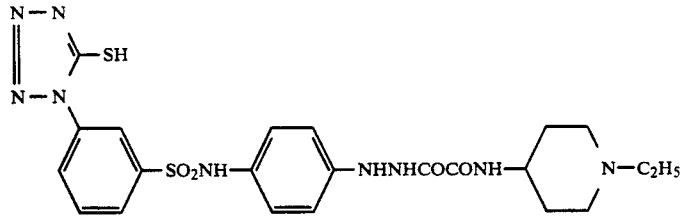
H-135
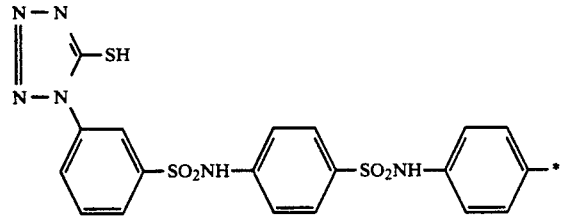

-continued
H-136
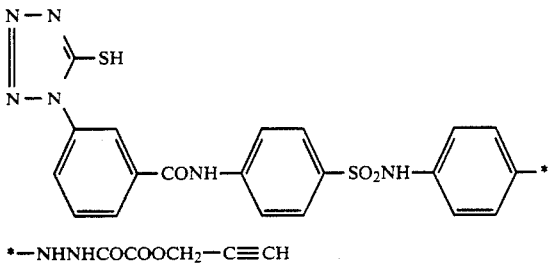
H-137
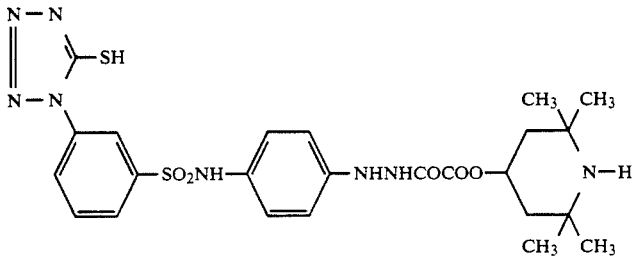
H-138
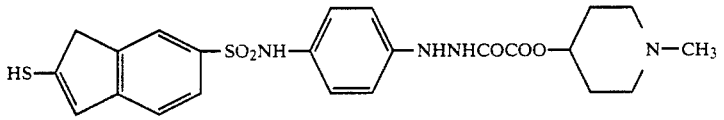
H-139
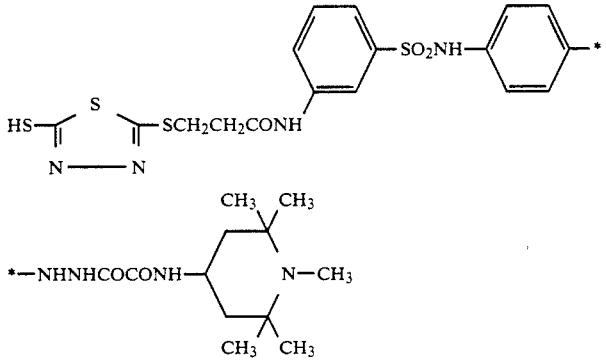
H-140
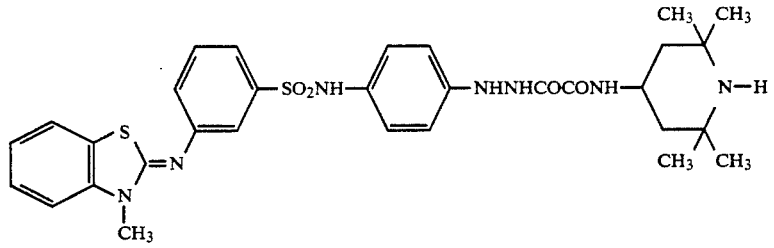
H-141
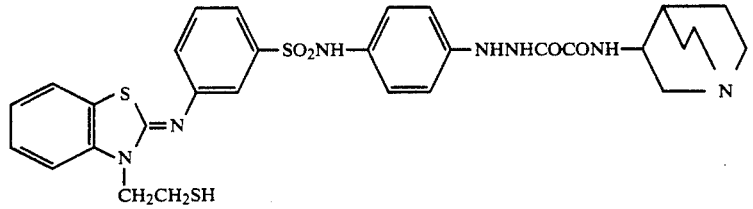

-continued
H-142
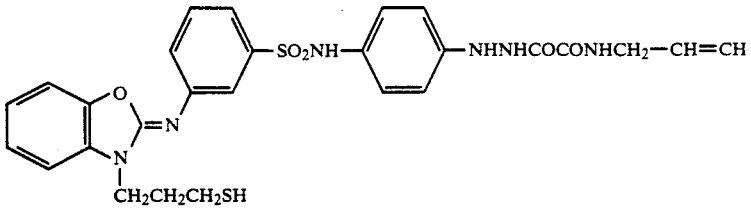
H-143
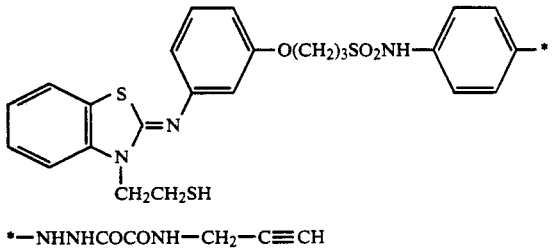
H-144
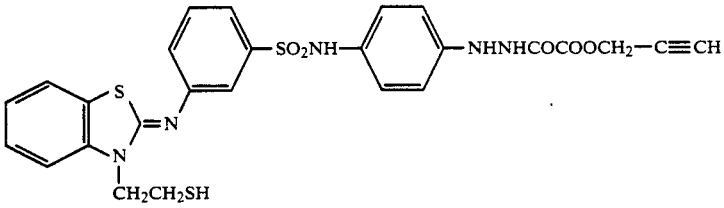
H-145
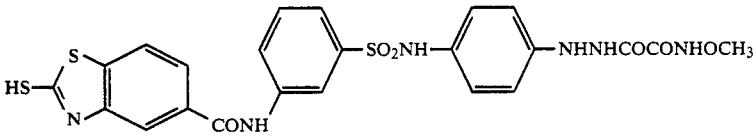
H-146
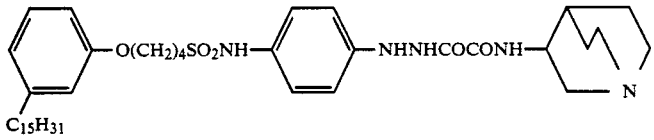
H-147
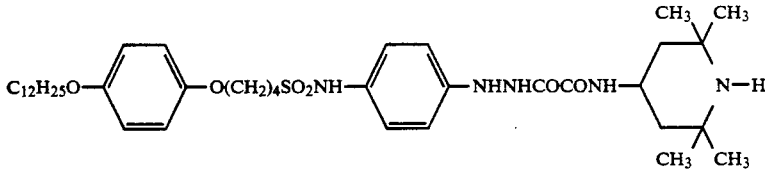
H-148
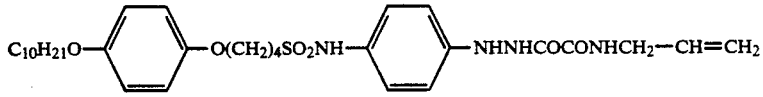
H-149
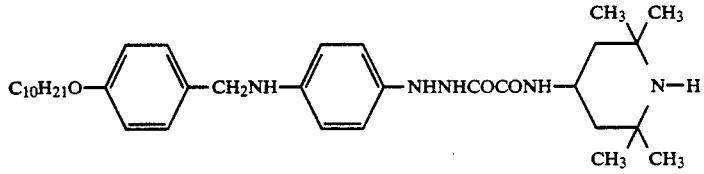

-continued
H-150
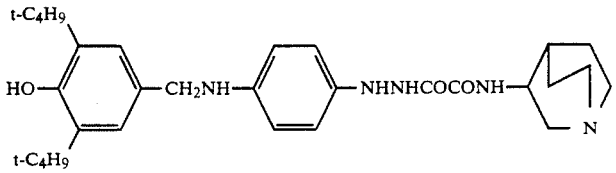
H-151
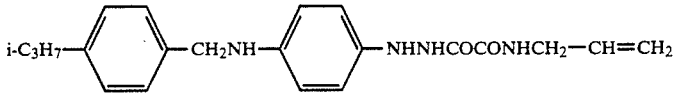
H-152
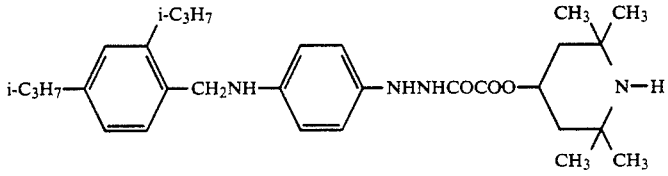
H-153
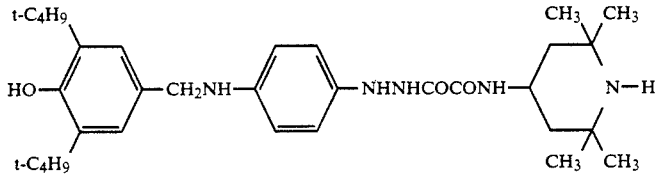
H-154
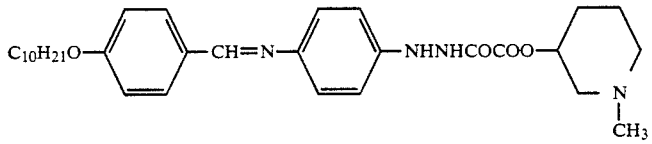
H-155
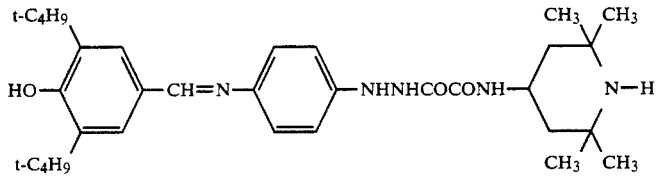
H-156
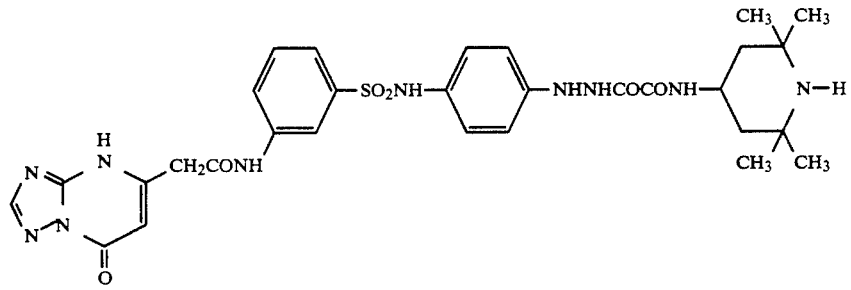
H-157
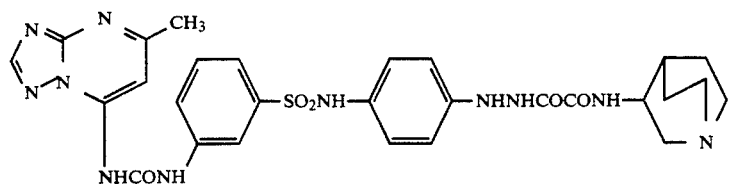

-continued
H-158
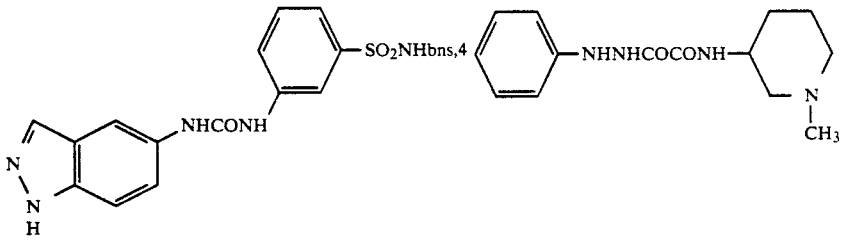
H-159
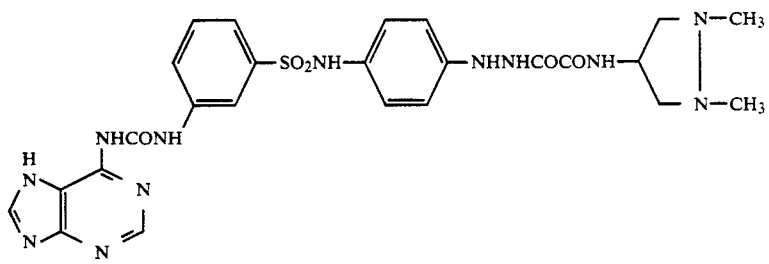
H-160
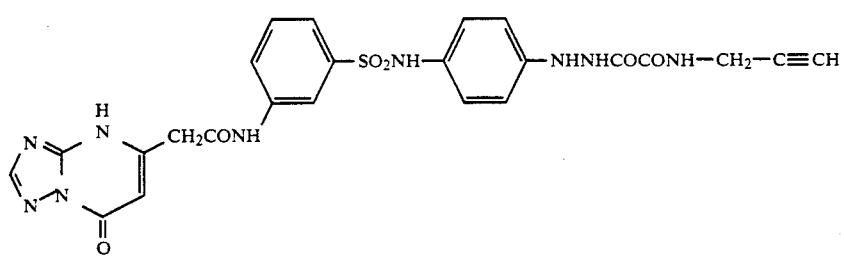
H-161
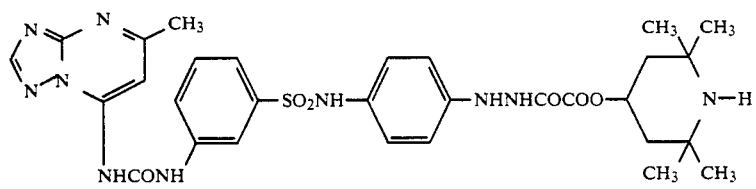
H-162
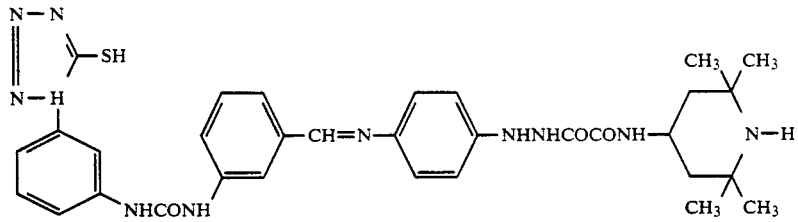
H-163
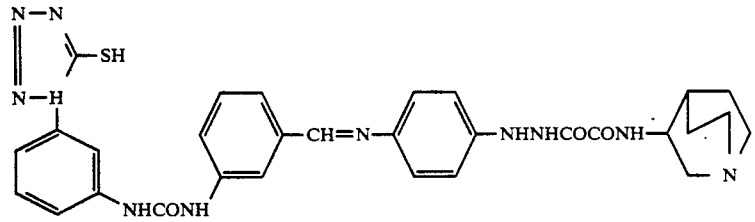
H-164
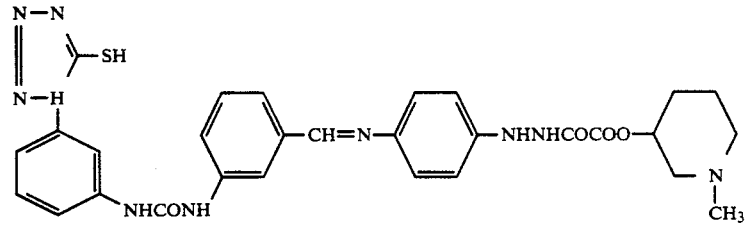

-continued
H-165
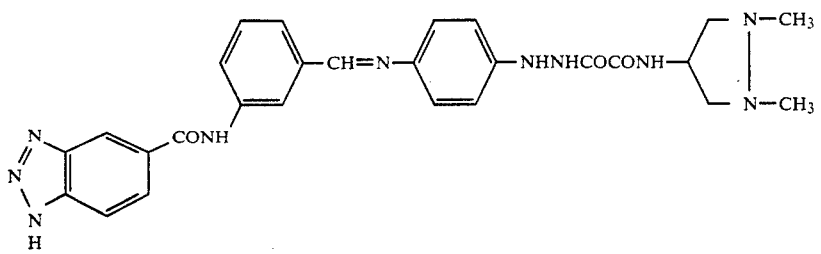
H-166
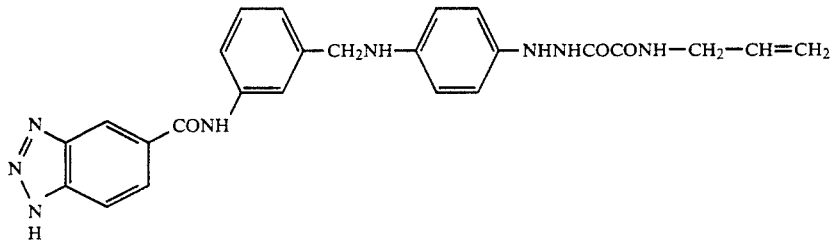
H-167
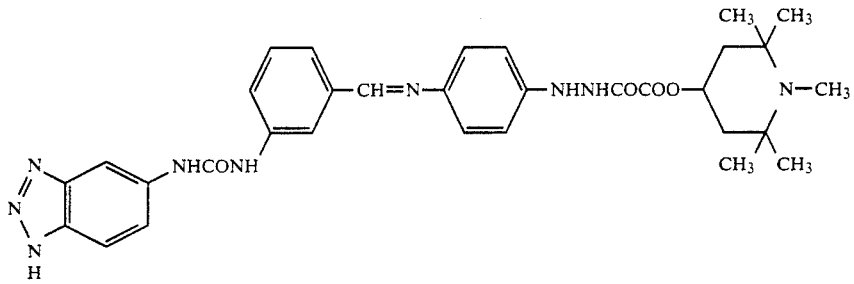
H-168
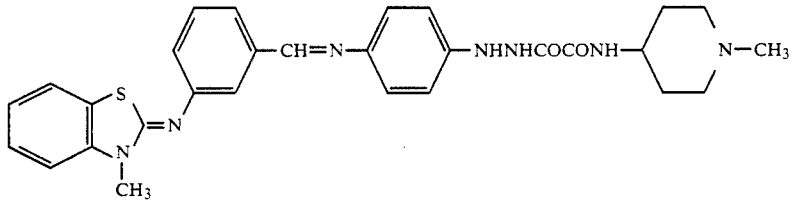
H-169
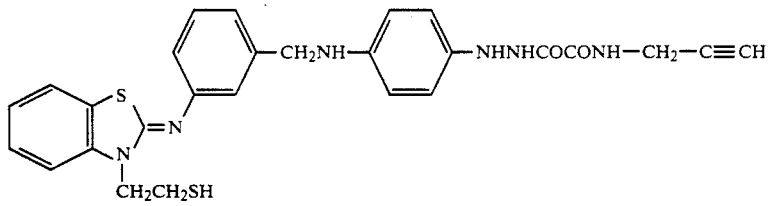
H-170
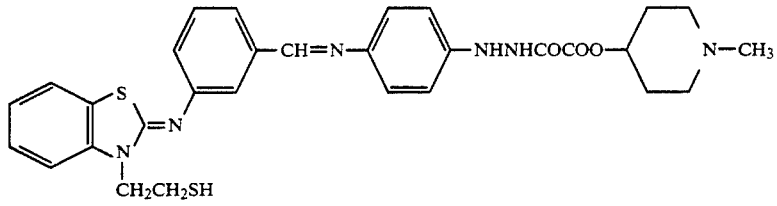
H-171
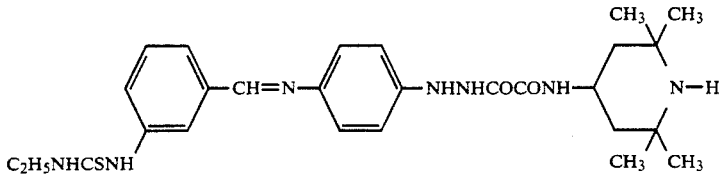

-continued
H-172
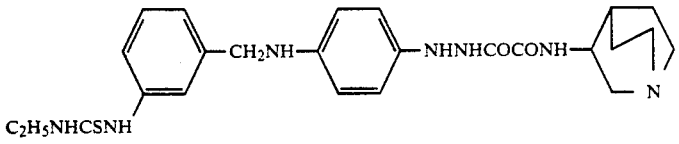
H-173
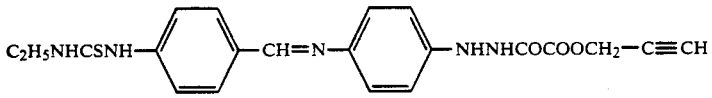
H-174
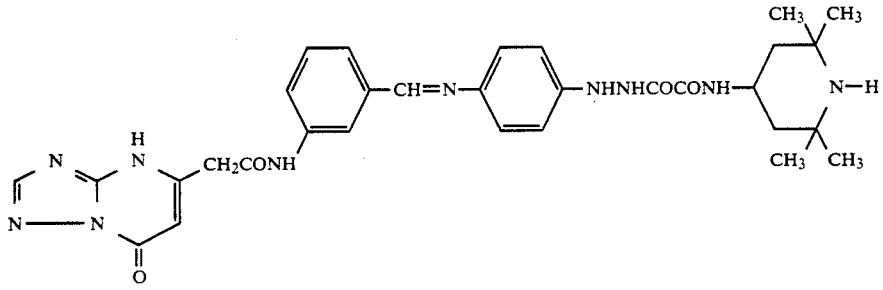
H-175
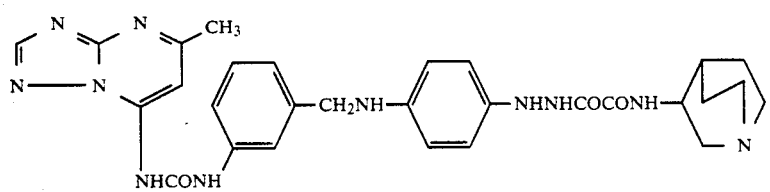
H-176
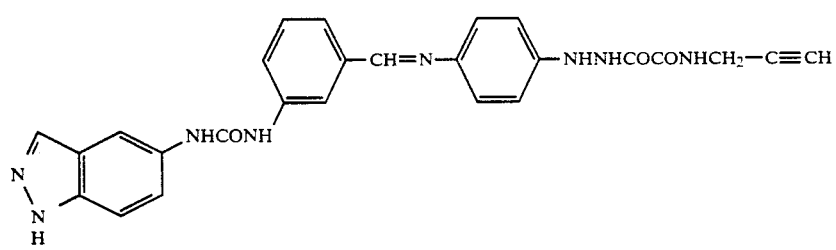
H-177
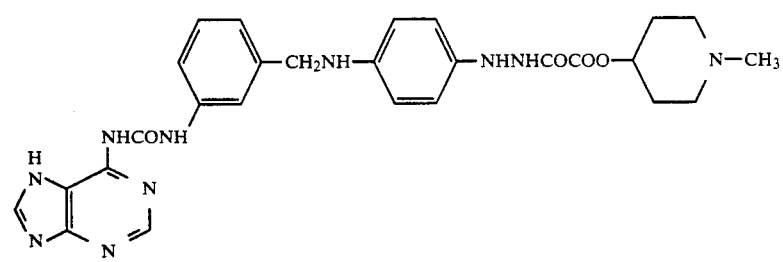
H-178
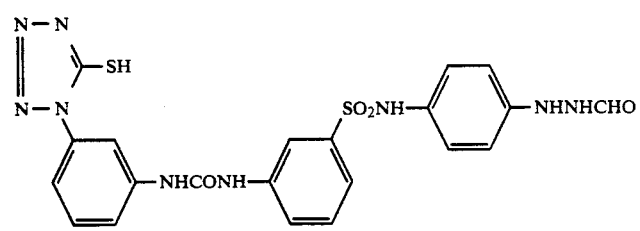
H-179
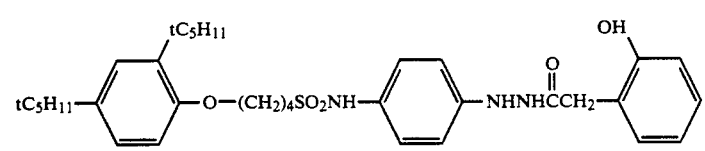

-continued
H-180
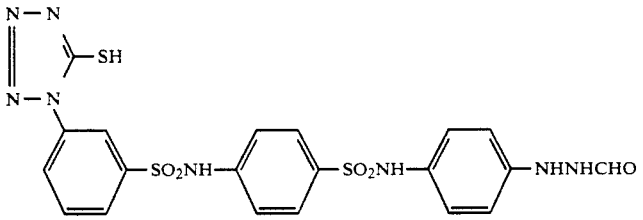
H-181
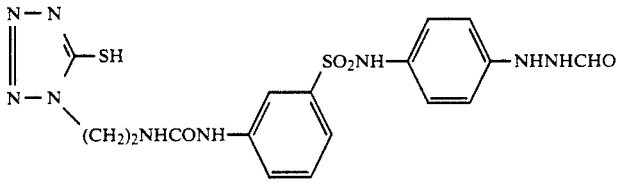
H-182
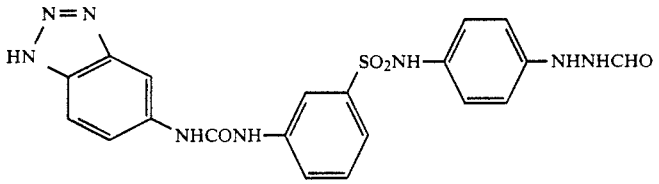
H-183
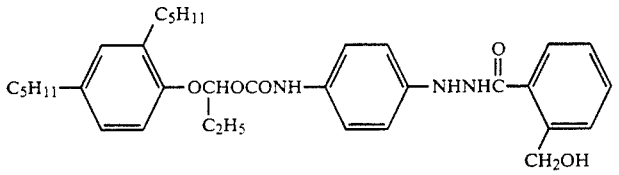
H-184
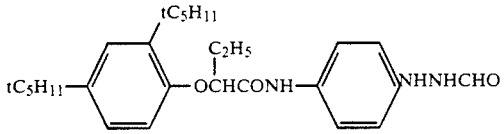
H-185
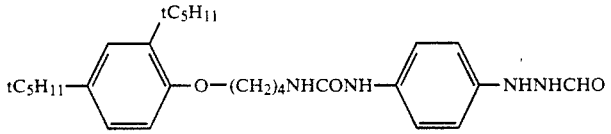
H-186
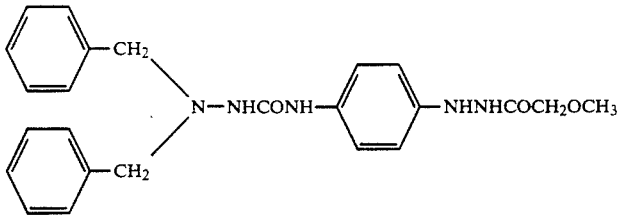
H-187
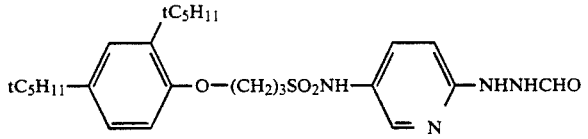
Next, syntheses of the compounds represented by Formula A or B are described.
For example, Compound H-1 can be synthesized by the following method.
$$C_2H_5OCOCOCl \xrightarrow{CH_2=CH-CH_2NH_2}$$

-continued
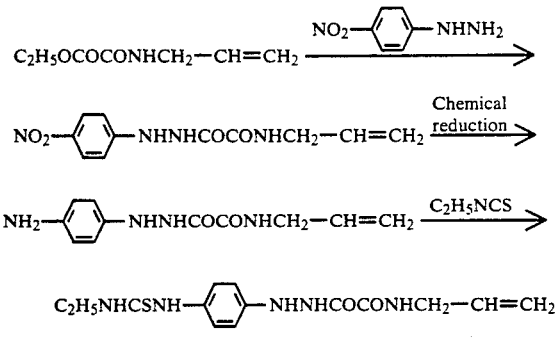
Or the compound can also be prepared by the following method.
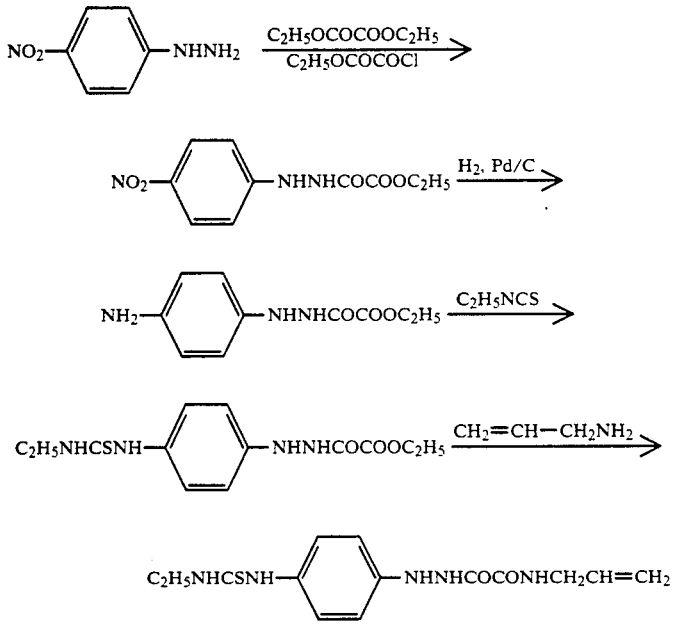
In synthesizing these compounds, there can also be referred to the methods described, for example, in Japanese Pat. O.P.I. Pub. No. 52050/1980 and U.S. Pat. No. 4,686,167.
Compound H-3 can be synthesized according to the following method.
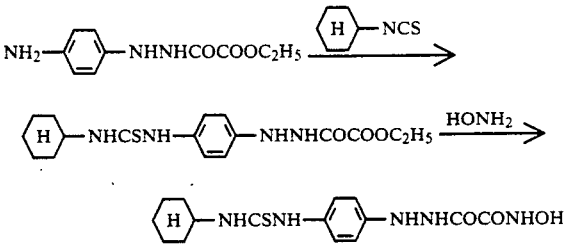
Compound H-5 can be synthesized by the following method.
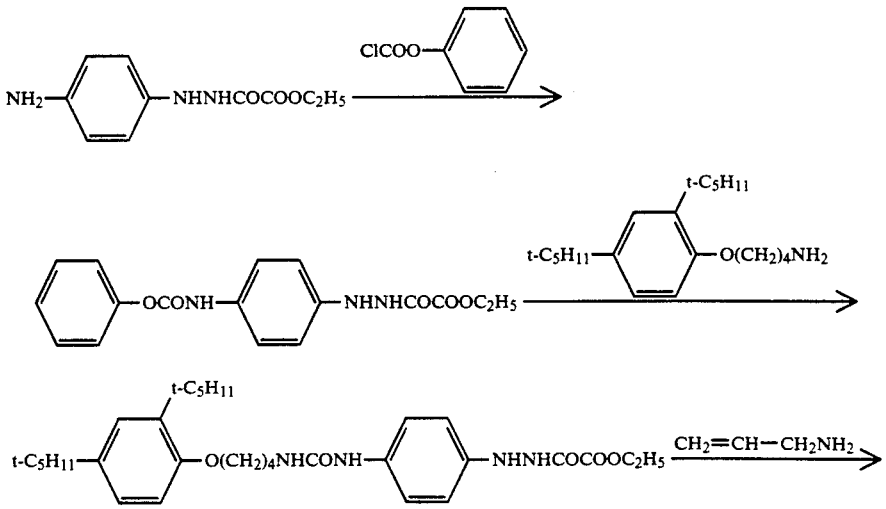

-continued
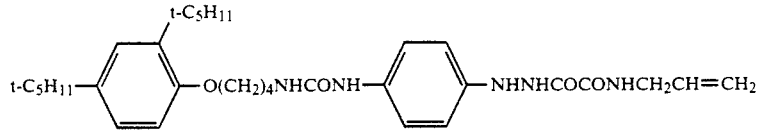
The compound can also be synthesized in the following procedure.
Compound H-35 can be synthesized according to the following method.
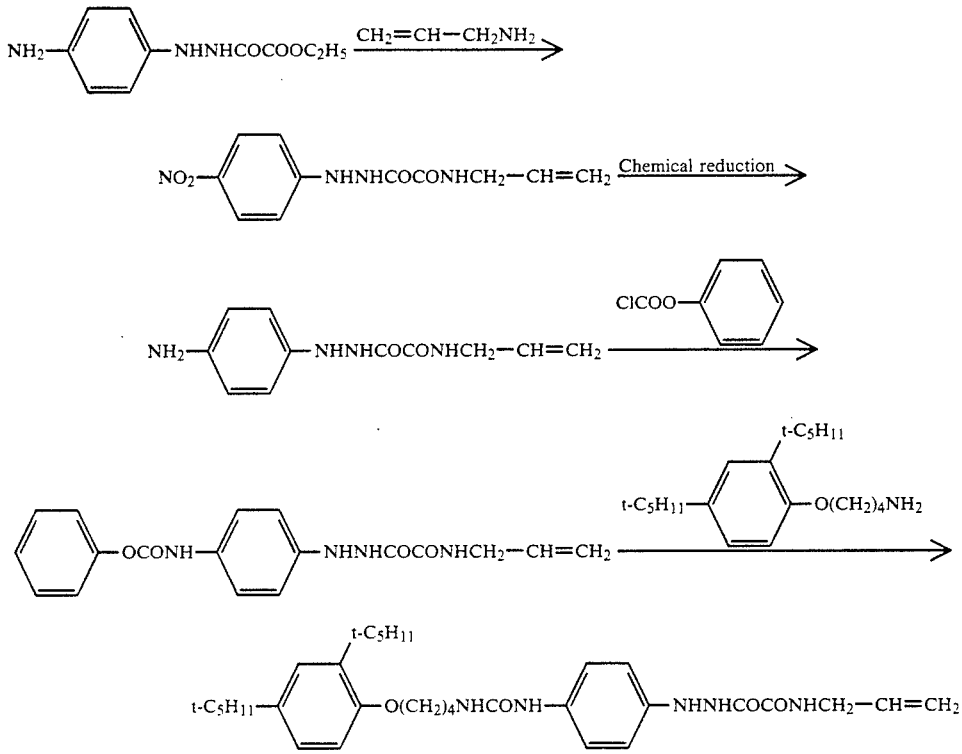
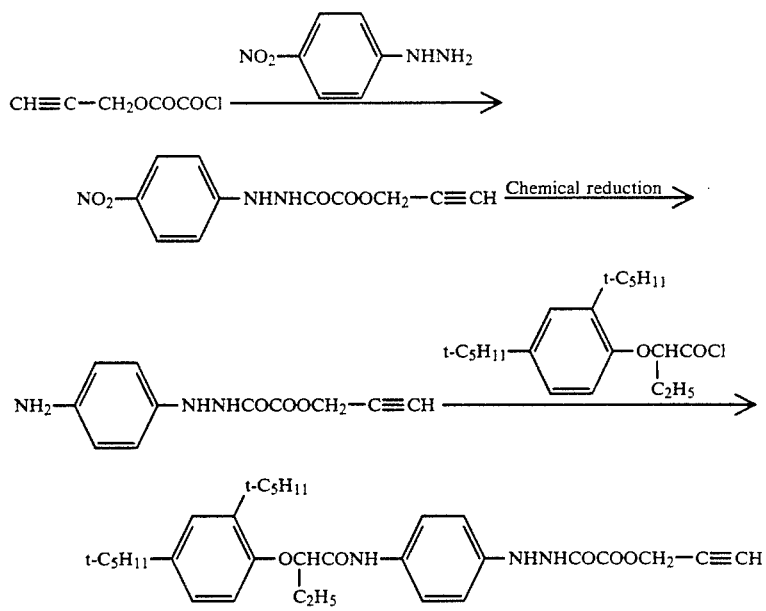
Compound H-49 can be synthesized according to the following method.

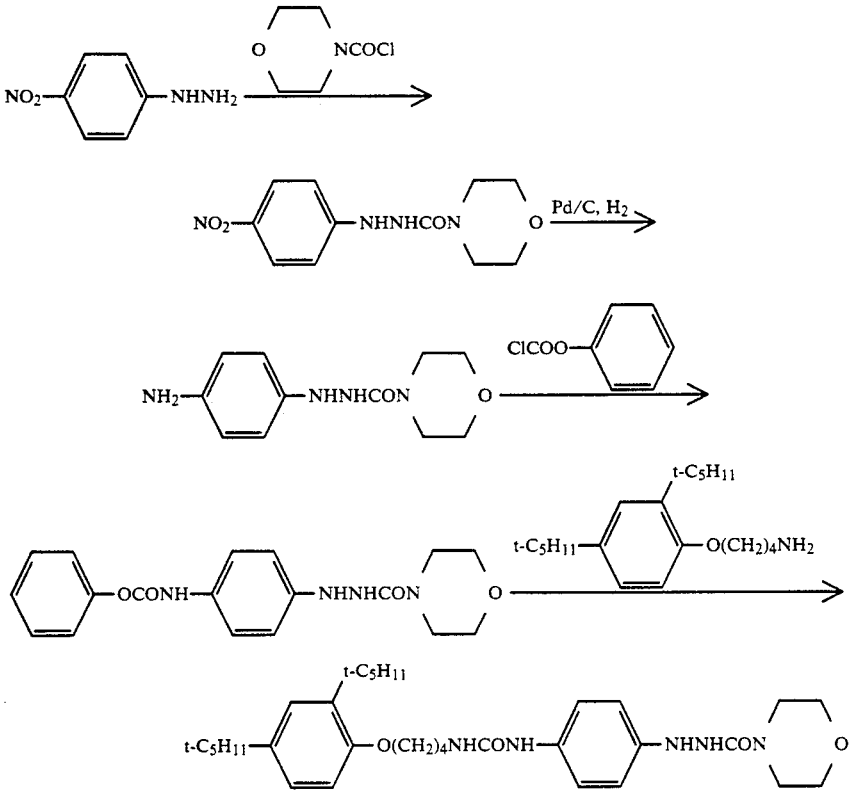

Other methods for synthesizing Compounds H-1 and H-5 as well as a method for synthesizing Compound H-57 are described below.

Synthesis of Compound H-1

The scheme of the synthesis is as follows:

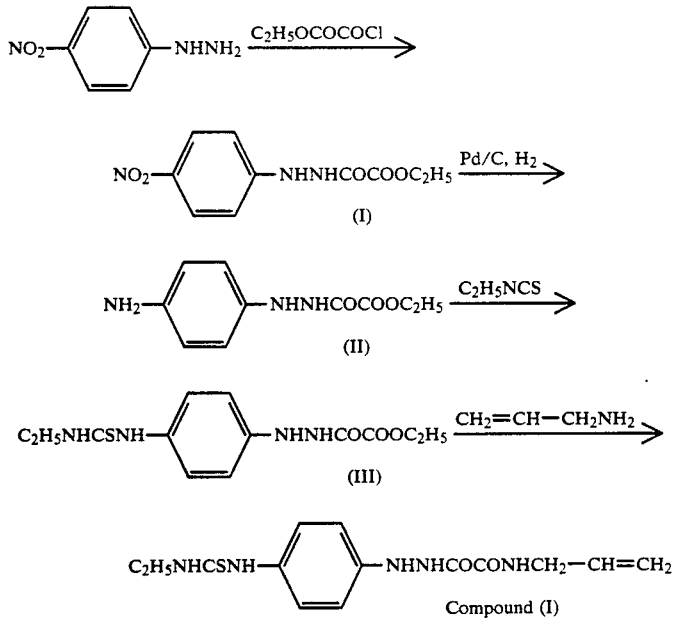

While cooling a suspension of 15 g of p-nitrophenyl hydrazine in 150 ml of acetonitrile with ice-cold water, 19 g of ethoxyoxalyl chloride and succeedingly 14 g of triethylamine were added dropwise thereto. After completion of the addition, the reaction mixture was stirred for 1 hour at room temperature. After filtering off insoluble matters, the filtrate was concentrated, and the residue was dissolved in 400 ml of chloroform. After washing the solution with a weak aqueous alkali, the chloroform layer was separated and concentrated, so that 29.7 g of crude product was obtained. It was purified by being stirred in 120 ml of isopropanol to obtain 16.9 g of Compound (I). Then, 16 g of Compound (I) and 5 g of Pd/C catalyst were added to 160 ml of acetic acid, and the mixture was stirred at room temperature in a hydrogen stream of atmospheric pressure. After completion of reaction, the catalyst residue was removed by filtration, the filtrate was concentrated to obtain a crude product. Purification of the crude product by column chromatography gave 5.6 g of Compound (II).

There were added dropwise 9.5 g of ethylthiocyanate to a suspension of 8.1 g of Compound (II) and 80 ml of acetonitrile under reflux-heating. After refluxing for 2 hours under heating, the reaction mixture was concentrated to obtain 11 g of a crude product, which was then recrystallized from acetonitrile. Thus, 4.5 g of Compound (III) was obtained.

After dissolving 5.0 g of Compound (III) in 40 ml of allylamine, the solution was refluxed for 2 hours under heating, then it was concentrated to obtain 4.9 g of a crude product. The crude product was purified by being stirred in 25 ml of chloroform. The product was 4.3 g of Compound H-1 having a melting point of 206.9° C. Detection with FAB-MS gave a $M^{+}+1$ value of 322.

Synthesis of Compound H-5

The scheme of the synthesis is as follows:

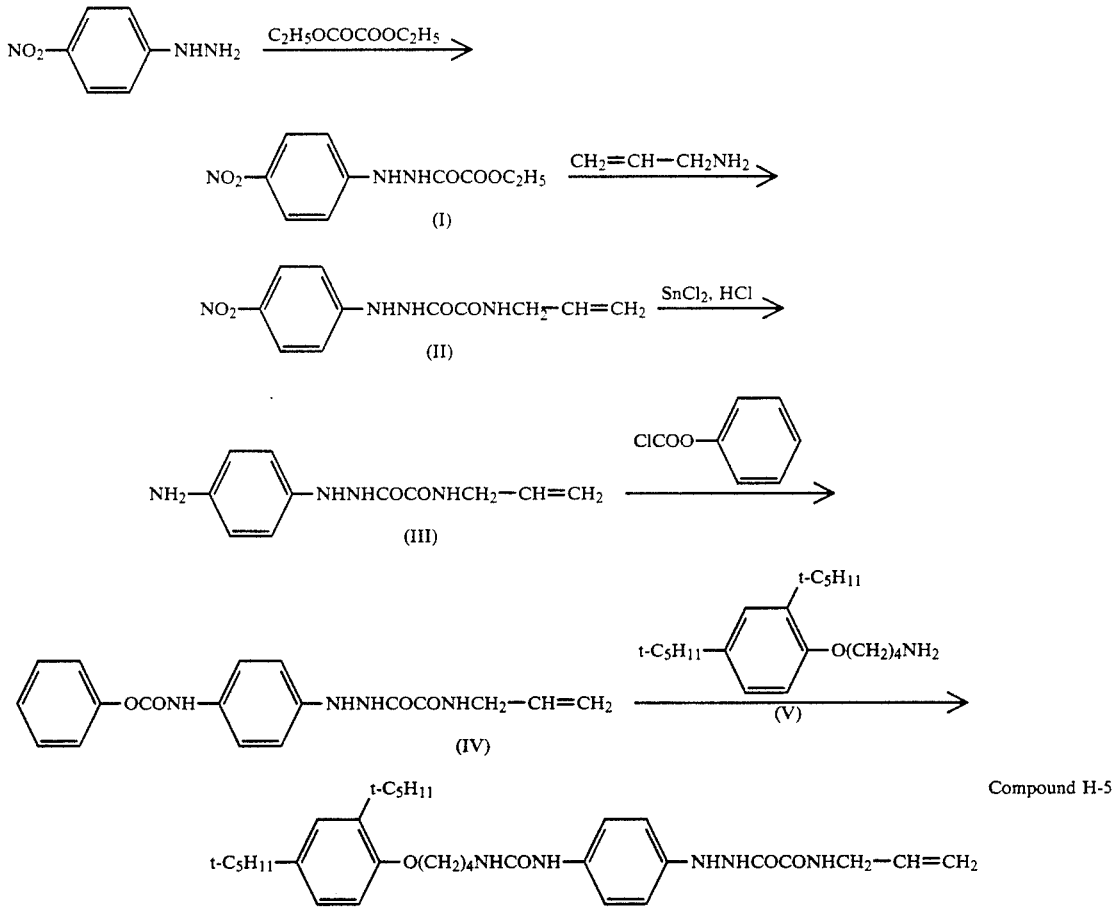

Compound (I) was prepared according to the method described in U.S. Pat. No. 4,686,167. A solution consisting of 31.3 g of Compound (I), 300 ml of ethanol and 10.6 g of allylamine was heated and allowed to react for a night at the refluxing temperature. After concentrating the reaction liquor, 600 ml of benzene was added to the concentrated liquor, and it was cooled to 5° C. Crystals formed were filtered off, so that 30 g of Compound (II) was obtained.

There was dissolved 30 g of Compound (II) in 540 ml of tetrahydrofuran, and 150 ml of concentrated hydrochloric acid was added thereto. Next, a solution of 150.8 g of $SnCl_2$ in 540 ml of tetrahydrofuran was added at room temperature, and the solution was allowed to react for a night at 40° to 50° C. After the reaction, the crystals formed were filtered off and suspended in 1 liter of methanol, then the suspension was adjusted to pH 7.5 to 8 with $NH_4OH$ under stirring, and the stirring was further continued for another 1 hour. Next, one-half of the methanol was distilled out, and the solution was cooled to 0° C. Filtration of the crystals formed gave 19.8 g of Compound (III).

After dissolving 15 g of Compound (III) in 600 ml of pyridine, 11 g of phenyl chloroformate was added dropwise thereto, while cooling the solution less than 15° C. from the outside. After the addition, the mixture was allowed to react for a night at room temperature. Then, the pyridine was distilled out, the residue was washed with 200 ml of acetone and then filtered, so that 17 g of Compound (IV) was obtained.

There was dissolved 16.2 g of Compound (IV) in 160 ml of pyridine, and 160 ml of a pyridine solution containing 16.8 g of Compound (V) was added thereto. The solution was refluxed for 3 hours under heating to complete the reaction. Then, the pyridine was distilled out, the residue was washed by adding 300 ml of n-hexane and stirring them together, and after that, crude crystals formed were filtered off. The crude crystals were dissolved in 60 ml of dimethylformamide under heating, 180 ml of acetone was added thereto, and then the solution was cooled to 0° C. Filtration of crystals formed gave 13.8 g of Compound H-5 having a melting point of 198.5° to 199.5° C. Detection with FAB-MS gave $M^+=565$.

Synthesis of Compound H-57

The scheme of the synthesis is as follows:

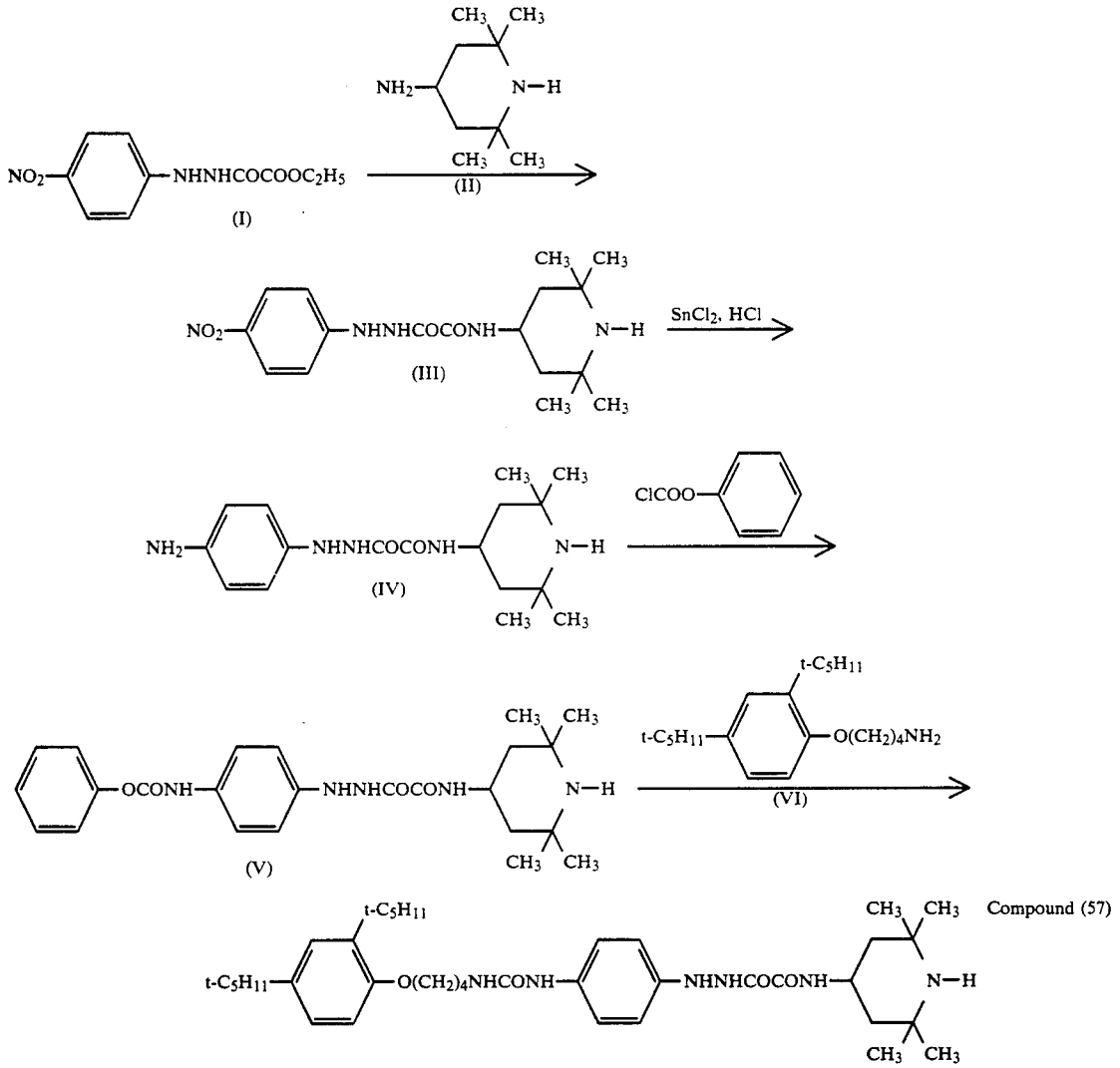

There were heated 27 g of Compound (I), 250 ml of ethanol and 25 g of Compound (II) and allowed to react at the refluxing temperature for a night. After completion of the reaction, crystals formed on cooling the reaction liquor were filtered off and washed with ethanol. Recrystallization of 31 g of the above crude crystals from 3 liters of methanol gave 20.8 g of Compound (III).

To a suspension prepared by dispersing 19 g of Compound (III) in 400 ml of tetrahydrofuran was added 115 ml of concentrated hydrochloric acid. Then, 300 ml of tetrahydrofuran solution dissolving 69.4 g of $SnCl_2$ was added thereto at room temperature, and the mixture was allowed to react at 40° to 50° C. for a night. After the reaction, crystals formed were filtered off and dissolved in 420 ml of methanol, then, the solution was suspended in 1680 ml of tetrahydrofuran, and the suspension was adjusted to pH 8.5 with $NH_4OH$ under stirring and stirred further for 15 minutes. Next, the crystals formed were filtered off to obtain 11.5 g of Compound (IV).

After dissolving 10 g of Compound (IV) in 1 liter of pyridine, 5.2 g of phenyl chloroformate was added thereto dropwise, while keeping the temperature of the solution less than 15° C. by cooling with ice-cold water from the outside. Then, it was allowed to react at room temperature for a night.

When the reaction was completed, 700 to 800 ml of pyridine was distilled out, and 400 ml of acetone was added to the residue and mixed with stirring, then the solution was allowed to stand to precipitate crystals.

These crude crystals were suspended in 200 ml of acetone and the suspension was refluxed. Next, the suspensoid was dissolved by adding dropwise 260 ml of dimethylformamide, and after removing insoluble matters, the solution was cooled to 0° C., so that 8.5 g of Compound (V) was obtained in the form of crystals.

After suspending 10 g of Compound (V) in 200 ml of pyridine, 100 ml of pyridine solution containing 8.1 g of Compound (VI) was added, and the mixture was allowed to react for 3 hours at the refluxing temperature. Then, 2 liters of acetone was added to the reaction liquor to crystallize the product. The crude crystals obtained were suspended in 85 ml of acetone. While refluxing the suspension, 85 ml of methanol was added dropwise, and immediately after dissolving the suspensoid, the solution was cooled to 0° C. Compound H-57 was thus obtained as crystals with a yield of 6 g. Its melting point was 230° to 231° C. The detection with FAB-MS gave M+1=665.

Synthesis of Compound H-61

The scheme of the synthesis is as follows:

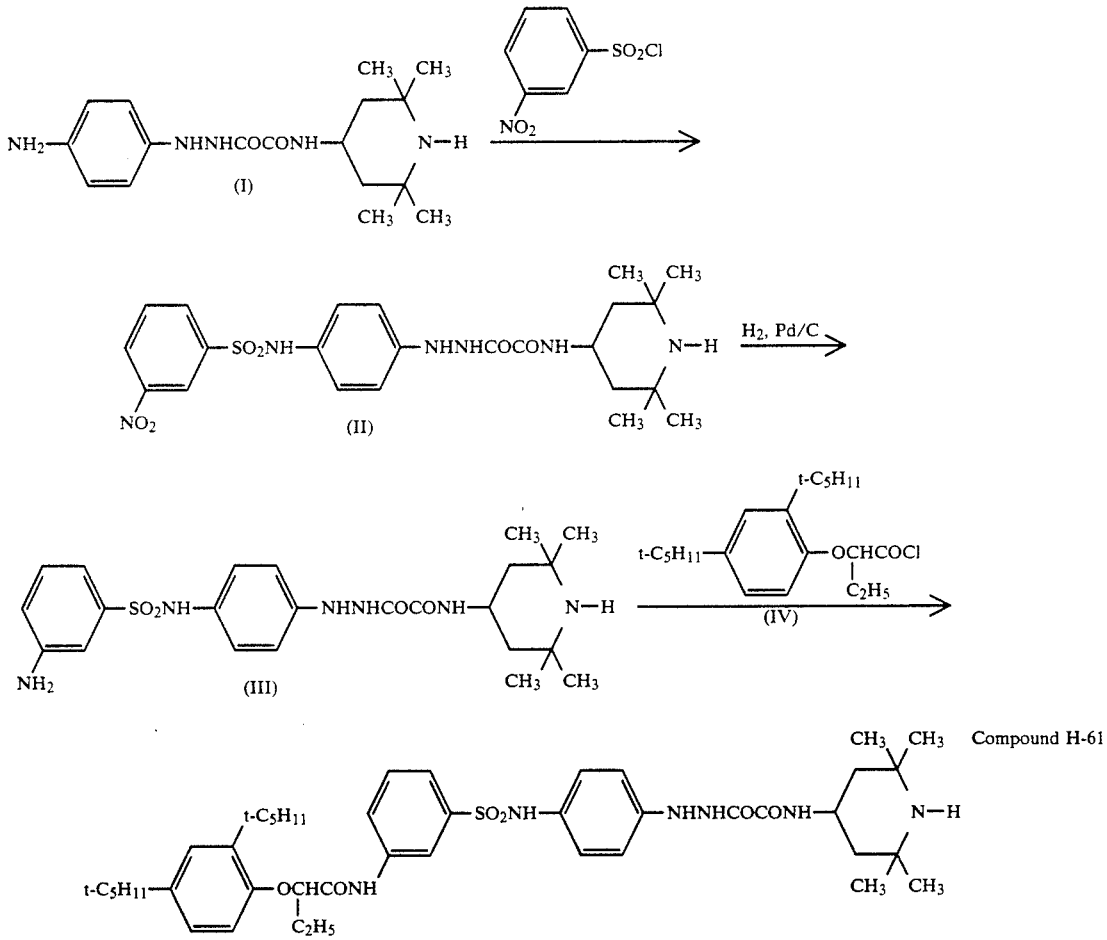

There was added 6.6 g of m-nitrobenzene sulfonylchloride to 50 ml of pyridine solution containing 10 g of Compound (I), while cooling the content with ice-cold water from the outside. After allowing them to react for 10 hours at room temperature, the solvent was distilled out and water was added. The solid matter was filtered off and purified by column chromatography (chloroform/methanol=3/2), so that 5.9 g of Compound (II) was obtained.

A mixed liquor of 5.5 g of Compound (II), 1.0 g of wet 5%-Pd/C and 150 ml of methanol was hydrogenated at atmospheric pressure.

After the hydrogenation, the Pd/C was removed by filtration, and the solvent was distilled out to obtain Compound (III). The product was dissolved in 50 ml of pyridine, then 10 ml of pyridine solution containing 4.0 g of Compound (IV) was added dropwise, while cooling the reaction liquor with ice-cold water from the outside. After stirring the solution for 5 hours at room temperature, the solvent was distilled out and water was added. The solid matter was filtered off, purified by column chromatography (methylene chloride/methanol=5/1) and recrystallized from a mixture of ethyl acetate and n-hexane, so that 1.0 g of Compound H-61 was obtained. The melting point was 165° to 172° C. The structure of the product was confirmed by MS and NMR.

Compound H-62 can be synthesized by the following method.

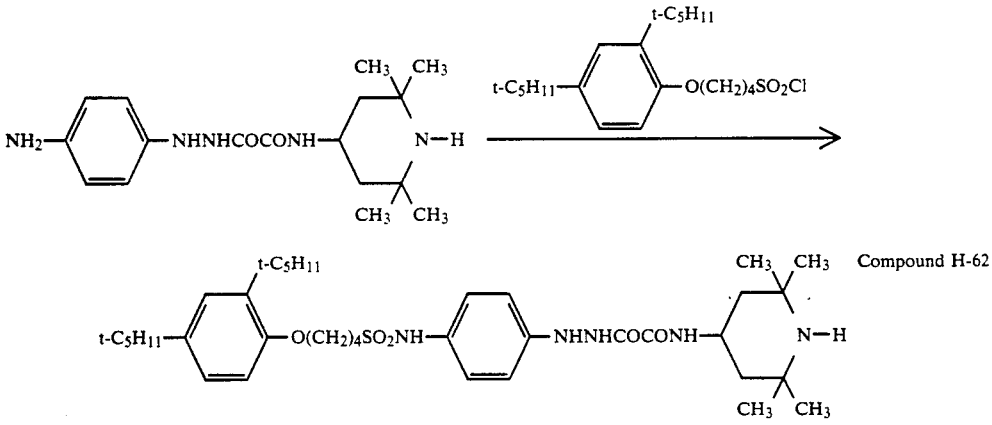
Compound H-116 can be synthesized by the following method.
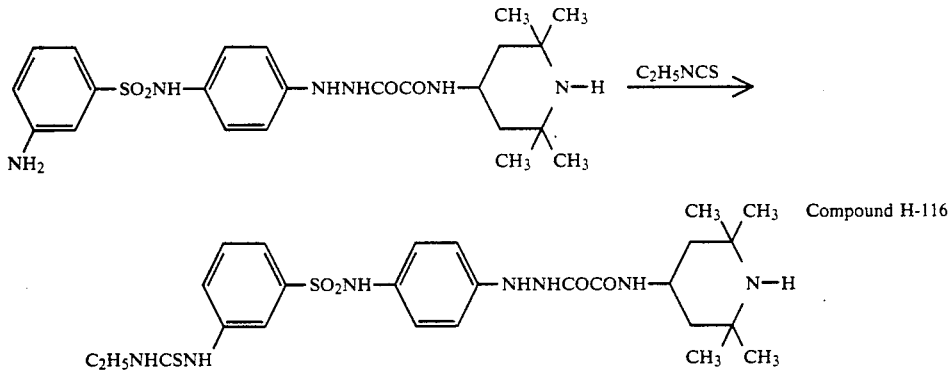
Compound H-133 can be synthesized by the following method.
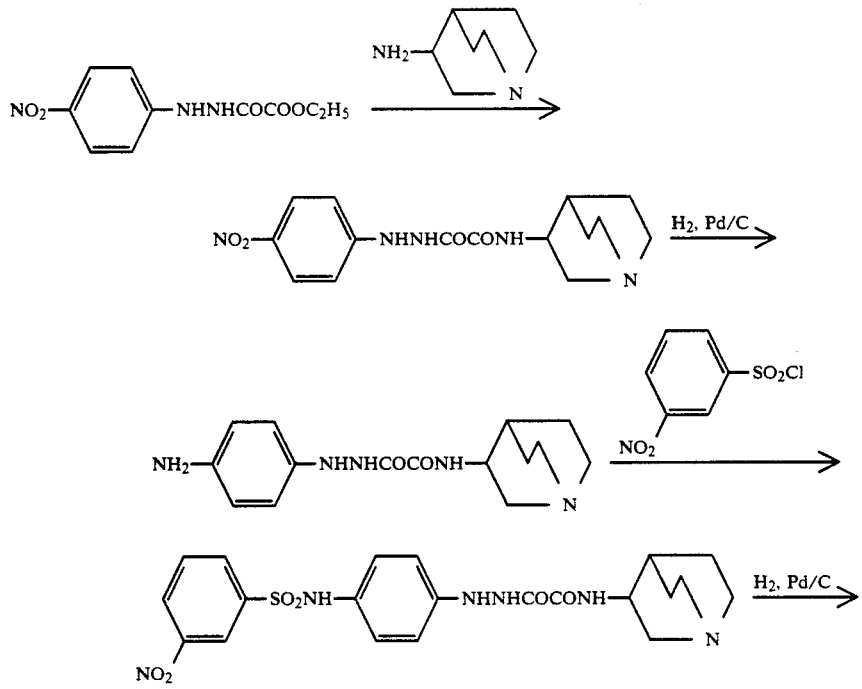

-continued
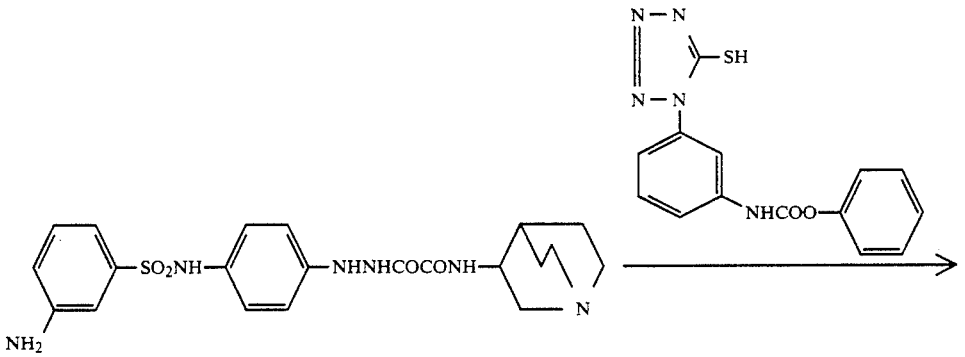
Compound H-133
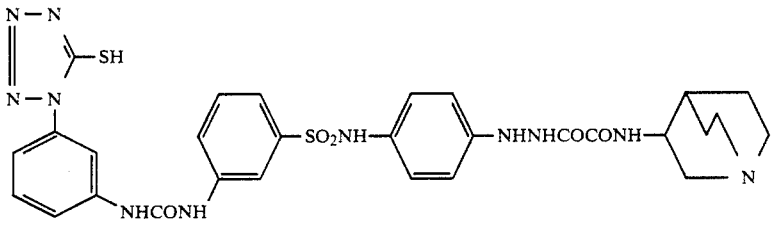
Compound H-140 can be synthesized by the following method.
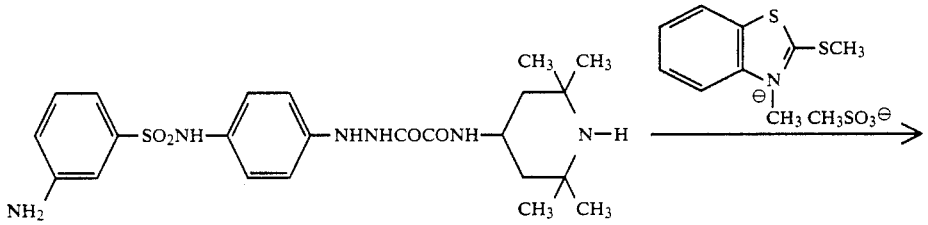
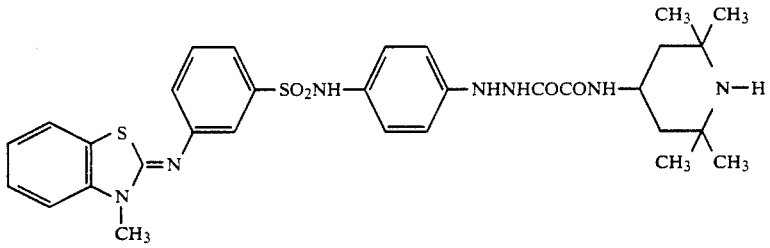
Compound H-140
Compound H-71 can be synthesized by the following method.
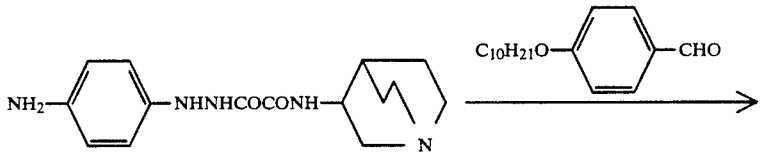
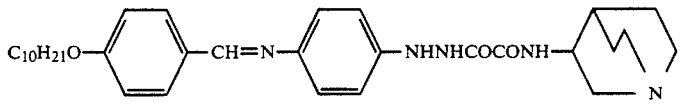
Compound H-71
Compound H-149 can be synthesized by the following method.

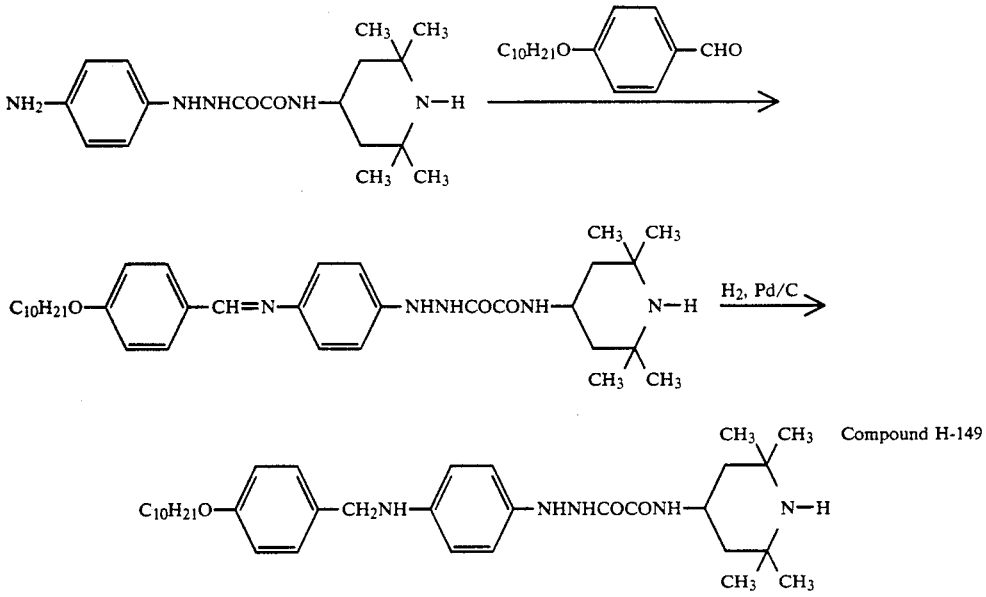

In the silver halide photographic light-sensitive material capable of providing high contrast images, to which the present invention is applied, at least one hydrazine compound represented by Formula H is contained. The amount of the compound of Formula H contained in said light-sensitive material is desirably $5\times10^{-7}$ to $5\times10^{-1}$ mol per mol of silver halide in the light-sensitive material. It is more desirable that this amount be within a range from $5\times10^{-6}$ to $1\times10^{-2}$ mol.

In the invention, it is preferable that a compound selected from amine compounds and quaternary onium salts be contained in a silver halide emulsion layer and/or a layer adjacent thereto. These amine compounds and quaternary onium salts are those compounds which are represented by one of the following Formulas I through VI. Among them, preferred compounds are those denoted by V-I, V-II, V-III, VI-I, VI-II and VI-III.

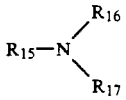

Formula I

In Formula I, $R_{15}$, $R_{16}$ and $R_{17}$ each represent a hydrogen atom or a substituent. Two or three of $R_1$, $R_2$ and $R_3$ may be linked to each other to form a ring, and $R_{15}$, $R_{16}$ and $R_{17}$ are not hydrogen atoms at the same time. Examples of the substituent represented by $R_{15}$, $R_{16}$ or $R_{17}$ include alkyl groups such as methyl, ethyl, propyl, butyl, hexyl and cyclohexyl groups; alkenyl groups such as allyl and butenyl groups; alkynyl groups such as propargyl and butynyl groups; aryl groups such as phenyl and naphthyl groups; and saturated or unsaturated heterocyclic groups such as piperidinyl, piperazinyl, morpholinyl, pyridinyl, furyl, thienyl, tetrahydrofuryl, tetrahydrothienyl and sulfolanyl groups.

$R_{15}$, $R_{16}$ and $R_{17}$ may be linked to each other to from a ring such as piperidine, morpholine, piperazine, quinuclidine or pyridine.

The group represented by $R_{15}$, $R_{16}$ or $R_{17}$ may have a substituent such as hydroxy, alkoxy, aryloxy, carboxyl, sulfo, alkyl or aryl group. When $R_1$ is an alkyl group, it preferably has a hydrox group, a carboxyl group or a sulfo group as a substituent.

As $R_{15}$, $R_{16}$ and $R_{17}$, hydrogen atoms and alkyl groups are preferred, provided that $R_{15}$, $R_{16}$ and $R_{17}$ are not hydrogen atoms at the same time.

Typical examples of the compound represented by Formula I are illustrated below.

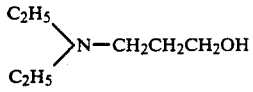

I-1

$CH_3NHCH_2CH_2OH$ I-2

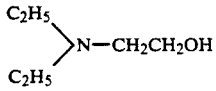

I-3

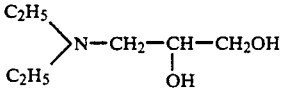

I-4

$NH_2(CH_2)_5OH$ I-5

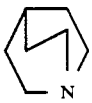

I-6

-continued

I-7 $(C_2H_5)_3N$

I-8

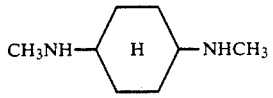

I-9 $(i\text{-}C_3H_7)_2NH$

I-10

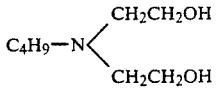

I-11

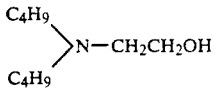

I-12

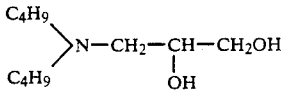

I-13

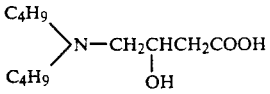

I-14

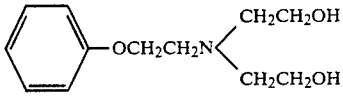

I-15

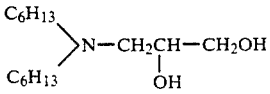

I-16

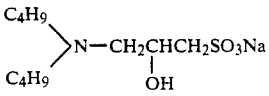

I-17

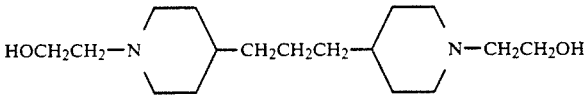

I-18

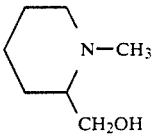

I-19

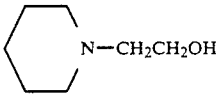

I-20

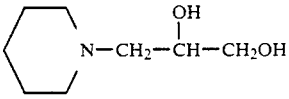

I-21

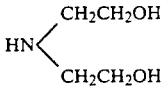

I-22 $N(CH_2CH_2OH)_3$

I-23

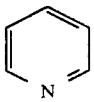

I-24

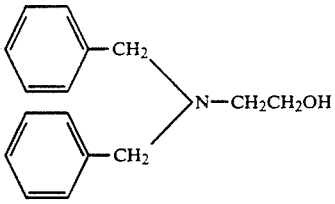

I-25

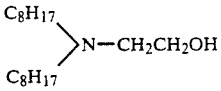

I-26

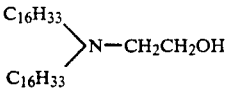

Formula II

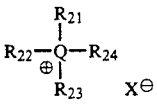

In Formula II, Q represents a nitro9en or phosphorus atom; $R_{21}$, $R_{22}$, $R_{23}$ and $R_{24}$ each represents a hydrogen atom or a substituent provided that $R_{21}$, $R_{22}$, $R_{23}$ and $R_{24}$ are not hydrogen atoms at the same time, and $X^{\ominus}$ represents an anion.

Two or three of $R_{21}$, $R_{22}$, $R_{23}$ and $R_{24}$ may be linked to each other to form a ring. The substituent T represented by $R_{21}$, $R_{22}$, $R_{23}$ or $R_{24}$ includes alkyl, alkenyl, alkynyl, aryl, saturated or unsaturated heterocyclic and amino groups. Examples thereof are those illustrated in respect of $R_{15}$, $R_{16}$ and $R_{17}$ of Formula I. The ring $R_{21}$, $R_{22}$, $R_{23}$ and $R_{24}$ may form is the same as the ring which may be formed b $R_{15}$, $R_{16}$ and $R_{17}$ of Formula I. The anion represented by $X^{\ominus}$ includes inorganic and organic anions such as halide ions, sulfate ion, nitrate ion, acetate ion and p-toluenesulfonate ion.

Typical example of the compound represented by Formula II are illustrated below.

II-1
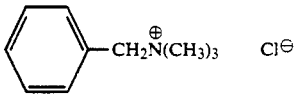
II-2
II-3
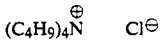
II-4
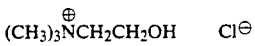
II-5
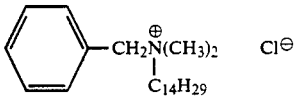
II-6
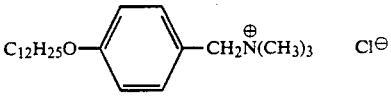
II-7
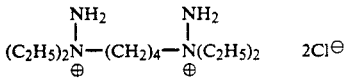
II-8
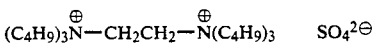
II-9
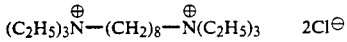
II-10
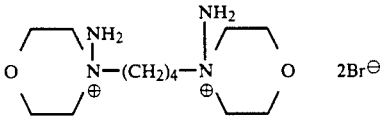
II-11
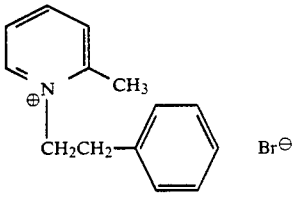
II-12
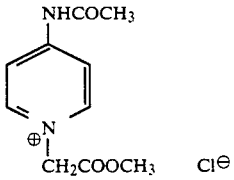
II-13
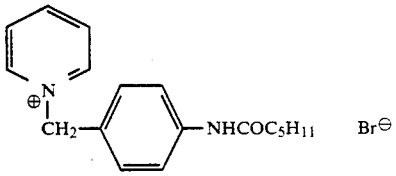
II-14
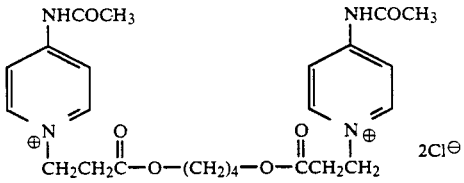
II-15
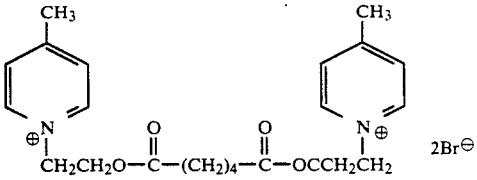
II-16
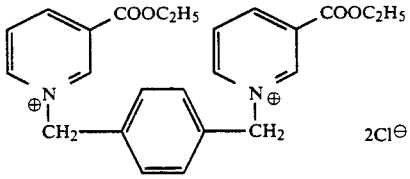
II-17
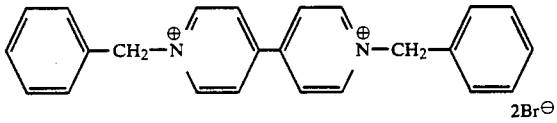
II-18
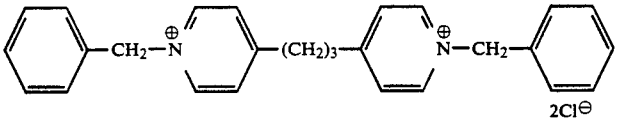
II-19
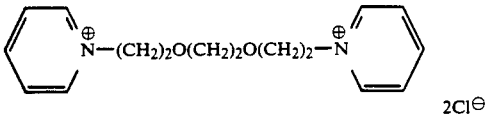
II-20
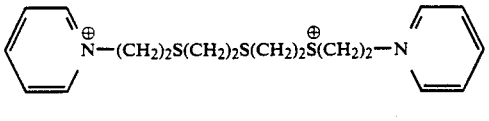

-continued

II-21

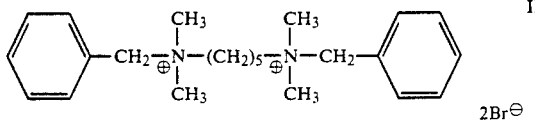

II-22

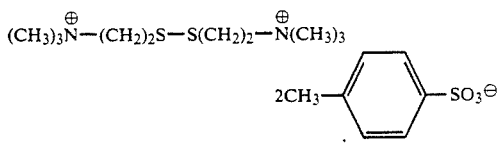

II-23

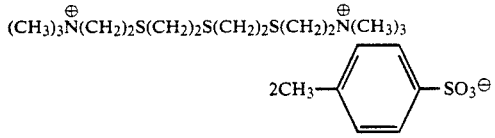

II-24

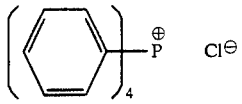

II-25

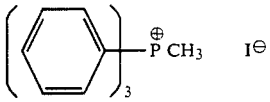

II-26

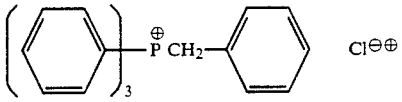

II-27

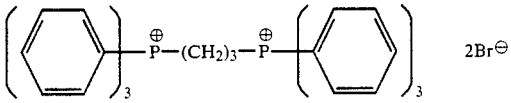

II-28

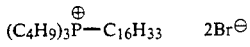

II-29

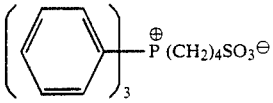

Formula III

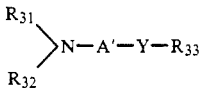

In Formula III, $R_{31}$ and $R_{32}$ each represent an alkyl group, $R_{31}$ and $R_{32}$ may be linked to each other to form a ring; $R_{33}$ represents an alkyl, aryl or heterocyclic group; A' represents an alkylene group; Y represents —$CONR_{34}$—, —$OCONR_{34}$—, —$NR_{34}CONR_{34}$—, —$NR_{34}COO$—, —COO—, —DCO—, —CO—, —O-COO—, —$NR_{34}CO$—, —$SO_2NR_{34}$—, —$NR_{34}SO_2$—, —$NR_{34}SO_2NR_{34}$—, —$SO_2$—, —S—, —O—, —$NR_{34}$— or —N= group, wherein $R_{34}$ represents a hydrogen atom or an alkyl group.

The alkyl group represented by $R_{31}$ or $R_{32}$ includes those illustrated as alkyl groups of $R_{15}$, $R_{16}$ or $R_{17}$ of Formula I, and the ring formed is the same as the ring illustrated in respect to Formula I.

The alkyl, aryl and heterocyclic groups represented by $R_{33}$ are the same as the alkyl, aryl and heterocyclic groups represented by $R_{15}$, $R_{16}$ or $R_{17}$ of Formula I.

The alkylene group represented by A' includes methylene, ethylene, trimethylene and tetramethylene; substituents thereof are aryl, alkoxy and hydroxy groups and halogen atoms.

The alkyl group represented by $R_{34}$ is preferably a lower alkyl or aralkyl group having 1 to 5 carbon atoms, examples thereof include benzyl group.

Typical examples of the compound represented by Formula III are as follows:

III-1

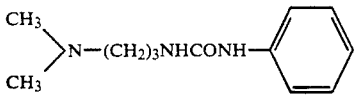

III-2

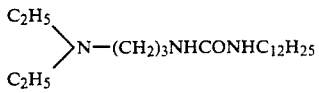

III-3

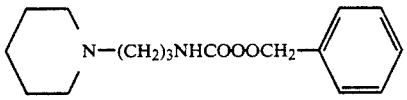

III-4

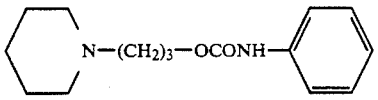

III-5

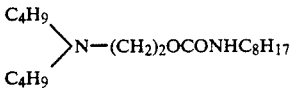

III-6

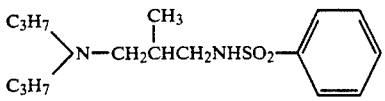

III-7

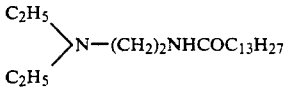

III-8

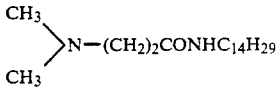

-continued
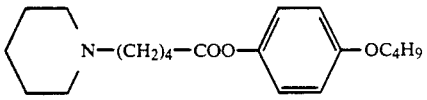
III-9
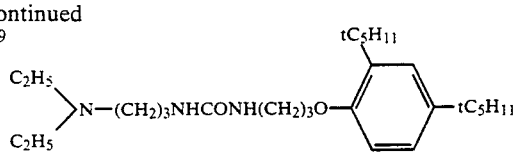
III-10
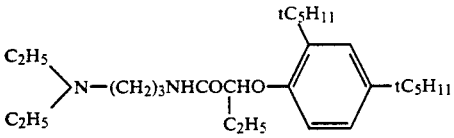
III-11
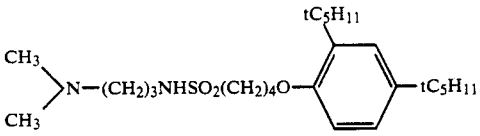
III-12
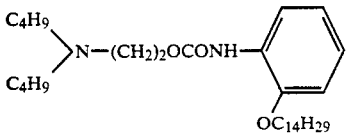
III-13
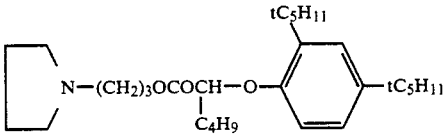
III-14
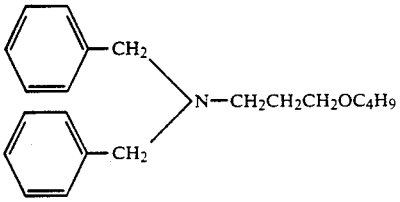
III-15
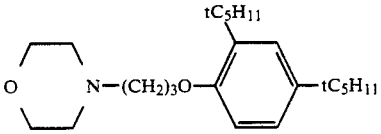
III-16
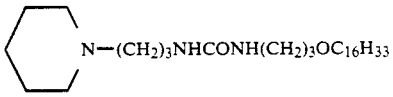
III-17
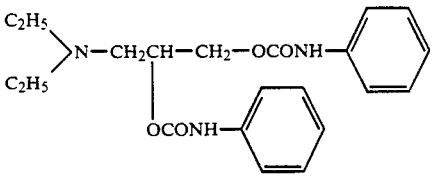
III-18
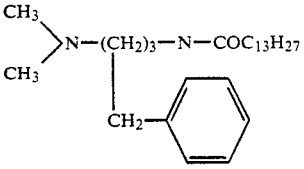
III-19
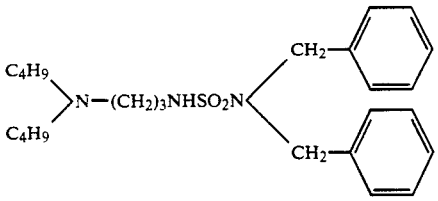
III-20
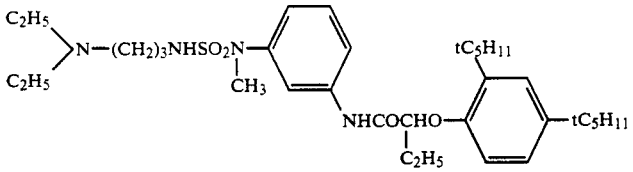
III-21
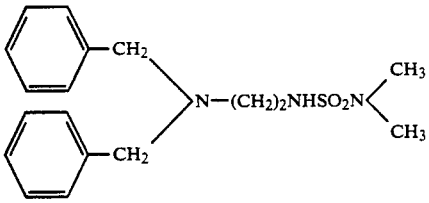
III-22
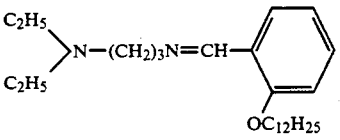
III-23
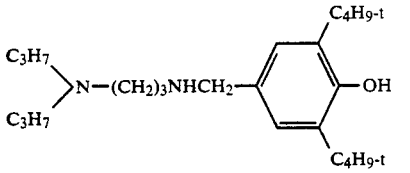
III-24
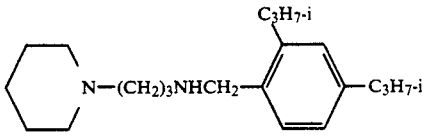
III-25

-continued
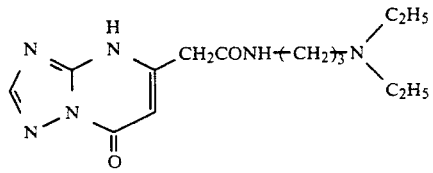
III-26
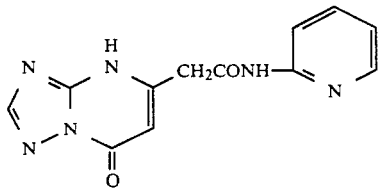
III-27
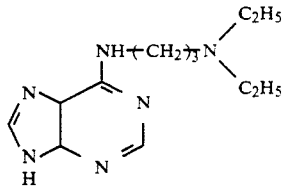
III-28
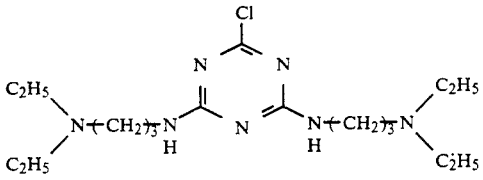
III-29
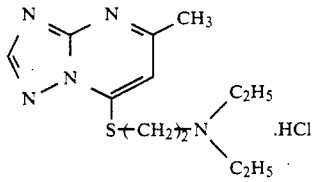
III-30
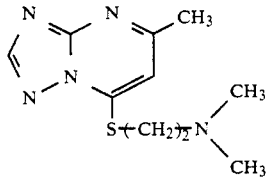
III-31
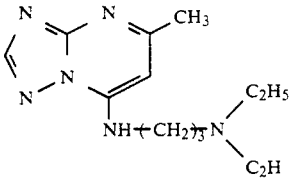
III-32
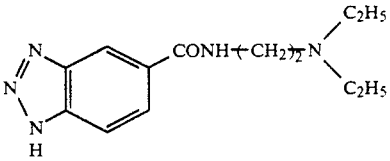
III-33
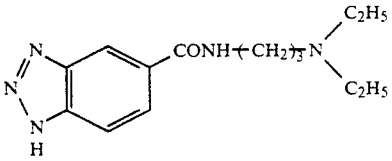
III-34
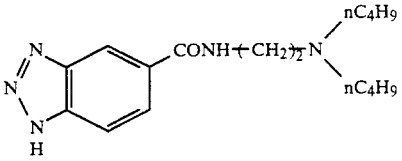
III-35
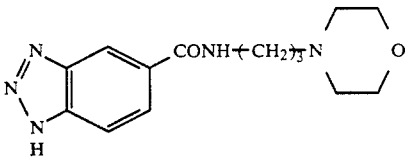
III-36
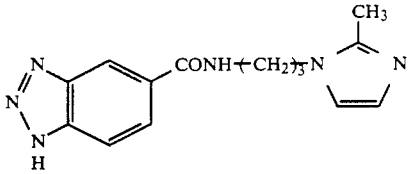
III-37
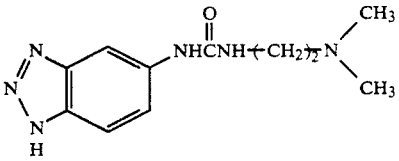
III-38
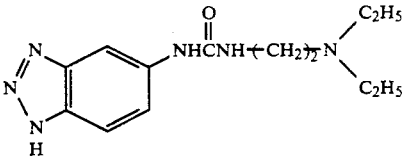
III-39
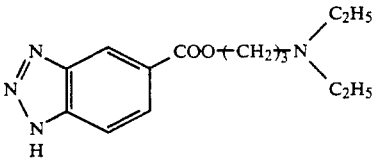
III-40
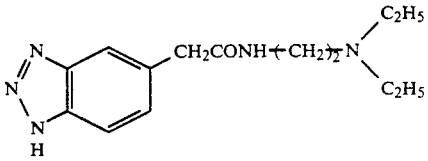
III-41

-continued

III-42

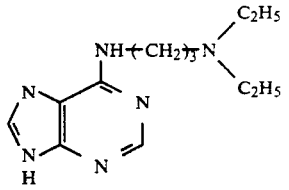

III-43

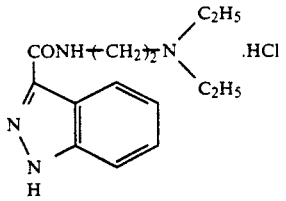

III-44

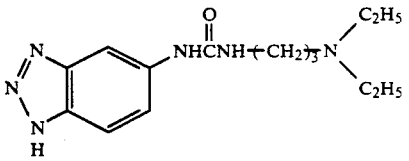

Formula IV

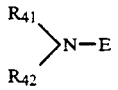

In Formula IV, $R_{41}$, and $R_{42}$ each represents a hydrogen atom, or an alkyl, alkenyl, alkynyl, aryl and heterocyclic group; and $R_{41}$ and $R_{42}$ may form a ring.

E is a group containing at least one of groups represented by $-(CH_2CH_2O)-n$, where n represents an integer of 2 or more.

The alkyl, alkenyl, alkynyl, aryl and saturated or unsaturated heterocyclic groups and the ring formed by $R_{41}$ and $R_{42}$ are the same as those described in respect of $R_{15}$, $R_{16}$ and $R_{17}$ of Formula I.

Typical examples of the compound represented by Formula IV are as follows:

IV-1

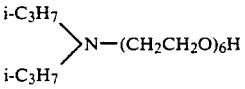

IV-2

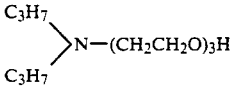

IV-3

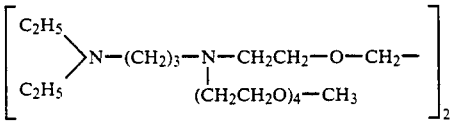

IV-4

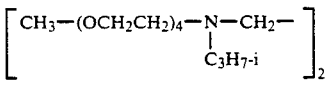

IV-5

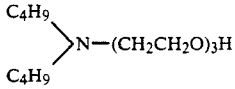

IV-6

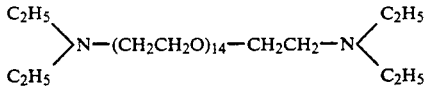

IV-7

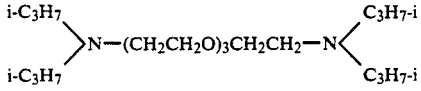

IV-8

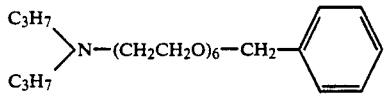

IV-9

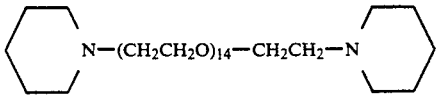

IV-10

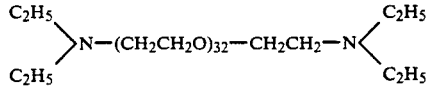

-continued
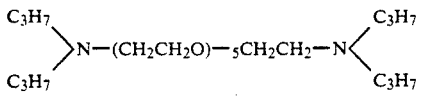
IV-11
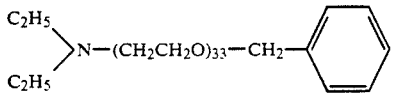
IV-12
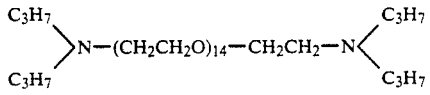
IV-13
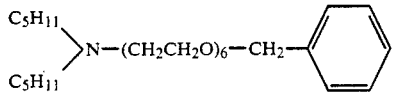
IV-14
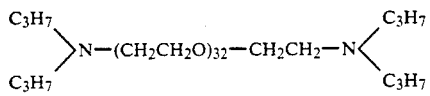
IV-15
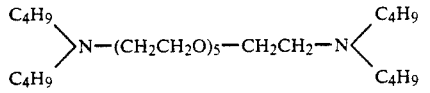
IV-16
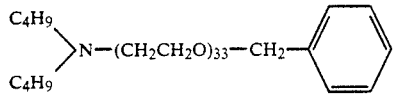
IV-17
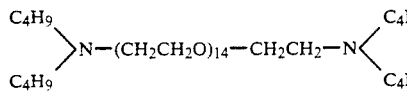
IV-18
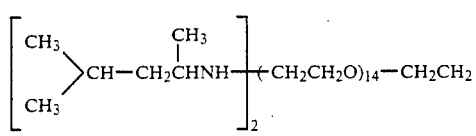
IV-19
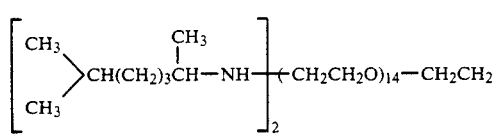
IV-20
$C_5H_{11}NH-(CH_2CH_2O)_{14}-CH_2CH_2NHC_5H_{11}$ IV-21
$C_7H_{15}NH-(CH_2CH_2O)_{14}CH_2CH_2NHC_7H_{15}$ IV-22
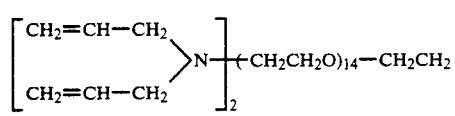
IV-23
$[CH_2{=}CH-CH_2NH]_2(CH_2CH_2O)_{14}CH_2CH_2$ IV-24
$[CH{\equiv}C-CH_2NH]_2(CH_2CH_2O)_{14}CH_2CH_2$ IV-25
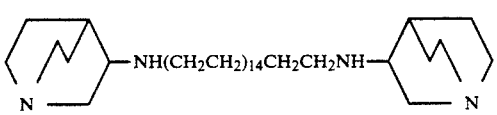
IV-26

-continued
IV-27
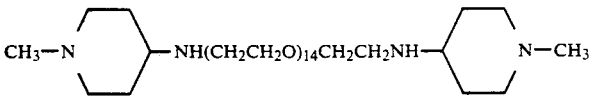
IV-28
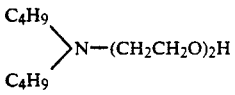
IV-29
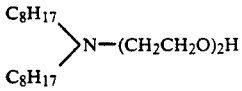
IV-30
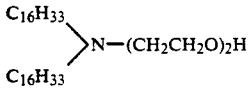
IV-31
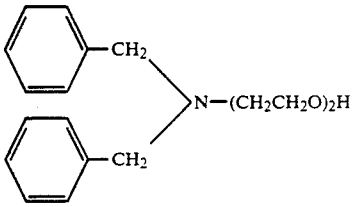
IV-32
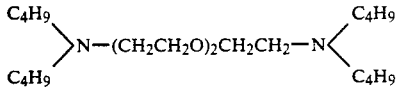
IV-33
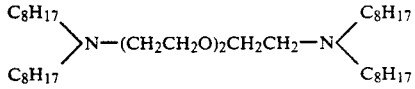
IV-34
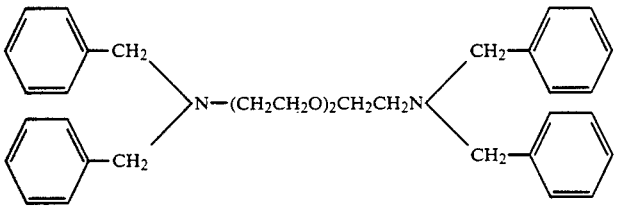
IV-35
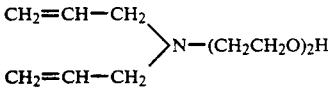
IV-36
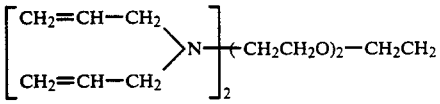
IV-37
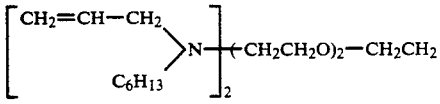
IV-38
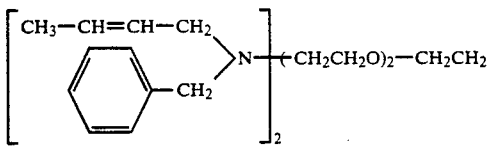

-continued

IV-39

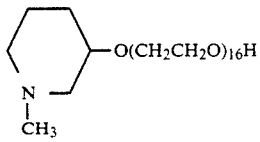

IV-40

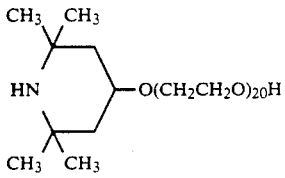

IV-41

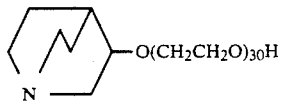

Formula V-I

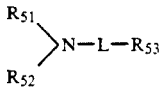

In Formula V-I, $R_{51}$, $R_{52}$ and $R_{53}$ each represent an alkyl, alkenyl, alkynyl, aryl or saturated or unsaturated heterocyclic group, provided that at least one of $R_{51}$, $R_{52}$ and $R_{53}$ represents an alkenyl or alkynyl group, or at least one of $R_{51}$ and $R_{52}$ represents an aryl or heterocyclic group. $R_{51}$ and $R_{52}$ may form a ring. L is an interlinking group.

The alkyl, alkenyl, alkynyl, aryl and heterocyclic groups represented by $R_{51}$, $R_{52}$ or $R_{53}$ are the same as those described in respect of $R_{15}$, $R_{16}$ and $R_{17}$ of Formula I. The ring formed by $R_1$ and $R_2$, is a heterocycle such as piperidine, morpholine or pyrrolizine.

The interlinking group represented by L includes, for example, —A—Y— described in respect of Formula III.

Typical examples of the compound represented by Formula V-I are illustrated below.

V-I-1

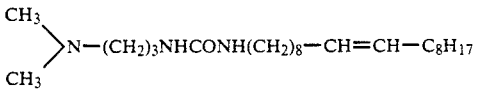

V-I-2

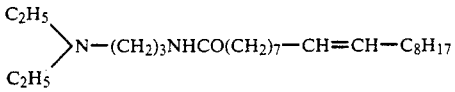

V-I-3

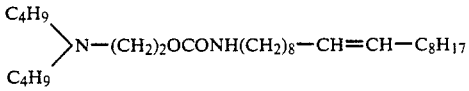

V-I-4

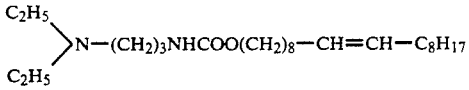

V-I-5

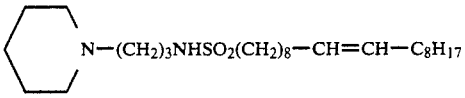

V-I-6

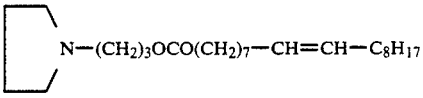

V-I-7

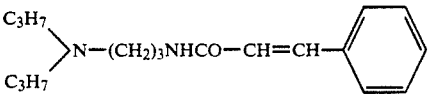

-continued
V-I-8
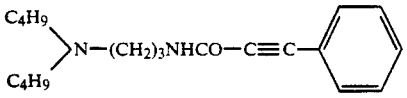
V-I-9
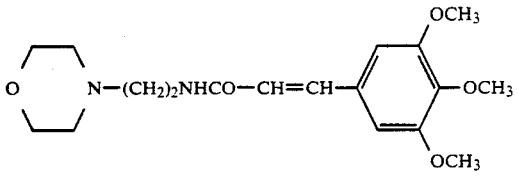
V-I-10
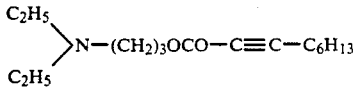
V-I-11
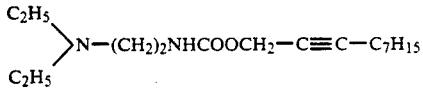
V-I-12
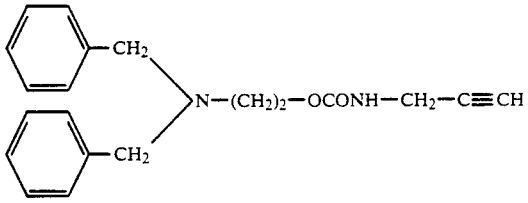
V-I-13
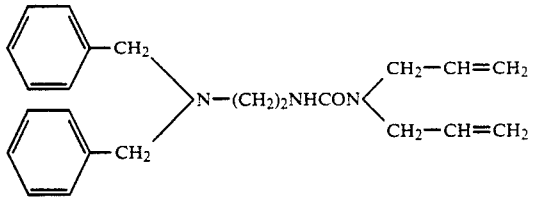
V-I-14
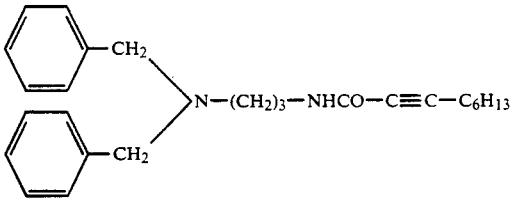
V-I-15
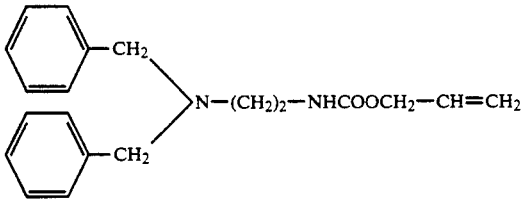
V-I-16
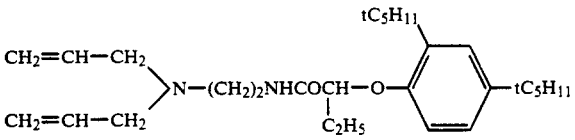

-continued
V-I-17
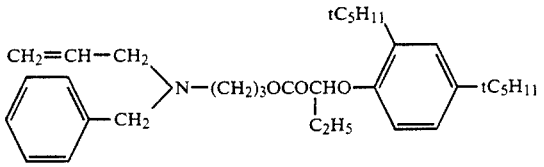
V-I-18
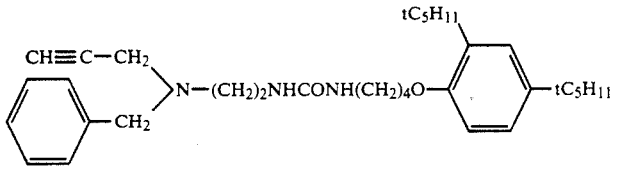
V-I-19
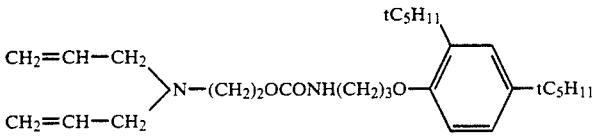
V-I-20
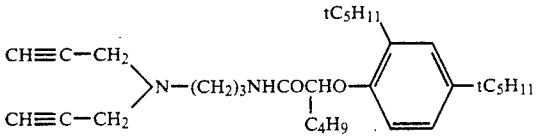
V-I-21
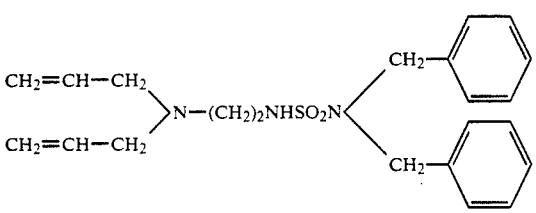
V-I-22
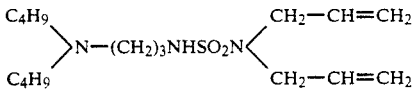
V-I-23
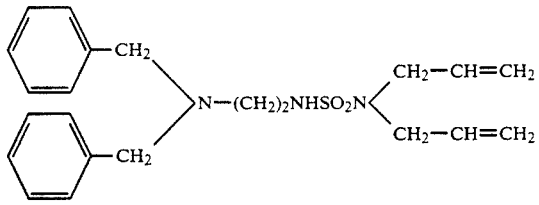
V-I-24
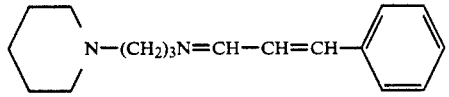
V-I-25
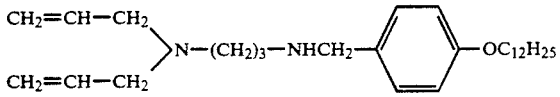
V-I-26
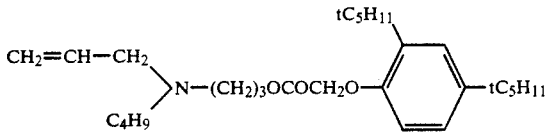

-continued

V-I-27

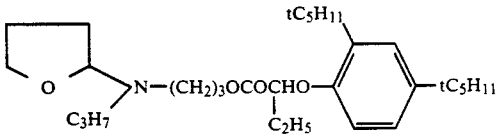

Formula V-II

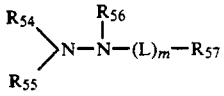

In Formula V-II, $R_1$, $R_2$ and $R_4$ each represent an alkyl, alkenyl, alkynyl, aryl or saturated or unsaturated heterocyclic group; $R_3$ represents a hydrogen atom or a substitutable group.

L represents an interlinking group; m represents an integer of 0 or 1; and $R_{54}$, $R_{55}$, $R_{56}$ and $R_{57}$ may be linked to form a ring. The alkyl, alkenyl, alkynyl, aryl and heterocyclic groups represented $R_{54}$, $R_{55}$ or $R_{57}$ are the same as those described in respect of $R_{15}$, $R_{16}$ and $R_{17}$ of Formula I.

The substitutable group represented by $R_3$ includes, for example, alkyl, alkenyl, alkynyl, aryl and heterocyclic groups; examples thereof are the same as those described above.

The interlinking group represented by L includes groups of —CO—, —COO—;, —$CONR_{50}$—, —$SO_2$— and —$SO_2NR_{50}$—; where $R_{50}$ represents a hydrogen atom or a substitutable group. The ring formed by $R_1$, $R_2$, $R_3$, L and $R_4$ is a heterocycle such as piperidine or morpholine.

Typical examples of the compound represented by Formula V-II are illustrated below.

V-II-1

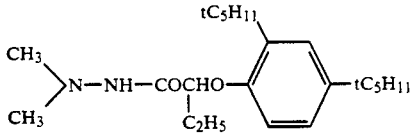

V-II-2

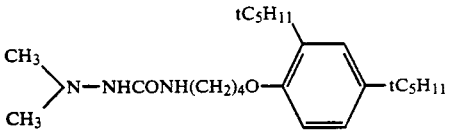

V-II-3

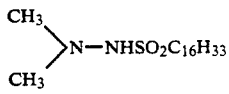

V-II-4

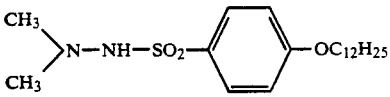

V-II-5

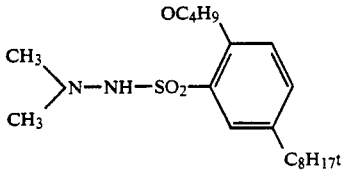

-continued

V-II-6

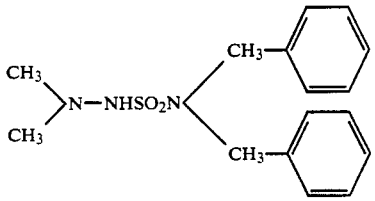

V-II-7

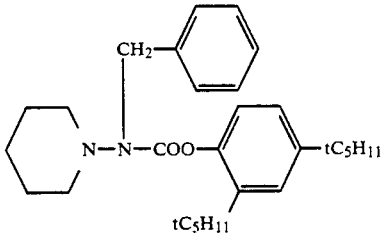

V-II-8

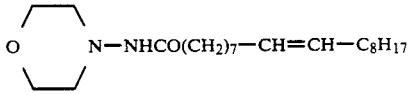

V-II-9

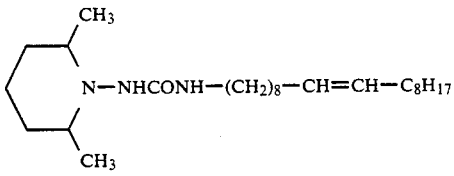

V-II-10

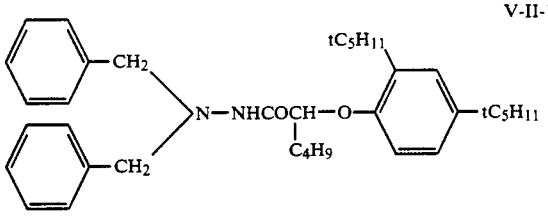

V-II-11

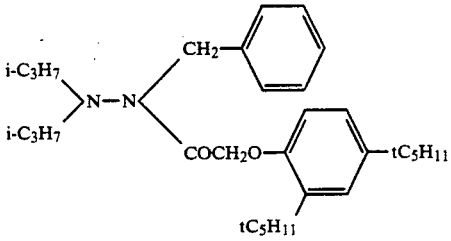

V-II-12

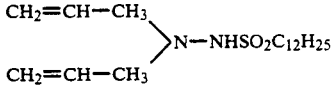

-continued
V-II-13
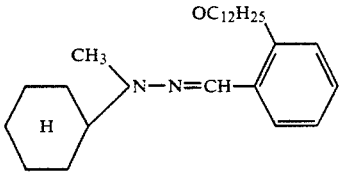
V-II-14
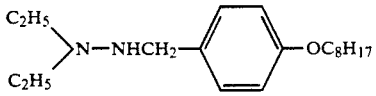
V-II-15
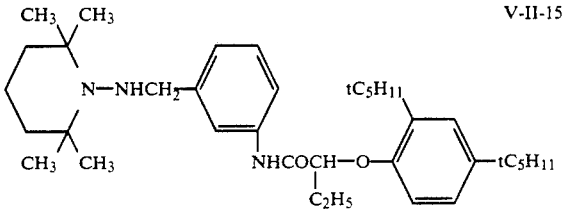
V-II-16
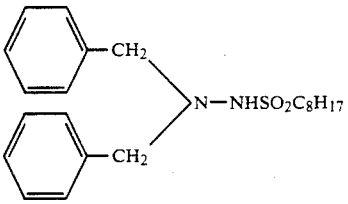
V-II-17
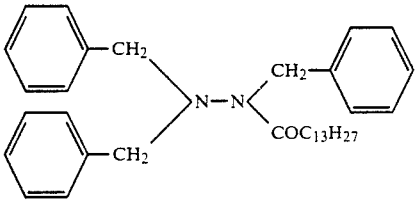
V-II-18
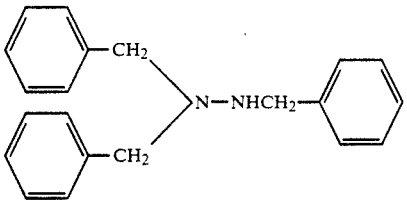
V-II-19
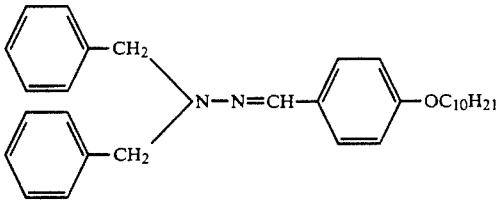
V-II-20
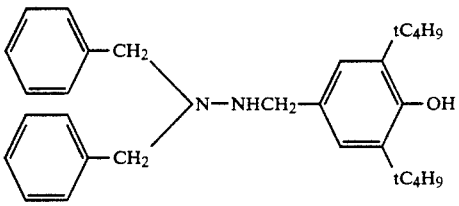
-continued
V-II-21
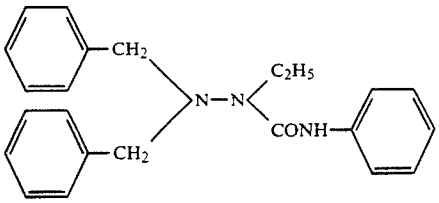
V-II-22
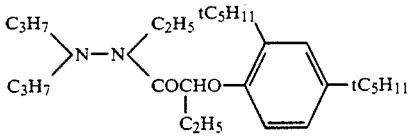
V-II-23
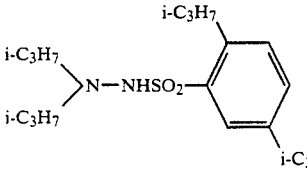
V-II-24
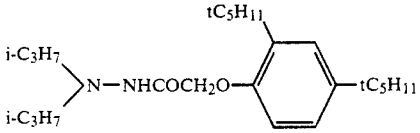
V-II-25
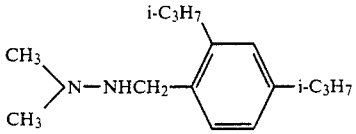
V-II-26
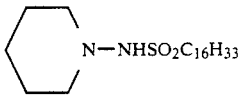
V-II-27
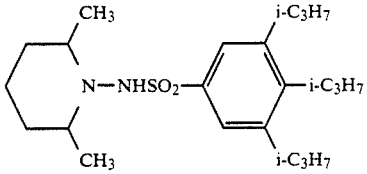
V-II-28
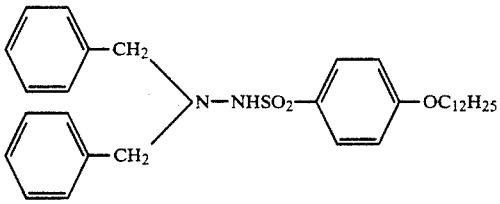
V-II-29
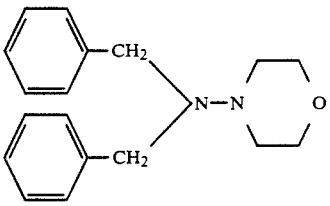

-continued

V-II-30

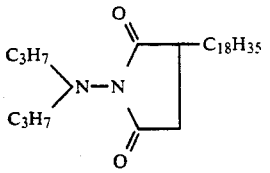

Formula V-III

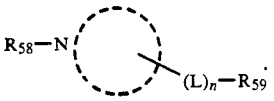

In Formula V-III, $R_{58}$ represents a hydrogen atom or a substituent. $R_{59}$ represents an alkyl, alkenyl, alkynyl, aryl or heterocyclic group. L is an interlinking group.

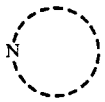

is a nitrogen-containing heterocycle. And n represents an integer of 0 or 1. $R_{58}$ may form a ring together with

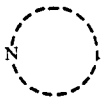

The alkyl, alkenyl, alkynyl, aryl and heterocyclic groups represented by $R_{58}$ are the same as those described in respect of $R_{15}$, $R_{16}$ and $R_{17}$ of Formula I.

The substituent represented b $R_{58}$ includes those mentioned as examples of the above $R_{59}$.

The heterocycle represented by

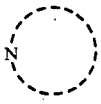

and the heterocycle formed by $R_{58}$ and

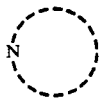

are heterocycles such as quinuclidine, piperidine and pyrazolidine. The interlinking group represented by L includes the same ones as those represented by Y of Formula II.

Typical examples of the compound represented by Formula V-III are illustrated below.

V-III-1

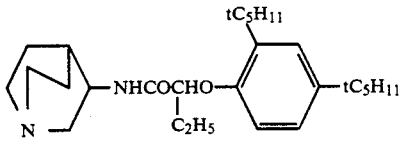

-continued

V-III-2

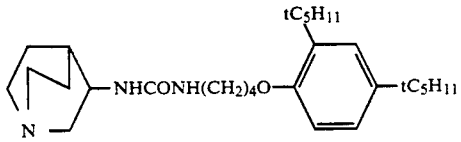

V-III-3

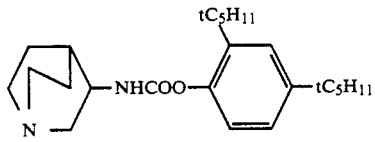

V-III-4

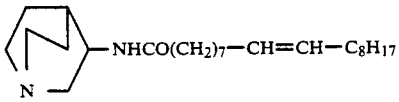

V-III-5

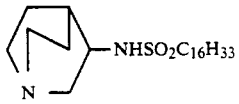

V-III-6

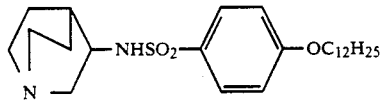

V-III-7

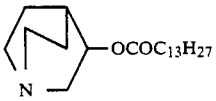

V-III-8

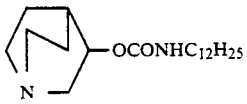

V-III-9

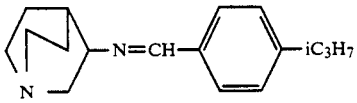

V-III-10

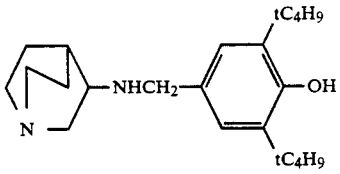

V-III-11

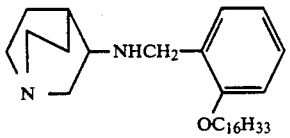

V-III-12

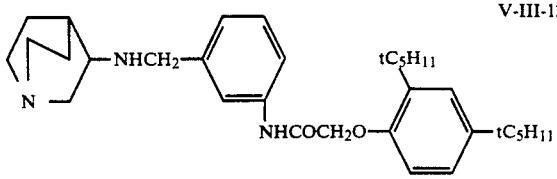

-continued
V-III-13
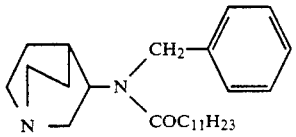
V-III-14
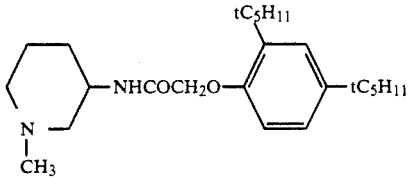
V-III-15
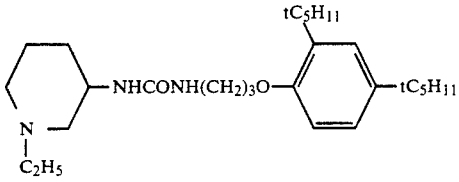
V-III-16
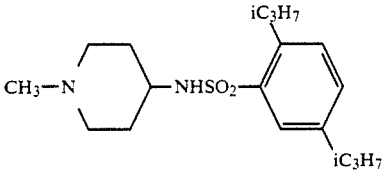
V-III-17
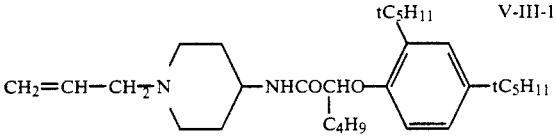
V-III-18
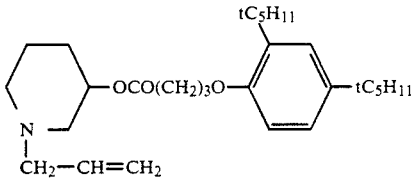
V-III-19
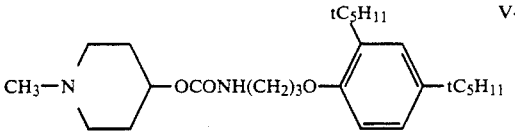
V-III-20
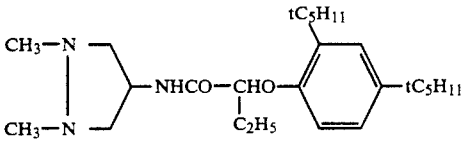
V-III-21
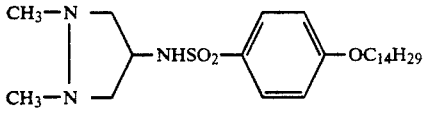
V-III-22
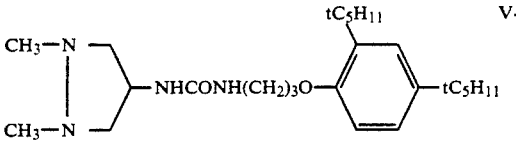
-continued
V-III-23
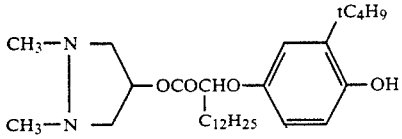
V-III-24
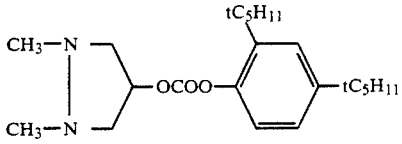
V-III-25
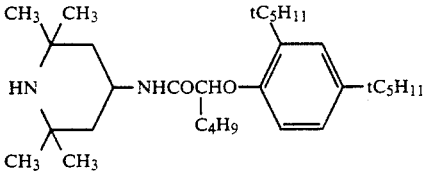
V-III-26
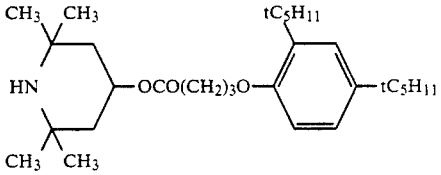
V-III-27
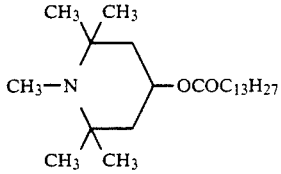
V-III-28
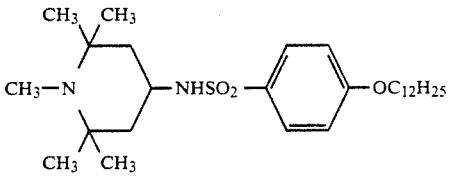
V-III-29
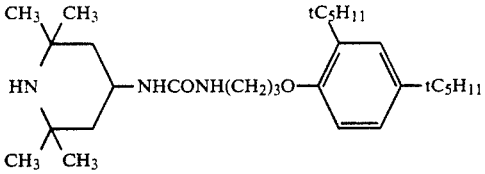
V-III-30
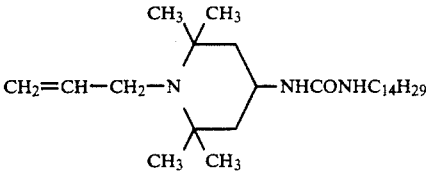
V-III-31
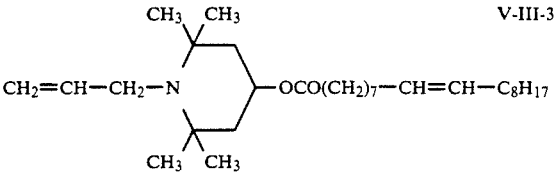

-continued

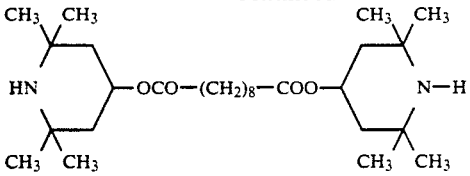

V-III-32

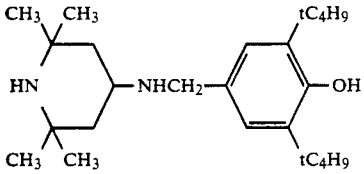

V-III-33

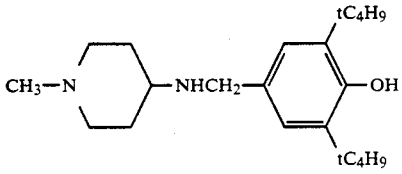

V-III-34

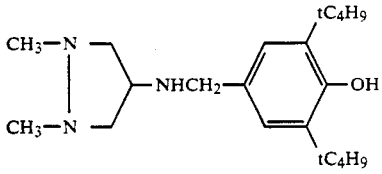

V-III-35

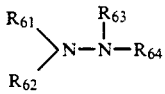

Formula VI-I

In Formula VI-I, $R_{61}$ and $R_{62}$ each represent an alkyl, alkenyl, alkynyl, aryl or heterocyclic group. $R_{63}$ represents a hydrogen atom or a substituent.

$R_{64}$ is a group containing at least one of the groups represented by

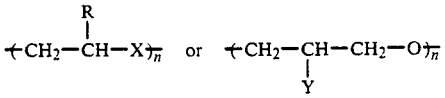

where, R is a hydrogen atom or an alkyl group, X is an O, S or NH group. Y is a hydrogen atom or OH group. n is an integer of 2 or more.

Two of $R_{61}$, $R_{62}$, $R_{63}$ and $R_{64}$ may be linked to form a ring. The alkyl, alkenyl, alkynyl, aryl and heterocyclic groups represented by $R_{61}$ or $R_{62}$ are the same as those described in respect of $R_{15}$, $R_{16}$ and $R_{17}$ of Formula I.

The substituent represented by $R_3$ includes, for example, alkyl, alkenyl, alkynyl, aryl, saturated or unsaturated heterocyclic, acyl, sulfonyl, oxycarbonyl and carbamoyl groups.

Among the substituents represented by $R_{63}$, the alkyl, alkenyl, alkynyl, aryl and heterocyclic groups are the same as those described in respect of $R_{15}$, $R_{16}$ and $R_{17}$ of Formula I. And the acyl group includes acetyl and bonzoyl groups, the sulfonyl group includes methanesulfonyl and toluenesulfonyl groups, the oxycarbonyl group includes ethoxycarbonyl and phenoxycarbonyl groups, carbamoyl group includes methylcarbamoyl and phenylcarbamoyl groups.

The ring formed by two of $R_{61}$, $R_{62}$, $R_{63}$ and $R_{64}$ includes piperidine and morpholinone.

The alkyl group represented by R includes methyl and ethyl groups; of the two, methyl group is preferred.

Typical examples of the compound represented by Formula VI-I are illustrated below.

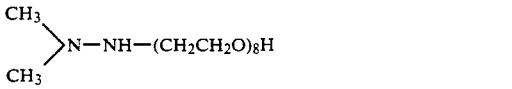

VI-I-1

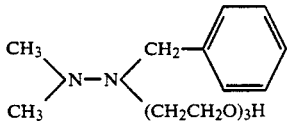

VI-I-2

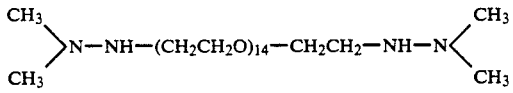

VI-I-3

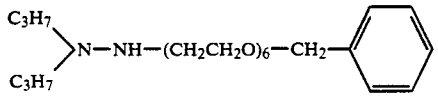

VI-I-4

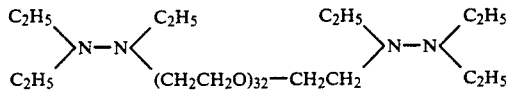

VI-I-5

-continued
VI-I-6
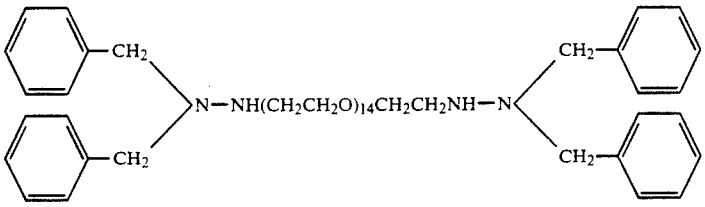
VI-I-7
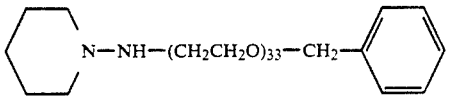
VI-I-8
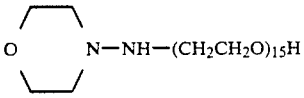
VI-I-9
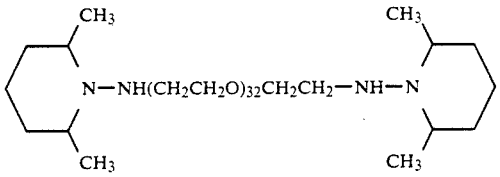
VI-I-10
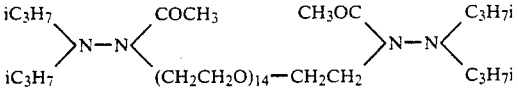
VI-I-11
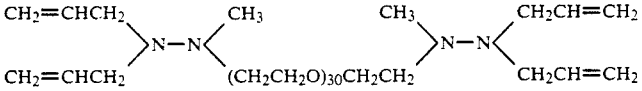
VI-I-12
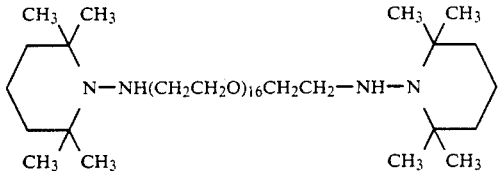
VI-I-13
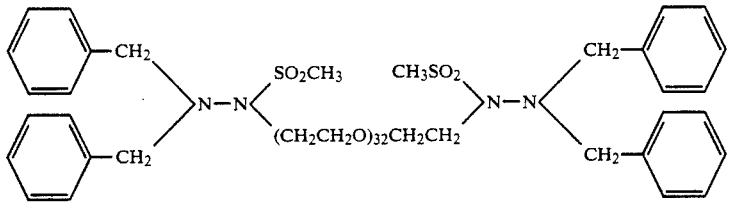
VI-I-14
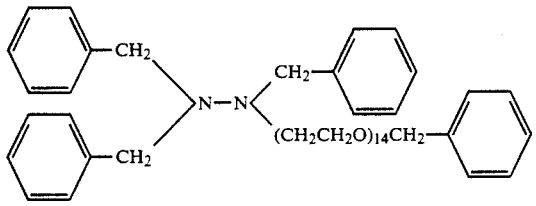

-continued
VI-I-15
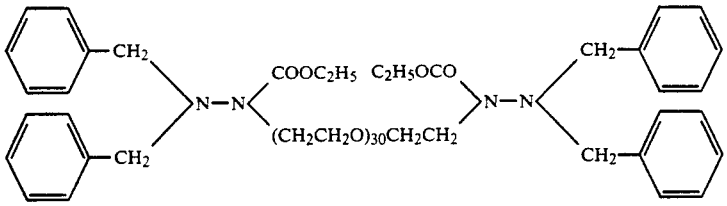
VI-I-16
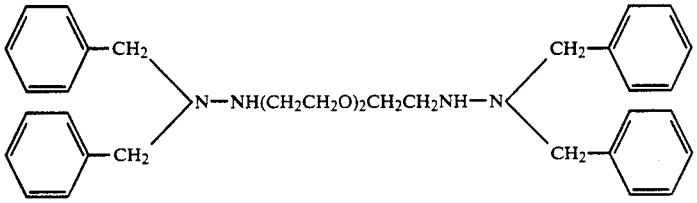
VI-I-17
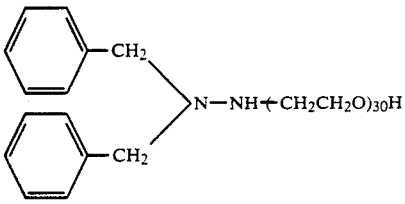
VI-I-18
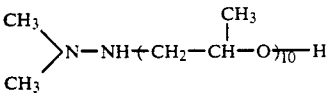
VI-I-19
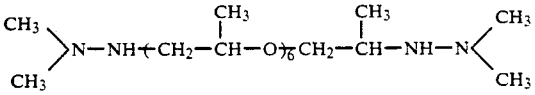
VI-I-20
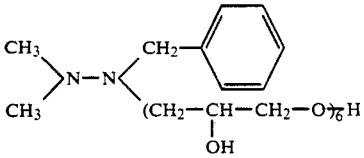
VI-I-21
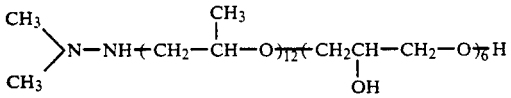
VI-I-22
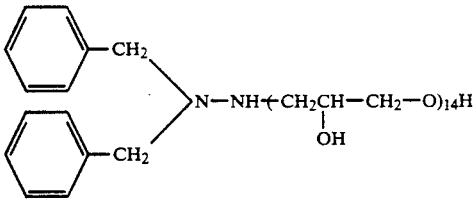
VI-I-23
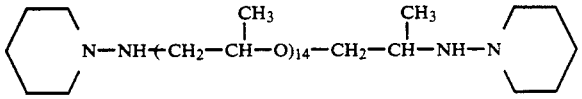
VI-I-24
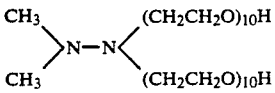

-continued
VI-I-25
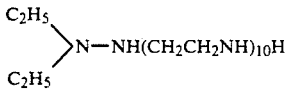
VI-I-26
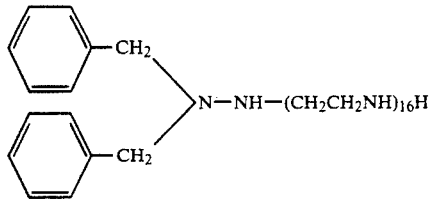
VI-I-27
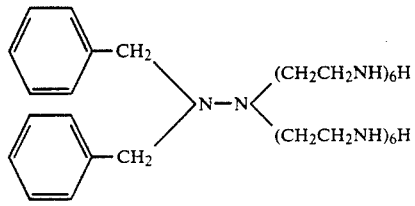
VI-I-28
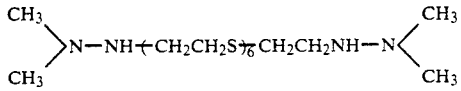
VI-I-29
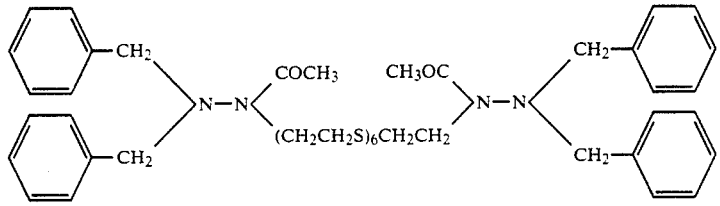
VI-I-30
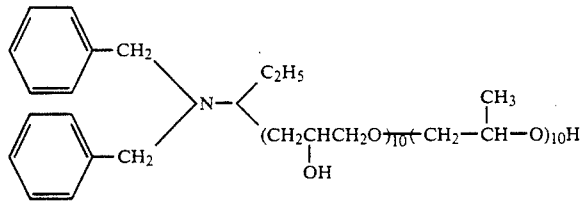
VI-I-31
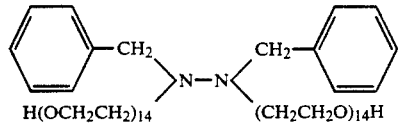
VI-I-32
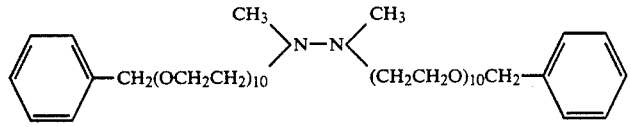
VI-I-33
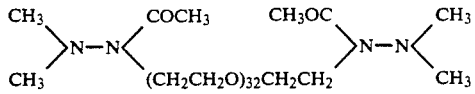

-continued
VI-I-34
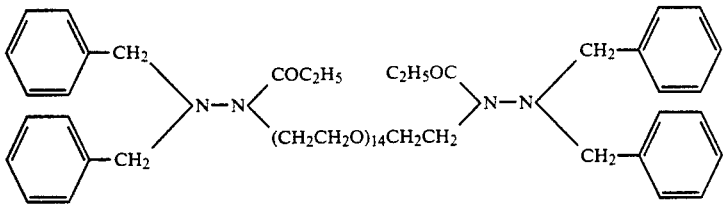
VI-I-35
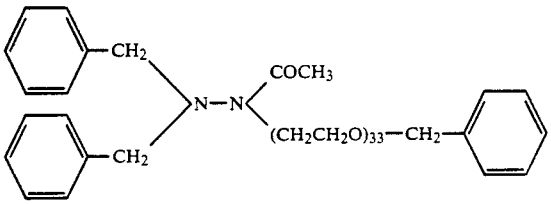
VI-I-36
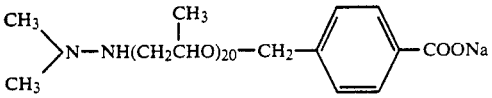
VI-I-37
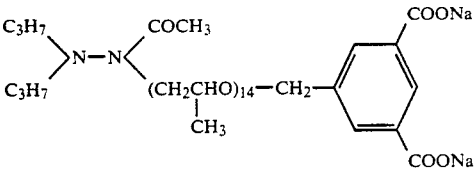
VI-I-38
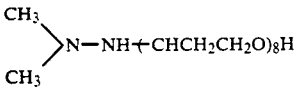
VI-I-39
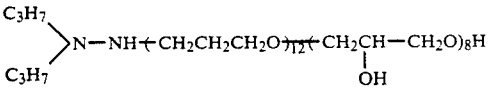
VI-I-40
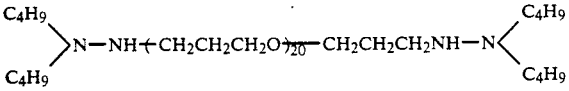
VI-I-41
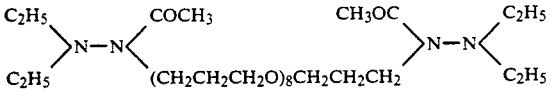
VI-I-42
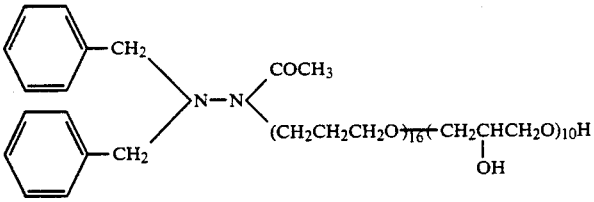
VI-I-43
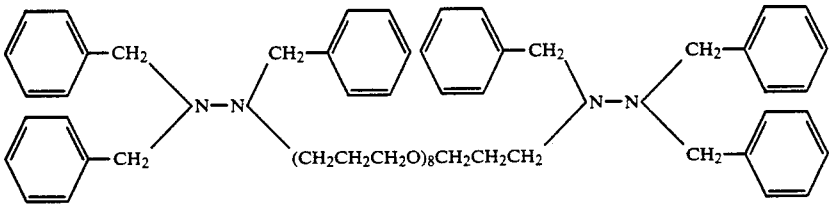

-continued

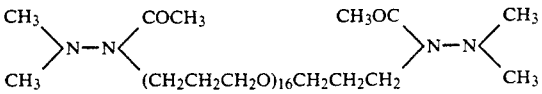

VI-I-44

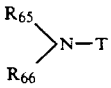

Formula VI-II

In Formula VI-II, $R_{65}$ and $R_{66}$ each represent a hydrogen atom, or an alkyl, alkenyl, alkynyl, aryl or saturated or unsaturated heterocyclic group. $R_{65}$ and $R_{66}$ may form a ring. T is a group containing at least one of the groups represented by

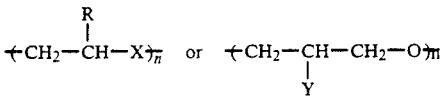

hydrogen atom or an alkyl group, X represents an O, S or NH group, Y represents a hydrogen atom or OH group, and n is an integer of 2 or more; provided that X is an S or NH group when R is a hydrogen atom. The alkyl, alkenyl, alkynyl, aryl and heterocyclic groups represented by $R_{65}$ or $R_{66}$ are the same as those described in respect of $R_{15}$, $R_{16}$ and $R_{17}$ of Formula I. The ring formed by $R_{15}$ and $R_{16}$ includes heterocycles such as piperidine, morpholine, quinuclidine and pyrazolidine. The alkyl group represented by R includes methyl and ethyl groups; of them, methyl group is preferred.

Typical examples of the compound represented by Formula VI-II are illustrated below.

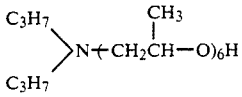

VI-II-1

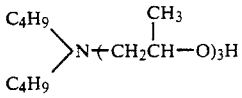

VI-II-2

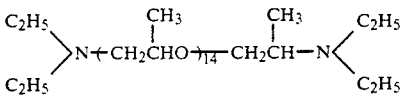

VI-II-3

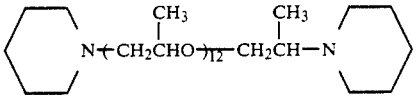

VI-II-4

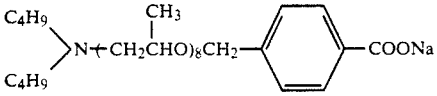

VI-II-5

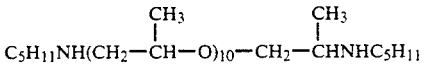

VI-II-6

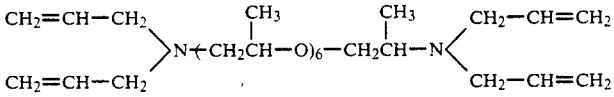

VI-II-7

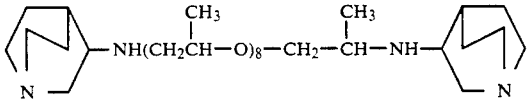

VI-II-8

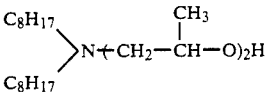

VI-II-9

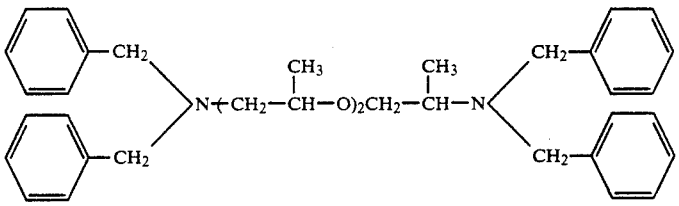

VI-II-10

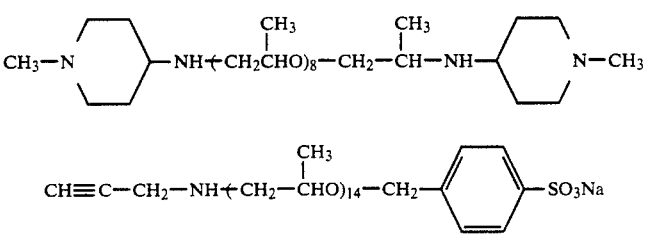

VI-II-11

VI-II-12

-continued
VI-II-13
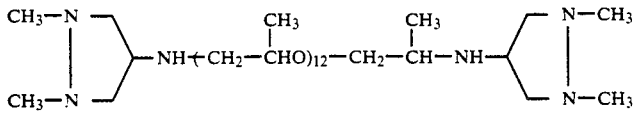
VI-II-14
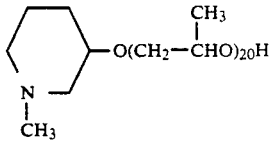
VI-II-15
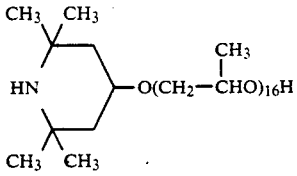
VI-II-16
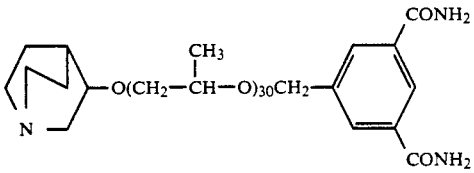
VI-II-17
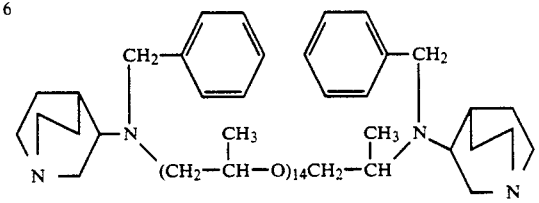
VI-II-18
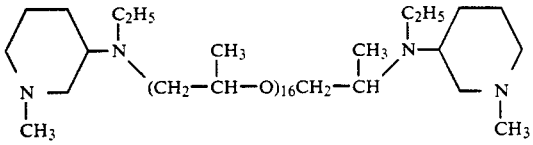
VI-II-19
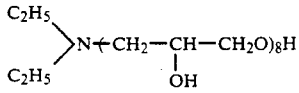
VI-II-20
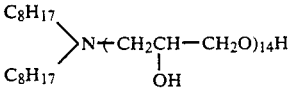
VI-II-21
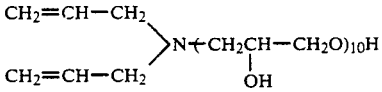
VI-II-22
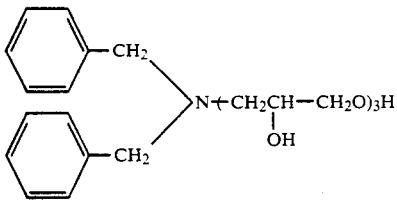
VI-II-23
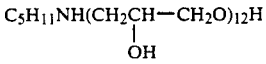
VI-II-24
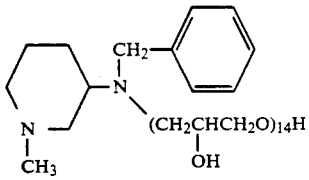
VI-II-25
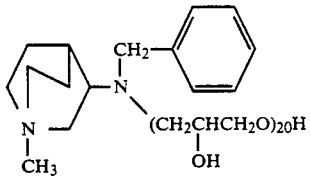
VI-II-26
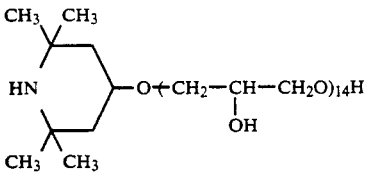
VI-II-27
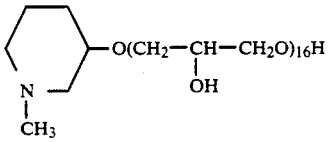
VI-II-28
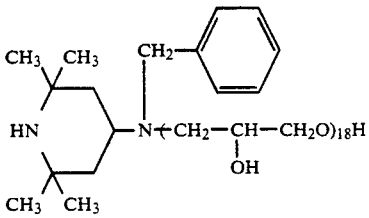
VI-II-29
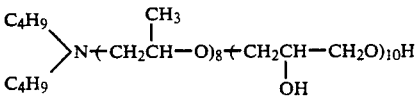

-continued
VI-II-30
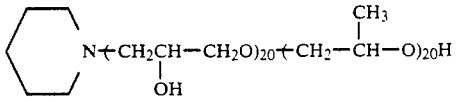
VI-II-31
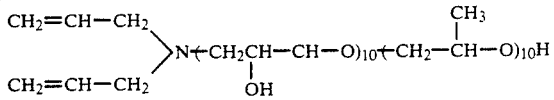
VI-II-32
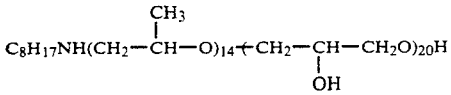
VI-II-33
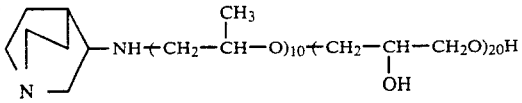
VI-II-34
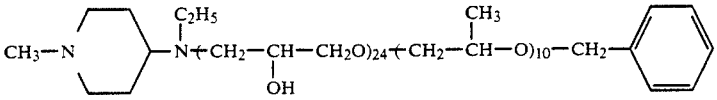
VI-II-35
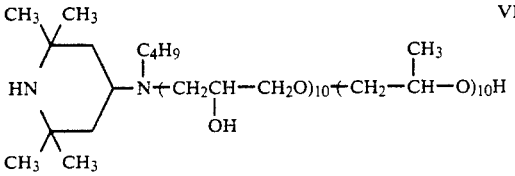
VI-II-36
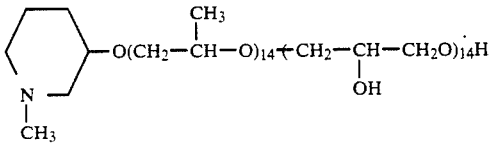
VI-II-37
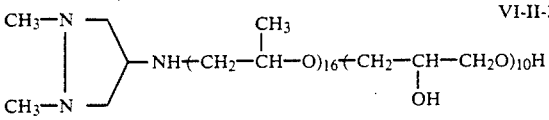
VI-II-38
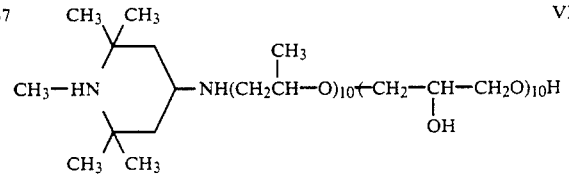
VI-II-39
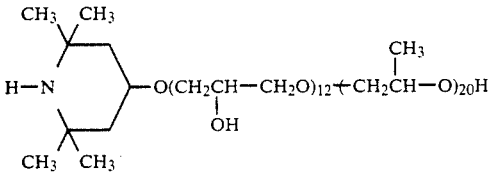
VI-II-40
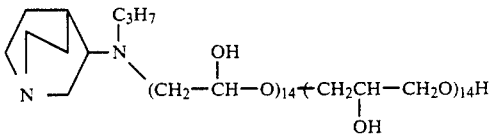
VI-II-41
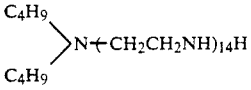
VI-II-42
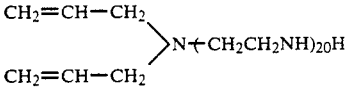
VI-II-43
$C_8H_{17}NH(CH_2CH_2NH)_{16}H$
VI-II-44
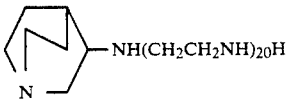
VI-II-45
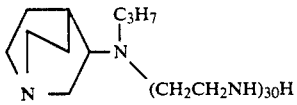
VI-II-46
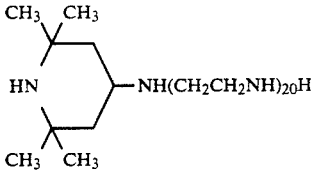
VI-II-47
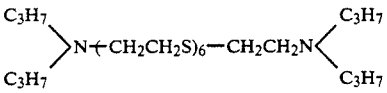
VI-II-48
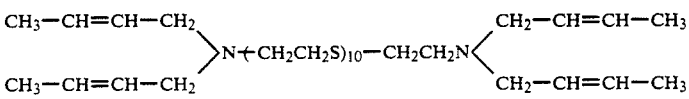
VI-II-49
$C_6H_{13}NH(CH_2CH_2S)_{12}—CH_2CH_2NHC_6H_{13}$
VI-II-50
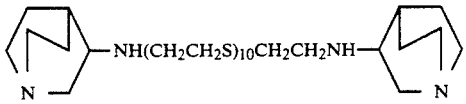

-continued
VI-II-51
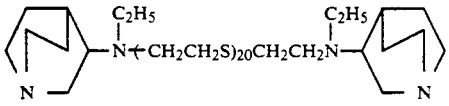
VI-II-52
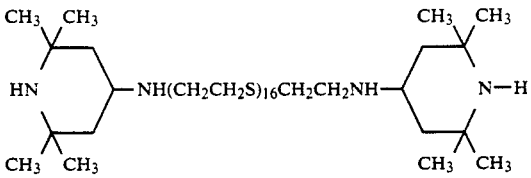
VI-II-53
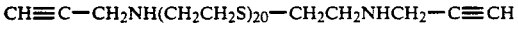
VI-II-54
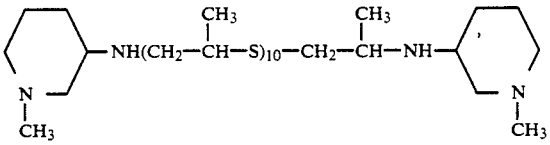
VI-II-55
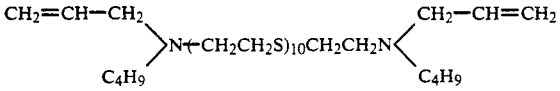
VI-II-56
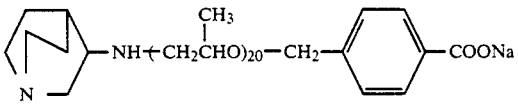
VI-II-57
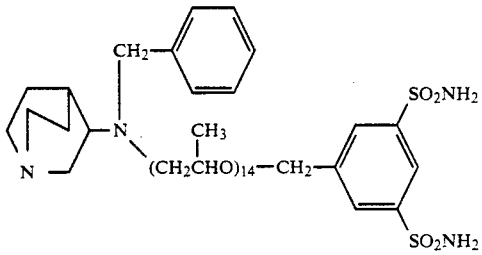
VI-II-58
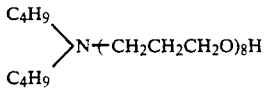
VI-II-59
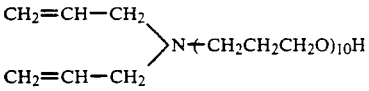
VI-II-60
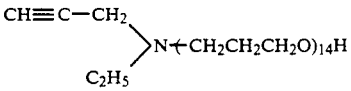
VI-II-61
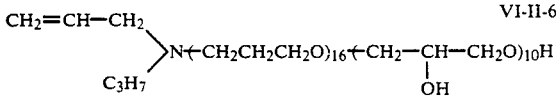
VI-II-62
$C_5H_{11}NH(CH_2CH_2CH_2O)_{12}H$
VI-II-63
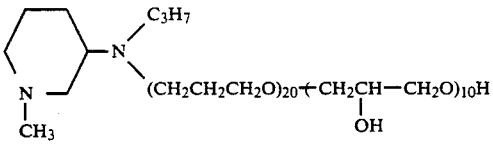
VI-II-64
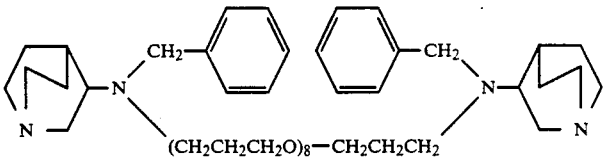
VI-II-65
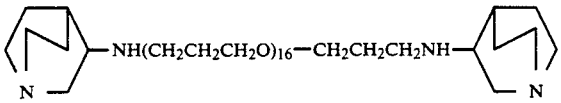

-continued

VI-II-66

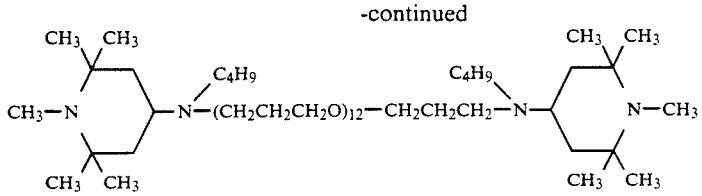

VI-II-67

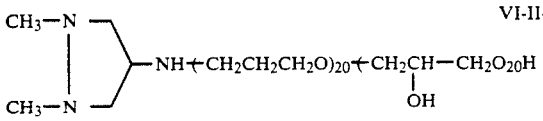

VI-II-68

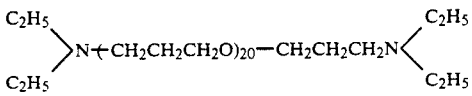

Formula VI-III

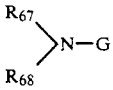

In Formula VI-III, $R_{67}$ and $R_{68}$ each represent a hydrogen atom, or an alkyl, alkenyl, alkynyl, aryl or saturated or unsaturated heterocyclic group; $R_{67}$ and $R_{68}$ may form a ring. A group represented by G contains at least one of the groups represented by $-(CH_2CH_2O_n)-$ and further contains at least two substituents having a hydrophobic substituent constant, $\pi$, of $-0.5$ to $-1.0$ or at least one substituent having a $\pi$ value of $-1.0$ or less. n is an integer of 2 or more. The alkyl, alkenyl, alkynyl, aryl and heterocyclic groups represented by $R_{67}$ or $R_{68}$ contain the same groups as those exemplified for $R_{15}$ and $R_{16}$ and $R_{17}$ of Formula I. The ring formed by $R_{65}$ and $R_{66}$ includes, for example, rings such as piperidine, quinuclidine and morpholine.

The hydrophobic substituent constant, $\pi$,is described on pages 79-103 of "The Structural Activity Correlation of Chemical Substances" (Konan-do 1979), edited by Kozo-kassei Soukan Konwakai (conversazione of Structural Activity Correlation).

Examples of the substituent having a $\pi$ value of $-0.5$ to $-1.0$ include, for example, —CN, —OH, —O-$SO_2CH_3$, —$OCOCH_3$,

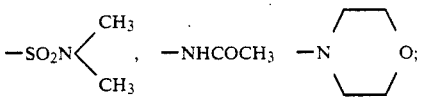

examples of the substituent having a $\pi$ value of $-1.0$ or less include, for example, —$CONH_2$, —CONHOH, —$CONHCH_3$ —$NH_2$, —$NHCONH_2$, —$NHCSNH_2$, —$NHSO_2CH_3$, —$N^{\oplus}(CH_3)_3$, —$O^{\ominus}$, —$OCONH_2$, —$SO_3^{\ominus}$, —$SO_2NH_2$, —$SOCH_3$, —$SO_2CH_3$, —$COO^{\ominus}$ groups.

Typical examples of the compound represented by Formula VI-III are illustrated below.

VI-III-1

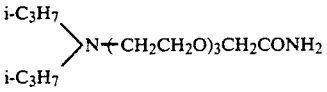

VI-III-2

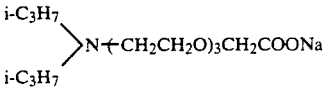

VI-III-3

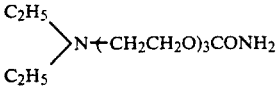

-continued

VI-III-4

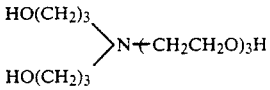

VI-III-5

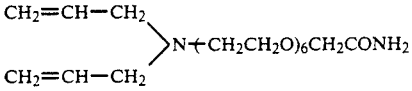

VI-III-6

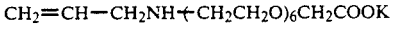

VI-III-7

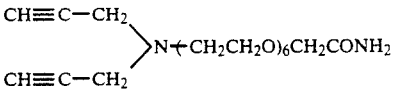

VI-III-8

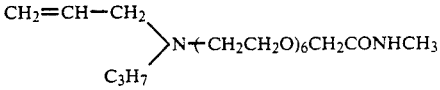

VI-III-9

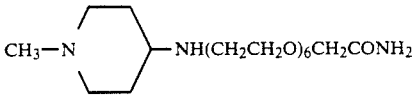

VI-III-10

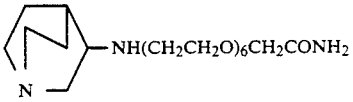

VI-III-11

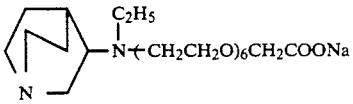

VI-III-12

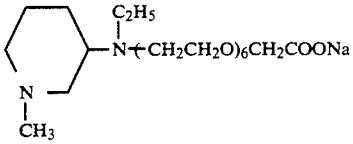

VI-III-13

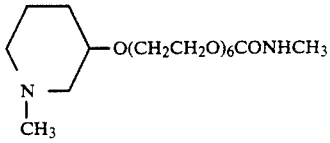

-continued
VI-III-14
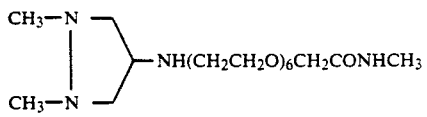
VI-III-15
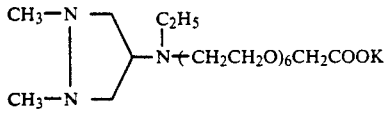
VI-III-16
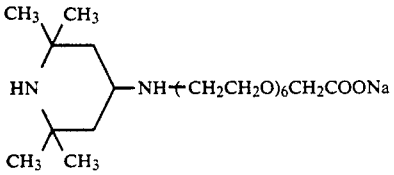
VI-III-17
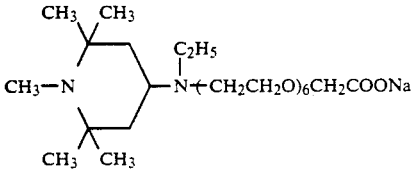
VI-III-18
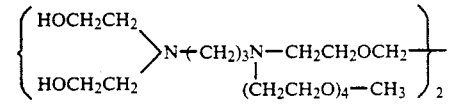
VI-III-19
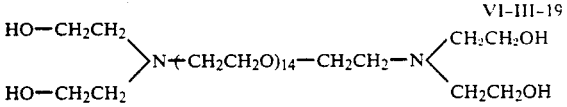
VI-III-20
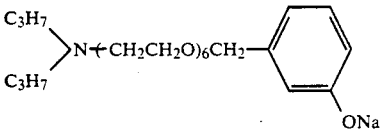
VI-III-21
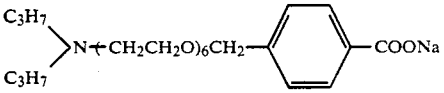
VI-III-22
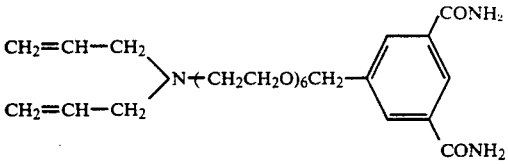
VI-III-23
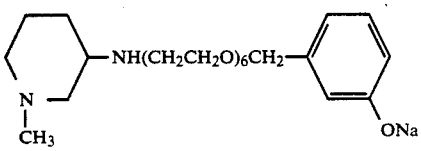
VI-III-24
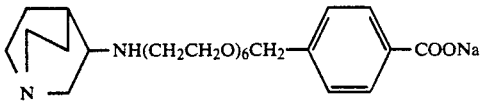
-continued
VI-III-25
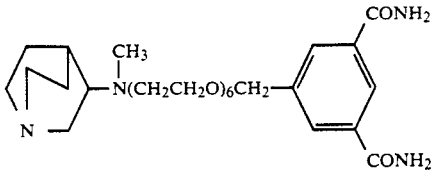
VI-III-26
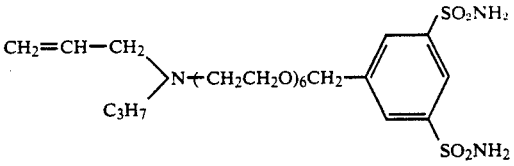
VI-III-27
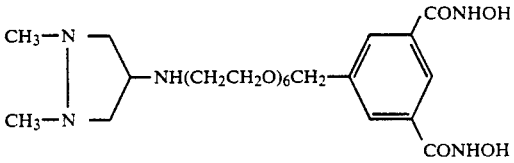
VI-III-28
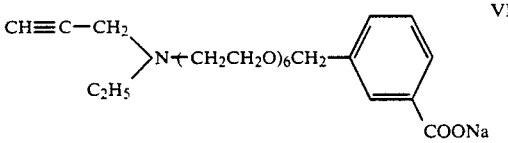
VI-III-29
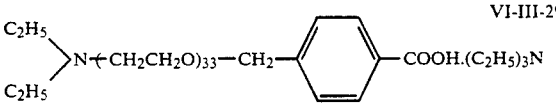
VI-III-30
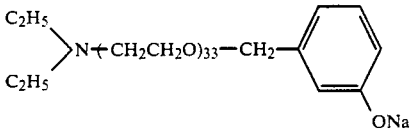
VI-III-31
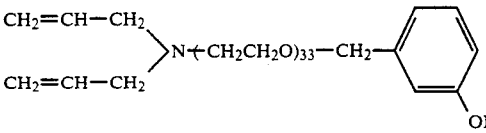
VI-III-32
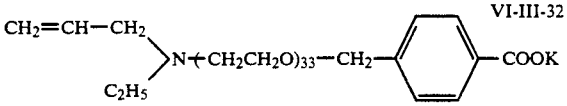
VI-III-33
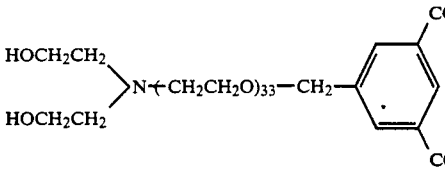
VI-III-34
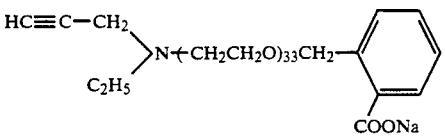

-continued

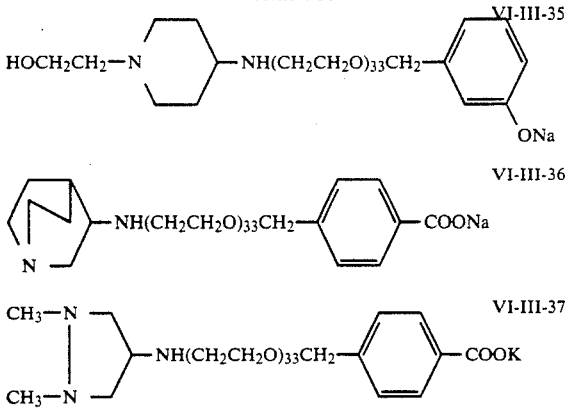

The addition amount of compounds represented by one of Formulas I through VI is preferably in a range from $5\times10^{-7}$ to $5\times10^{-1}$ mol, especially from $5\times10^{-6}$ to $1\times10^{-2}$ mol per mol of the silver halide contained in a photographic light-sensitive material.

The silver halide photographic light-sensitive material of the invention has at least, one silver, halide layer,; that is, the silver halide emulsion layer may be formed either on one side or on both sides of a support. And the silver halide emulsion layer may be formed in contact with a support, or may be formed on a support via another layer such as a hydrophilic colloid layer containing no silver halide emulsion. Further, there may be formed on a silver halide emulsion layer a hydrophilic colloid layer as a protective layer. The silver halide emulsion layer may be divided into layers different in sensitivities, for example, high-sensitivity and low-sensitivity silver halide emulsion layers. In this case, an intermediate layer may be provided between respective layers; that is, an intermediate layer consisting of hydrophilic colloid may be provided according to a specific requirement. In addition, there may be formed, between a silver halide emulsion layer and a protective layer, non-light-sensitive hydrophilic colloid layers such as intermediate layer, protective layer, antihalation layer and backing layer.

The compound represented by Formula H is contained in a silver halide emulsion layer in the silver halide photographic light-sensitive material of the invention, or in a hydrophilic colloid layer adjacent to said silver halide emulsion layer.

Next, silver halide used in the silver halide photographic light-sensitive material of the invention is described. Suitable silver halide compositions are silver chloroiodobromide and silver iodobromide each having a silver iodide content of less than 4 mol %, preferably less than 3 mol %. The average grain size. of these silver halides is preferably within a range from 0.05 to 0.5 μm, especially from 0.10 to 0.40 μm.

While the grain size distribution of the silver halide used in the invention may be arbitrarily selected, it is desirable that the degree of monodispersion defined by the distribution variation coefficient described below be within the range from 1 to 30. More desirably, the distribution variation coefficient is adjusted within the range from 5 to 20.

The term "distribution variation coefficient" used here is defined as the value obtained by centupling (%) a value given by dividing a standard deviation of grain size by an average grain size. For convenience, the size of silver halide grains is given by an edge length for a cubic grain and by a square root of a projected area for other shapes of grains of octahedron, tetradecahedron, etc.

In embodying the present invention, silver halide grains of 2 or more-layered, multilayered structure can be used. For example, there can be used silver iodobromide grains having a core comprising silver iodobromide and a shell comprising silver bromide. In this case, iodine can be contained in any layer in an amount of less than 5 mol %.

In a process to form and/or a process to grow silver halide grains used in the silver halide emulsion of the invention, there can be introduced a metallic element inside and/or on a surface of the grains by adding a metallic salt or complex salt thereof selected from cadmium salts, zinc salts, lead salts, thallium salts, iridium salts and complex salts thereof, rhodium salts and complex salts thereof, and iron salts and complex salts thereof. Or reduction-sensitized specks can be provided inside and/or on a surface of the grains by keeping the grains in an appropriate reducing environment.

Further, silver halide grains can be sensitized by various types of chemical sensitizers. As such sensitizers, there can be used singly or in combination active gelatin, sulfur sensitizers such as sodium thiosulfate, allyl thiocarbamide, thiourea and allyl thioisocyanate; selenium sensitizers such as N,N-dimethylselenourea and selenourea; reduction sensitizers such as triethylenetetramine and stannous chloride; and various precious metal sensitizers represented by potassium chloroaurite, pottasium aurithiocyanate, potassium chloroaurate, 2-aurosulfobenzothiazole methylchloride, ammonium chloropalladate, potassium chloroplatinate and sodium chloropalladite.

When a gold sensitizer is used, ammonium rhodanate may be employed as an auxiliary.

Silver halide grains used in the invention can be favorably utilized as silver halide grains which have a higher sensitivity at the surface than in the inner portion and provide the so-called negative image, so that photographic properties can be enhanced by treating the grains with the above chemical sensitizers.

Further, silver halide emulsions used in the invention can be stabilized and made immune from fogging by the addition of mercapto compounds such as 1-phenyl-5-mercaptotetrazole or 2-mercaptobenzothiazole; benzotriazoles such as 5-bromobenzotriazole or 5-methylbenzotriazole; benzimidazoles such as 6-nirobenzimidazole; or indazoles such as 5-nitroindazole.

The light-sensitive silver halide emulsion layer or its adjacent layer may contain compounds described in Research Disclosure No. 17463, Section XXI, Item B to D, for raising sensitivity, enhancing contrast and accelerating development.

The silver halide emulsion layer used in the invention may contain sensitizing dyes, plasticizers, antistatic agents, surfactants and hardeners.

In adding the compound according to the invention to a hydrophilic colloid layer, gelatin is preferably used as the binder of said hydrophilic colloid layer, but hydrophilic colloids other than gelatin can also be employed. These hydrophilic binders are preferably coated on both sides of a support in amounts of not more than 10 g/m$^2$ respectively.

Suitable supports to embody the invention are, for example, baryta paper, polyethylene-coated paper, polypropylene synthetic paper, glass plates, and films of cellulose acetate, cellulose nitrate and polyester such as polyethylene terephthalate. These supports are appropriately selected according to uses of silver halide photographic light-sensitive materials.

In developing the silver halide light-sensitive material of the invention, the following developing agents, for example, are used.

HO—(CH=CH)n—OH type developing agents represented by hydroquinone, other examples of this type are catechol and pyrogallol.

HO—(CH=CH)n—$NH_2$ type developing agents represented by ortho- and para-aminophenols and aminopyrazolone, other examples are N-methyl-p-aminophenol, N-β-hydroxyethyl-p-aminophenol, p-hydroxyphenylaminoacetic acid and 2-aminonaphthol.

Heterocyclic developing agents including 3-pyrazolidones such as 1-phenyl-3-pyrazolidone, 1-phenyl-4,4-dimethyl-3-pyrazolidone, and 1-phenyl-4-methyl-4-hydroxymethyl-3-pyrazolidone.

In addition to the above, there can be favorably used in the invention developing agents described on pages 291-334 of The Theory of the Photographic Process, 4th Edition, T. H. James and on page 3,100 in Volume 73 of Journal of the American Chemical Society (1951).

These developing agents may be used singly or in combination, but are preferably used in combination of two or more kinds.

A developer used for the light-sensitive material of the invention can employ preservatives including sulfites such as sodium sulfite and potassium sulfite, without impairing the effect of the invention. As the preservative, hydroxylamine and hydrazine compounds may also be used. Further, caustic alkali, carbonate alkali or amines, which are commonly used in black-and-white developers, may also be added to the developer for pH adjustment and enhancement of buffer capacity. The developer suitably used for developing a light-sensitive material prepared by the method of the invention is characterized by its capability of being used at a pH less than 11. And it is preferably used within a pH range from 10.0 to 10.8. Further, there may be arbitrarily added to the developer inorganic developing inhibitors such as potassium bromide; organic developing inhibitors such as 5-methylbenzotriazole, 5-methylbenzimidazole, 5-nitroindazole, adenine, guanine and 1-phenyl-5-mercaptotetrazole; metallic ion chelating agents such as ethylenediaminetetracetic acid; developing accelerators such as methanol, ethanol, benzyl alcohol and polyalkylene oxide; surfactants such as sodium alkylarylsulfonate, natural saponins and sugers, and alkyl estes of the above compounds; hardeners such as glutaraldehyde, formalin and glyoxal; and ion strength controllers such as sodium sulfate.

The developer may further contain organic solvents such as alkanol amines including diethanolamine and triethanolamine as well as glycols including diethylene glycol and triethylene glycol.

EXAMPLE 1

Preparation of Silver Halide Photographic Emulsion A

A silver iodobromide emulsion containing 2 mol % silver iodide per mol of silver was prepared by the double-jet mixing method. During the mixing, $K_2IrCl_6$ was added in amount of $8\times10^{-7}$ mol per mol of silver. The emulsion prepared was an emulsion comprising cubic monodispersed grains having an average grain size of 0.20 μm and a distribution variation coefficient of 9%. A gelatin modified with phenylcarbamide (illustrated compound G-8 in Japanese Pat. O.P.I. Publication No. 45946/1991) was added to this emulsion, and washing and desalting were performed in a similar manner as in Example 1 of Japanese Pat. O.P.I. Publication No. 45946/1991. Subsequently, a potassium iodide aqueous solution was added in amount of 0.1 mol % per silver, for the conversion of grain surface. The pAg after desalting was 8.0 at 40° C.

Preparation of Silver Halide Photographic Light-Sensitive Material

A polyethylene terephthalate base film having a thickness of 100 μm was prepared. The film was provided on both side with subbing layers according to Example 1 of Japanese Pat. O.P.I. Publication No. 12145/1990. On a side of the film a backing layer of the following recipe (3) was coated to give a gelatin amount of 2.4 g/m² and a protective layer of the backing layer of the following recipe (4). Then the coated layers were dried simultaneously. On another side of the film a silver halide emulsion layer of the following recipe (1) was coated, in which coating amounts of gelatin and silver of the emulsion layer were 2.0 g/μm² and 3.2 g/μm², respectively. Further a protective layer of emulsion layer of the following recipe (2) was coated on the emulsion layer so that a coating amount of gelatin was 1.0 g/m². The coated layer were dried simultaneously under conditions the same as those applied for drying the backside layers for each samples. The dried light-sensitive materials were cut into a prescribed size in the environment of 23° C., 35% RH (dew point: 6° C.) and packed airtightly in wrapping paper absolutely free from air permeation, so that sample Nos. 1 through 18 were obtained.

Recipe (1) (silver halide emulsion layer composition)

| | |
|---|---|
| Gelatin | 2.0 g/m² |
| Silver halide emulsion A (as silver amount) | 3.2 g/m² |
| Sensitizing dye | 8 mg/m² |

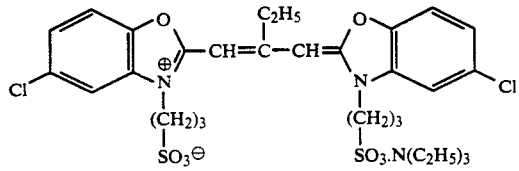

Sensitizing dye

-continued

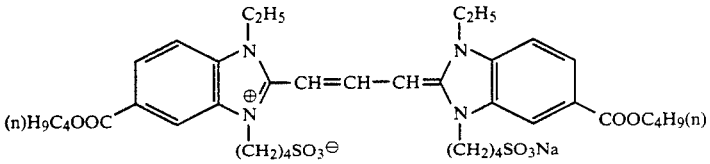

0.2 mg/m²

Stabilizer (4-methyl-6-hydroxy-1,3,3a,7-tetrazaindene) 30 mg/m²
Antifoggant (adenine) 10 mg/m²
Antifoggant (1-phenyl-5-mercaptotetrazole) 5 mg/m²
Surfactant (saponin) 0.1 g/m²
Surfactant (S-1) 8 mg/m²

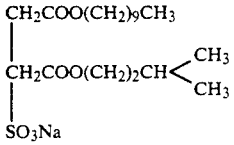

Hydrazine derivative of the invention in amount shown in Table 2
Latex polymer (m:n = 50:50)

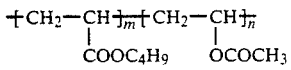

1 g/m²

Polyethylene glycol (Mw: 4000) 0.1 g/m²
Hardener (H-1) 60 mg/m²

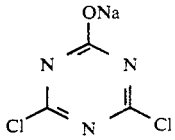

Recipe (2) (emulsion protecting layer composition)

Gelatin 0.9 g/m²
Surfactant (S-2) 10 mg/m²

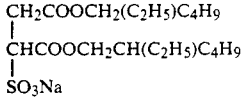

Surfactant (S-3) 10 mg/m²

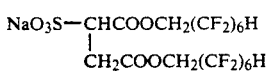

Matting agent (monodispersed silica having an average particle size of 3.5 μm) 3 mg/m²
Hardener (1,3-vinylsulfonyl-2-propanol) 40 mg/m²

Recipe (3) (backing layer composition)

Antihalation dye (a) 30 mg/m²

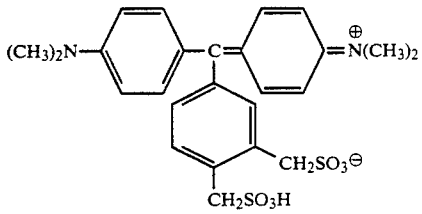

Antihalation dye (b) 75 mg/m²

-continued

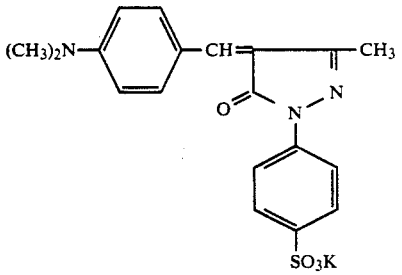

Antihalation dye (c) 30 mg/m²

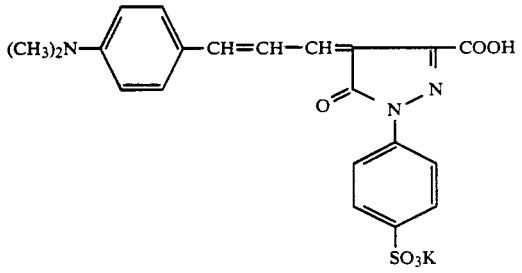

| | |
|---|---|
| Gelatin | 2.4 g/m² |
| Surfactant (saponin) | 0.1 g/m² |
| Surfactant (S-1) | 6 mg/m² |
| Colloidal silica | 100 mg/m² |

Recipe (4) (backing protecting layer composition)

| | |
|---|---|
| Gelatin | 1 g/m² |
| Matting agent (monodispersed polymethyl-methacrylate, average particle size: 5.0 μm) | 50 mg/m² |
| Surfactant (S-2) | 10 mg/m² |
| Hardener (glyoxal) | 25 mg/m² |
| Hardener (H-1) | 35 mg/m² |

TABLE 1

| Coating and drying condition | Drying condition while water content is more than 300% (relative humidity) | Drying condition while water content is less than 300% (relative humidity) | Remarks |
|---|---|---|---|
| a | 40% | 60% | Comparison |
| b | 40% | 40% | Invention |
| c | 60% | 60% | Comparison |
| d | 60% | 50% | Invention |
| e | 60% | 40% | Invention |
| f | 60% | 30% | Invention |

Each sample was closely contacted with an optical step wedge, exposed for 5 seconds using a 3200K tungsten ray and then processed, under the following conditions, in an automatic rapid-processor filled with developer 1 and fixer of the following recipes. Separately, each sample was kept in the environment of 23° C. and 50% RH for 24 hours, then packed airtightly and subsequently subjected to a thermal treatment by being kept at 55° C. for 3 days in substitution for aging. The thermally treated sample was exposed, developed and fixed likewise.

| Developer 1 | |
|---|---|
| Sodium ethylenediaminetetraacetate | 1 g |
| Sodium sulfite | 60 g |

-continued

| Developer 1 | |
|---|---|
| Trisodium phosphate (dodecahydrate) | 75 g |
| Hydroquinone | 22.5 g |
| Sodium hydroxide | 8 g |
| Sodium bromide | 3 g |
| 5-methyl-benzotriazole | 0.25 g |
| 2-mercaptobenzothiazole | 0.1 g |
| 2-mercaptobenzothiazole-5-sulfonic acid | 0.2 g |
| N-methyl-p-aminophenol ½ sulfate | 0.25 g |
| n-butyl-ethanolamine | 15.0 g |
| Phenetylpicolinium bromide | 2.5 g |

Water was added to make 1 liter, and the pH was adjusted to 10.4 with sodium hydroxide.

| Fixer | |
|---|---|
| (Composition A) | |
| Ammonium thiosulfate (72.5% W/V aqueous solution) | 240 ml |
| Sodium sulfite | 17 g |
| Sodium acetate (trihydrate) | 6.5 g |
| Boric acid | 6.0 g |
| Sodium citrate (dihydrate) | 2.0 g |
| (Composition B) | |
| Deionized water | 17 ml |
| Sulfuric acid (50% W/V aqueous solution) | 4.7 g |
| Aluminium sulfate (8.1% W/V aqueous solution as $Al_2O_3$) | 26.5 g |

At the use of the fixer, the above compositions A and B were dissolved in this order in 500 ml of water, then the total volume was made to 1 liter and the pH was adjusted to 4.8 with acetic acid.

| Processing conditions | | |
|---|---|---|
| (Process) | (Temperature) | (Time) |
| Developing | 38° C. | 15 sec |
| Fixing | 35° C. | 15 sec |
| Washing | 30° C. | 10 sec |
| Drying | 50° C. | 10 sec |

The density of each processed sample was measured with Konica digital densitometer Model PDA-65. The sensitivity was reported by a sensitivity relative to that of sample No. 1 which was set at 100. The sensitivity was determined in accordance with the reciprocal of exposure amount necessary for forming image density of 2.5 in the processed sample. And $\gamma$ was expressed by a tangent of a line connecting the points of densities 0.1 and 2.5 on the characteristic curve. A $\gamma$ value less than 6 is of no use; a $\gamma$ value between 6 and 10 is st111 insufficient in contrasty property. A $\gamma$ value not less than 10 gives ultracontrasty images hard enough to use practically.

In addition, the unexposed portion was checked for pepper spots with a 40-power loupe. No pepper spot formation was rated 5, the highest rank, and the ranking was lowered in the order of 4, 3, 2 and 1 according to the degree of pepper spot formed. Ranks 1 and 2 are undesirable for practical use.

The results are shown in Table 2.

TABLE 2

| Sample No. | Drying condition | Hydrazine derivative No. | Hydrazine derivative Addition amount (mol/mol Ag) | Properties: Without thermal treatment Relative sensitivity | Without thermal treatment Gamma | Without thermal treatment Pepper spots | After thermal treatment Relative sensitivity | After thermal treatment Gamma | After thermal treatment Pepper spots | Remarks |
|---|---|---|---|---|---|---|---|---|---|---|
| 1 | a | — | — | 100 | 5.0 | 4 | 115 | 3.5 | 1 | Comparison |
| 2 | a | 132 | $2 \times 10^{-3}$ | 180 | 17.0 | 3 | 200 | 7 | 1 | Comparison |
| 3 | a | 184 | $2 \times 10^{-3}$ | 130 | 10.0 | 3 | 170 | 5 | 1 | Comparison |
| 4 | b | — | — | 100 | 5.0 | 4.5 | 105 | 4.5 | 3 | Comparison |
| 5 | b | 61 | $2 \times 10^{-3}$ | 160 | 16.0 | 4.5 | 160 | 160 | 4.5 | Invention |
| 6 | b | 62 | $2 \times 10^{-3}$ | 170 | 16.0 | 4.5 | 170 | 16.0 | 4.5 | Invention |
| 7 | c | 64 | $2 \times 10^{-3}$ | 160 | 15 | 3 | 175 | 7 | 1 | Comparison |
| 8 | c | 68 | $2 \times 10^{-3}$ | 160 | 15 | 3 | 175 | 7 | 1 | Comparison |
| 9 | c | 120 | $2 \times 10^{-3}$ | 170 | 15 | 3 | 190 | 7 | 1 | Comparison |
| 10 | d | 132 | $2 \times 10^{-3}$ | 180 | 17.0 | 4 | 180 | 17.0 | 4 | Invention |
| 11 | d | 184 | $2 \times 10^{-3}$ | 125 | 9.5 | 3.5 | 125 | 9.5 | 3.5 | Invention |
| 12 | d | 178 | $2 \times 10^{-3}$ | 125 | 10.5 | 3 | 125 | 10.5 | 3 | Invention |
| 13 | e | 120 | $2 \times 10^{-3}$ | 170 | 16 | 4.5 | 170 | 16 | 4.5 | Invention |
| 14 | e | 64 | $2 \times 10^{-3}$ | 170 | 16 | 4.5 | 170 | 16 | 4.5 | Invention |
| 15 | e | 68 | $2 \times 10^{-3}$ | 170 | 17 | 4.5 | 170 | 17 | 4.5 | Invention |
| 16 | f | 132 | $2 \times 10^{-3}$ | 180 | 17 | 5 | 180 | 17 | 5 | Invention |
| 17 | f | 184 | $2 \times 10^{-3}$ | 125 | 9.5 | 3.5 | 125 | 9.5 | 3.5 | Invention |
| 18 | f | 178 | $2 \times 10^{-3}$ | 125 | 11 | 3.5 | 125 | 11 | 3.5 | Invention |

As apparent from Table 2, sample Nos. 5 to 6 and 10 to 18 according to the invention are prevented from fluctuating in sensitivity, lowering in contrast and increasing in pepper spots, each of which is caused by aging.

EXAMPLE 2

The same procedure as in Example 1 was repeated, except that the following compound (a) was added in an amount of 80 mg/m$^2$ to the silver halide emulsion layer of Example 1 and the developer was replaced by the following developer. The results obtained were much the same as those in Example 1.

Compound (a)

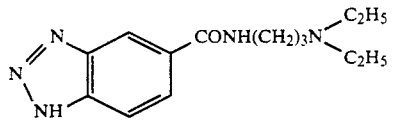

| Developer 2 | |
|---|---|
| Sodium ethylenediaminetetraacetate | 1 g |
| Sodium sulfite | 60 g |
| Boric acid | 40 g |
| Hydroquinone | 35 g |
| Sodium hydroxide | 8 g |
| Sodium bromide | 3 g |
| 5-methyl-benzotriazole | 0.2 g |
| 2-mercaptobenzothiazole | 0.1 g |
| 2-mercaptobenzothiazole-5-sulfonic acid | 0.2 g |
| 1-phenyl-4,4-dimethyl-3-pyrazolidone | 0.2 g |

Water was added to make 1 liter, and then the pH was adjusted to 10.5 with sodium hydroxide.

EXAMPLE 3

Samples 21 to 38 were prepared in the same manner as in Example 1 except that drying condition and hydrazine compound were changed, and compounds represented by I to VI were further added as shown in Table 3. The samples were processed by the following Developer 3 or 4. The other processing conditions were the same as in Example 1. The results obtained are given in Table 3.

| Developer 3 | |
|---|---|
| Sodium ethylenediaminetetraacetate | 1 g |
| Sodium sulfite | 60 g |
| Sodium phosphate.12$H_2O$ | 75 g |
| Boric acid | — |
| Hydroquinone | 22.5 g |
| Sodium hydroxide | 8 g |
| Sodium bromide | 3 g |
| 5-methyl-benzotriazole | 0.08 g |
| 1-phenyl-5-mercaptotetrazole | — |
| 1-phenyl-4,4-dimethyl-3-pyrazoline | 0.25 g |
| Phenetylpicolinium bromide | — |
| **Developer 4** | |
| Sodium ethylenediaminetetraacetate | 1 g |
| Sodium sulfite | 60 g |

-continued

| | |
|---|---|
| Sodium phosphate.12$H_2O$ | — |
| Boric acid | 40 g |
| Hydroquinone | 35 g |
| Sodium hydroxide | 8 g |
| Sodium bromide | 3 g |
| 5-methyl-benzotriazole | 0.08 g |
| 1-phenyl-5-mercaptotetrazole | 0.2 g |
| 1-phenyl-4,4-dimethyl-3-pyrazoline | — |
| Phenetylpicolinium bromide | 2.5 g |

Water was added to make 1 liter and then the pH was adjusted to 10.4 in Developer 3, and 10.3 in Developer 4 with sodium hydroxide.

TABLE 3

| Sample No. | Developer No. | Compound of Formula I-VI No. | Compound of Formula I-VI Addition amount (mol/mol Ag) | Drying condition | Hydrazine derivative No. | Hydrazine derivative Addition amount (mol/mol Ag) | Properties: Without thermal treatment: Relative sensitivity | Without thermal treatment: Gamma | Without thermal treatment: Pepper Spots | After thermal treatment: Relative sensitivity | After thermal treatment: Gamma | After thermal treatment: Pepper Spots | Remarks |
|---|---|---|---|---|---|---|---|---|---|---|---|---|---|
| 21 | 3 | — | — | c | (61) | $2 \times 10^{-3}$ | 100 | 5.0 | 4 | 115 | 3 | 1 | Comparison |
| 22 | 3 | III-11 | $1.5 \times 10^{-3}$ | c | (61) | $2 \times 10^{-3}$ | 160 | 14 | 3 | 175 | 7 | 1 | Comparison |
| 23 | 3 | III-11 | $1.5 \times 10^{-3}$ | f | (61) | $2 \times 10^{-3}$ | 170 | 14.5 | 4 | 170 | 14.5 | 4 | Invention |
| 24 | 4 | I-15 | $1.5 \times 10^{-3}$ | f | (61) | $2 \times 10^{-3}$ | 160 | 14.5 | 4 | 160 | 14.5 | 4 | Invention |
| 25 | 3 | II-14 | $1.5 \times 10^{-3}$ | f | (61) | $2 \times 10^{-3}$ | 170 | 14.5 | 4 | 170 | 14.5 | 4 | Invention |
| 26 | 3 | V-I-1 | $1.5 \times 10^{-3}$ | f | (62) | $2 \times 10^{-3}$ | 170 | 16.0 | 5 | 170 | 16.0 | 5 | Invention |
| 27 | 4 | V-II-4 | $1.5 \times 10^{-3}$ | f | (64) | $2 \times 10^{-3}$ | 170 | 16.0 | 5 | 170 | 16.0 | 5 | Invention |
| 28 | 3 | VI-I-10 | $1.5 \times 10^{-3}$ | f | (64) | $2 \times 10^{-3}$ | 170 | 15.0 | 4.5 | 170 | 15.0 | 5 | Invention |
| 29 | 4 | III-10 | $1.5 \times 10^{-3}$ | f | (64) | $2 \times 10^{-3}$ | 165 | 14.0 | 4 | 165 | 14.0 | 4 | Invention |
| 30 | 3 | I-10 | $1.5 \times 10^{-3}$ | f | (68) | $2 \times 10^{-3}$ | 165 | 14.0 | 4 | 165 | 14.0 | 4 | Invention |
| 31 | 4 | V-I-19 | $1.5 \times 10^{-3}$ | f | (68) | $2 \times 10^{-3}$ | 170 | 16.0 | 5 | 170 | 16.0 | 5 | Invention |
| 32 | 3 | II-6 | $1.5 \times 10^{-3}$ | f | (120) | $2 \times 10^{-3}$ | 165 | 14.0 | 4 | 165 | 14.0 | 4 | Invention |
| 33 | 4 | VI-II-34 | $1.5 \times 10^{-3}$ | f | (120) | $2 \times 10^{-3}$ | 170 | 16.0 | 5 | 170 | 16.0 | 5 | Invention |
| 34 | 3 | IV-13 | $1.5 \times 10^{-3}$ | f | (132) | $2 \times 10^{-3}$ | 170 | 14.5 | 4 | 170 | 14.5 | 4 | Invention |
| 35 | 4 | V-III-21 | $1.5 \times 10^{-3}$ | f | (132) | $2 \times 10^{-3}$ | 170 | 15.0 | 4.5 | 170 | 15.0 | 5 | Invention |
| 36 | 3 | III-10 | $1.5 \times 10^{-3}$ | f | (178) | $2 \times 10^{-3}$ | 120 | 10.5 | 3.5 | 120 | 10.5 | 3.5 | Invention |
| 37 | 4 | V-II-4 | $1.5 \times 10^{-3}$ | f | (178) | $2 \times 10^{-3}$ | 125 | 11 | 5 | 125 | 11 | 5 | Invention |
| 38 | 3 | II-1 | $1.5 \times 10^{-3}$ | f | (184) | $2 \times 10^{-3}$ | 125 | 10 | 3.5 | 125 | 10 | 3.5 | Invention |

Sample Nos. 23 to 38 according to the invention are prevented from fluctuating in sensitivity, lowering in contrast and increasing in pepper spots caused by aging.

What is claimed is:

1. A method for producing a silver halide photographic light-sensitive material, which comprises a support having thereon a photographic layer including a silver halide emulsion layer, comprising steps of coating a coating solution to form said photographic layer on said support, drying said coated layer or layers, and storing said light-sensitive material after said drying step, wherein said photographic layer may include a hydrophilic colloid sublayer which is simultaneously dried with said silver halide emulsion layer and said silver halide emulsion layer or said hydrophilic colloid layer contains a hydrazine compound represented by the following formula A-I and an amine or quaternary onium compound represented by the following Formula V-I, V-II, V-III, VI-I, VI-II or VI-III, and drying of said photographic layer, during that period in the drying process in which the water content of the photographic layer is 300% or less of the dry-weight of a hydrophilic colloid contained in the photographic layer, is carried out with air having a relative humidity of not more than 50%;

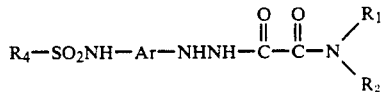

(A-1)

wherein $R_1$ and $R_2$ are each a hydrogen atom, an alkyl group, an alkenyl group, an alkynyl group, an aryl group, a saturated or unsaturated heterocyclic group, a hydroxyl group, an alkoxy group an alkenyloxy group, an alkynyloxy group, an aryloxy group, or heterocycloxy group, and at least one of said $R_1$ and $R_2$ is an alkenyl group, an alkynyl group, a saturated heterocyclic group, a hydroxyl group, an alkoxy group, an alkenyloxy group, an alkynyloxy group, an aryloxy group, or heterocycloxy group; $R_4$ is an alkyl group, an aryl group, or a saturated or unsaturated heterocyclic group; and Ar is an arylene group or a saturated or unsaturated heterocyclic group;

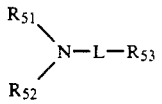

(V-I)

wherein $R_{51}$, $R_{52}$ and $R_{53}$ are each an alkyl group, an alkenyl group, an alkynyl group, an aryl group or a saturated or unsaturated heterocyclic group, provided at least one of $R_{51}$, $R_{52}$ and $R_{53}$ is an alkenyl group or an alkynyl group or at least one of $R_{51}$ and $R_{52}$ is an aryl group or a saturated or unsaturated heterocyclic group; L is a linking group; $R_{51}$ and $R_{52}$ and $R_{53}$ may be bonded to each other to form a ring;

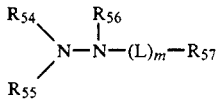

(V-II)

wherein $R_{54}$, $R_{55}$ and $R_{57}$ are each an alkyl group, an alkenyl group, an alkynyl group, an aryl group or a saturated or unsaturated heterocyclic group; $R_{56}$ is a hydrogen atom or a substituent; L is a linking group; m is 0 or 1; $R_{54}$ and $R_{55}$ may be bonded to each other to form a ring;

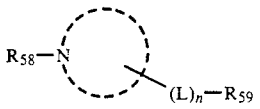

(V-III)

wherein $R_{58}$ is a hydrogen atom or a substituent; $R_{59}$ is an alkyl group, an alkenyl group, an alkynyl group, an aryl group or a heterocyclic group; L is a linking group;

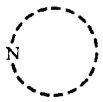

is a nitrogen-containing heterocyclic group; and n is 0 or 1; $R_{58}$ may form a ring with the

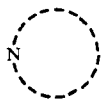

group;

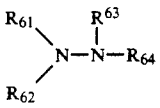

(VI-I)

wherein $R_{61}$ and $R_{62}$ are each an alkyl group, an alkenyl group, an alkynyl group, an aryl group or a heterocyclic group; $R_{63}$ is a hydrogen atom or a substituent; $R_{64}$ is a group containing a

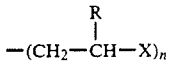

group or a

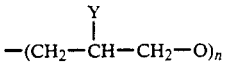

group; R is a hydrogen atom or an alkyl group; X is an oxygen atom, a sulfur atom or a —NH— group; Y is a hydrogen atom or a hydroxy group; and n is an integer 2 or more; two of $R_{61}$, $R_{62}$, $R_{63}$ and $R_{64}$ may be bonded to each other to form a ring;

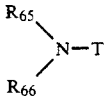

(VI-II)

wherein $R_{65}$ and $R_{66}$ are each a hydrogen atom, an alkyl group, an alkenyl group, an alkynyl group, an aryl group or a saturated or unsaturated heterocyclic group; T is a group containing a

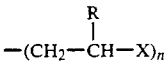

group or a

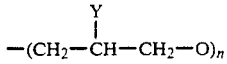

group; R is a hydrogen atom or an alkyl group; X is an oxygen atom, a sulfur atom or a —NH— group; Y is a hydrogen atom or a hydroxy group; and n is an integer of 2 or more, provided that when R is a hydrogen atom, X is a sulfur atom or a —NH— group; $R_{65}$ and $R_{66}$ may be bonded to each other to form a ring;

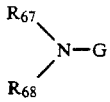

(VI-III)

wherein $R_{67}$ and $R_{68}$ are each a hydrogen atom, an alkyl group, an alkenyl group, an alkynyl group, an aryl group or a saturated or unsaturated heterocyclic group; and G is a group containing a $—(CH_2CH_2O)_n—$ group, and at least two groups each having a hydrophobic substituent constant of from −0.5 to −1.0 or at least one group having a hydrophobic substituent constant of less than −1.0; $R_{67}$ and $R_{68}$ may be bonded to each other to form a ring.

2. A method of claim 1, wherein said light-sensitive material is stored under a condition of contacting with air having a dew-point temperature of not higher than 16° C. in the period from completion of drying step to start of said storing step.

3. A method of claim 1, wherein temperature of said air used for drying said photographic layer is within the range of from 25° C. to 50° C.

4. A method of claim 1, wherein said hydrazine compound represented by formula A-1 is contained in said silver halide emulsion layer or said hydrophilic colloid sublayer in an amount of from $5\times10^{-6}$ mol to $1\times10^{-2}$ mol per mol of silver halide contained in said silver halide emulsion layer.

5. A light-sensitive material of claim 1, wherein said amine compound is a compound represented by formula V-I, V-II, VI-I or VI-II.

6. A light-sensitive material of claim 1, wherein said amine compound or quaternary onium compound are each contained in said photographic layer in an amount of from $5\times10^{-7}$ mol to $5\times10^{-1}$ mol per mol of silver halide contained in said emulsion layer.

7. A light-sensitive material of claim 6, wherein said amine compound or quaternary onium compound are each contained in said photographic layer in an amount of from $5\times10^{-6}$ mol to $1\times10^{-2}$ mol per mol of silver halide contained in said emulsion layer.

* * * * *

UNITED STATES PATENT AND TRADEMARK OFFICE

CERTIFICATE OF CORRECTION

PATENT NO. : 5,219,724

DATED : June 15, 1993

INVENTOR(S) : Mariko Kato et al.

It is certified that error appears in the above-indentified patent and that said Letters Patent is hereby corrected as shown below:

Claim 1, column 130, line 58, after "an alkoxy group" insert --,--.

Claim 1, column 132, line 57, change "-($CH_2$C-" to --($CH_2$--.

Claim 1, column 132, line 58, change "$H_2O)_n$-" to --$CH_2O)_n$- --.

Signed and Sealed this

Twenty-third Day of August, 1994

*Attest:*

Bruce Lehman

BRUCE LEHMAN

*Attesting Officer*

*Commissioner of Patents and Trademarks*